US010756404B2

(12) United States Patent
Suzuki et al.

(10) Patent No.: US 10,756,404 B2
(45) Date of Patent: Aug. 25, 2020

(54) MAGNETORESISTANCE EFFECT DEVICE AND MAGNETORESISTANCE EFFECT MODULE

(71) Applicant: TDK CORPORATION, Tokyo (JP)

(72) Inventors: Tsuyoshi Suzuki, Tokyo (JP); Shinji Hara, Tokyo (JP)

(73) Assignee: TDK CORPORATION, Tokyo (JP)

( * ) Notice: Subject to any disclaimer, the term of this patent is extended or adjusted under 35 U.S.C. 154(b) by 16 days.

(21) Appl. No.: 16/262,358

(22) Filed: Jan. 30, 2019

(65) Prior Publication Data

US 2019/0252749 A1 Aug. 15, 2019

(30) Foreign Application Priority Data

Feb. 1, 2018 (JP) ..... 2018-016680
Jan. 15, 2019 (JP) ..... 2019-004354

(51) Int. Cl.
*H01P 1/218* (2006.01)

(52) U.S. Cl.
CPC ..... *H01P 1/218* (2013.01)

(58) Field of Classification Search
CPC ..... H01P 1/218
USPC ..... 333/175
See application file for complete search history.

(56) References Cited

U.S. PATENT DOCUMENTS

| | | | |
|---|---|---|---|
| 2014/0056060 | A1 | 2/2014 | Khvalkovskiy et al. |
| 2016/0277000 | A1 | 9/2016 | Shibata et al. |
| 2017/0244377 | A1 | 8/2017 | Yamane et al. |
| 2018/0040666 | A1 | 2/2018 | Shibata et al. |

FOREIGN PATENT DOCUMENTS

| | | | |
|---|---|---|---|
| JP | 2017-063397 | A | 3/2017 |
| WO | 2007/032149 | A1 | 3/2007 |
| WO | 2018/052062 | A1 | 3/2018 |

OTHER PUBLICATIONS

Konishi, K. et al., "Radio-Frequency Amplification Property of the MgO-Based Magnetic Tunnel Junction Using Field-Induced Ferromagnetic Resonance", Appl. Phys. Lett., vol. 102, pp. 162409-1-162409-4, (2013).

*Primary Examiner* — Benny T Lee
*Assistant Examiner* — Hafizur Rahman
(74) *Attorney, Agent, or Firm* — Oliff PLC

(57) ABSTRACT

A magnetoresistance effect device includes first and second ports, first and second circuit units, and reference potential and DC applying terminals. The first and second circuit units respectively include first and second magnetoresistance effect elements and first and second conductors. In the second conductor, the positional relationship between first and second end faces respectively on the first and opposite conductor sides in the first magnetoresistance effect element with respect to a flowing direction of a direct current flowing inside the first magnetoresistance effect element and the positional relationship between first and second end faces respectively on the second and opposite conductor sides in the second magnetoresistance effect element with respect to a flowing direction of a direct current flowing in the second magnetoresistance effect element are opposite each other. The relative angle between the first and second circuit units in a predetermined cross product direction is 90 degrees or less.

20 Claims, 35 Drawing Sheets

MAGNETORESISTANCE EFFECT DEVICE AND MAGNETORESISTANCE EFFECT MODULE

The present disclosure relates to a magnetoresistance effect device and a magnetoresistance effect module.

Priority is claimed on Japanese Patent Application No. 2018-016680 filed Feb. 1, 2018 and Japanese Patent Application No. 2019-004354 filed Jan. 15, 2019, the contents of which are incorporated herein by reference.

BACKGROUND ART

In recent years, as mobile communication terminals such as cellular phones have become more sophisticated, high-speed wireless communication has advanced. Since the communication speed is proportional to the bandwidth of the frequency to be used, the frequency band required for communication is increasing. Along with this, the number of installed high frequency filters required for mobile communication terminals has also increased.

Spintronics has been being studied as a field that can be applied to new high frequency components in recent years. One of the phenomena that is attracting attention in spintronics is a ferromagnetic resonance phenomenon of a magnetoresistance effect element.

When an alternating current or alternating magnetic field is applied to a ferromagnetic layer included in a magnetoresistance effect element, ferromagnetic resonance can be caused in the magnetization of the ferromagnetic layer. When ferromagnetic resonance occurs, the resistance value of the magnetoresistance effect element oscillates cyclically at the ferromagnetic resonance frequency. The ferromagnetic resonance frequency varies depending on the intensity of the magnetic field applied to the ferromagnetic layer, and its ferromagnetic resonance frequency is generally in a high frequency band of several to several tens of GHz.

For example, Japanese Unexamined Patent Publication No. 2017-063397 describes a magnetoresistance effect device usable as a high frequency device such as a high frequency filter utilizing the ferromagnetic resonance phenomenon.

SUMMARY

However, high frequency filters using this magnetoresistance effect device do not have frequency characteristics (steepness) in the vicinity of the cutoff frequency which are sufficient.

It is desirable to provide a magnetoresistance effect device having excellent frequency characteristics in the vicinity of the cutoff frequency.

The inventors have found that by combining circuit units (elements) exhibiting predetermined characteristics, the respective characteristics thereof are superimposed on each other so that the steepness of the magnetoresistance effect device can be improved.

That is, the present disclosure provides the following means.

(1) A magnetoresistance effect device according to the first aspect includes: a first port; a second port; a first circuit unit and a second circuit unit which are connected between the first port and the second port; a shared reference potential terminal which is connected to the first circuit unit and the second circuit unit by sharing or a first reference potential terminal and a second reference potential terminal which are connected to the first circuit unit and the second circuit unit, respectively; and a shared DC applying terminal which is capable of connecting a power source for applying a direct current or a direct current voltage to a first magnetoresistance effect element of the first circuit unit and a second magnetoresistance effect element of the second circuit unit by sharing, or a first DC applying terminal and a second DC applying terminal which are capable of connecting a power source for applying a direct current or a direct current voltage to a first magnetoresistance effect element of the first circuit unit and a second magnetoresistance effect element of the second circuit unit, respectively, wherein the first circuit unit includes the first magnetoresistance effect element including a magnetization fixed layer, a magnetization free layer, and a spacer layer sandwiched therebetween, and a first conductor connected to a first end face in a stacking direction of the first magnetoresistance effect element, the first conductor is formed such that a first end portion of the first conductor is connected to an input side of a high frequency current and a second end portion of the first conductor is connected to the shared reference potential terminal or the first reference potential terminal so that a high frequency current branches to flow to the first magnetoresistance effect element and the shared reference potential terminal or the first reference potential terminal, the second circuit unit includes the second magnetoresistance effect element including a magnetization fixed layer, a magnetization free layer, and a spacer layer sandwiched therebetween, and a second conductor connected to a first end face in a stacking direction of the second magnetoresistance effect element, the second conductor is formed such that a first end portion of the second conductor is connected to an input side of a high frequency current and a second end portion of the second conductor is connected to the shared reference potential terminal or the second reference potential terminal so that a high frequency current branches to flow to the second magnetoresistance effect element and the shared reference potential terminal or the second reference potential terminal, when the shared DC applying terminal or the first DC applying terminal and the second DC applying terminal are connected to a power source, a positional relationship between the first end face and a second end face opposite to the first end face of the first magnetoresistance effect element in the stacking direction of the first magnetoresistance effect element with respect to a flowing direction of a direct current flowing inside the first magnetoresistance effect element and a positional relationship between the first end face and a second end face opposite to the first end face of the second magnetoresistance effect element in the stacking direction of the second magnetoresistance effect element with respect to a flowing direction of a direct current flowing inside the second magnetoresistance effect element are opposite to each other, and in a case where, when viewed in the stacking direction of the first magnetoresistance effect element, a direction from the first end portion toward the second end portion of the first conductor in a region where the first conductor overlaps the first magnetoresistance effect element is defined as a first direction, a stacking direction of the first magnetoresistance effect element with the first conductor as a reference is defined as a first stacking direction, and a direction of an cross product between the first direction and the first stacking direction is defined as a first cross product direction, and when viewed in the stacking direction of the second magnetoresistance effect element, a direction from the first end portion toward the second end portion of the second conductor in a region where the second conductor overlaps the second magnetoresistance effect element is defined as a second direction, a stacking direction of the second magnetoresistance effect element with the second conductor as a reference is defined as a second stacking direction, and a direction of an cross product between the second direction and the second stacking direction is defined as a second cross product direction, a relative angle between the first cross product direction and the second cross product direction is 90 degrees or less.

(2) A magnetoresistance effect device according to the second aspect includes: a first port; a second port; a first circuit unit and a second circuit unit which are connected between the first port and the second port; a shared reference potential terminal which is connected to the first circuit unit and the second circuit unit by sharing or a first reference potential terminal and a second reference potential terminal which are connected to the first circuit unit and the second circuit unit, respectively; and a shared DC applying terminal which is capable of connecting a power source for applying a direct current or a direct current voltage to a first magnetoresistance effect element of the first circuit unit and a second magnetoresistance effect element of the second circuit unit by sharing, or a first DC applying terminal and a second DC applying terminal which are capable of connecting a power source for applying a direct current or a direct current voltage to a first magnetoresistance effect element of the first circuit unit and a second magnetoresistance effect element of the second circuit unit, respectively, wherein the first circuit unit includes the first magnetoresistance effect element including a magnetization fixed layer, a magnetization free layer, and a spacer layer sandwiched therebetween, and a first conductor connected to a first end face in a stacking direction of the first magnetoresistance effect element, the first conductor is formed such that a first end portion of the first conductor is connected to an input side of a high frequency current and a second end portion of the first conductor is connected to the shared reference potential terminal or the first reference potential terminal so that a high frequency current branches to flow to the first magnetoresistance effect element and the shared reference potential terminal or the first reference potential terminal, the second circuit unit includes the second magnetoresistance effect element including a magnetization fixed layer, a magnetization free layer, and a spacer layer sandwiched therebetween, and a second conductor connected to a first end face in a stacking direction of the second magnetoresistance effect element, the second conductor is formed such that a first end portion of the second conductor is connected to an input side of a high frequency current and a second end portion of the second conductor is connected to the shared reference potential terminal or the second reference potential terminal so that a high frequency current branches to flow to the second magnetoresistance effect element and the shared reference potential terminal or the second reference potential terminal, a positional relationship between the first end face and a second end face opposite to the first end face of the first magnetoresistance effect element in the stacking direction of the first magnetoresistance effect element with respect to a connection point on an input side of a direct current or a direct current voltage of the first magnetoresistance effect element and a positional relationship between the first end face and a second end face opposite to the first end face of the second magnetoresistance effect element in the stacking direction of the second magnetoresistance effect element with respect to a connection point on an input side of a direct current or a direct current voltage of the second magnetoresistance effect element are opposite to each other, and in a case where, when viewed in the stacking direction of the first magnetoresistance effect element, a direction from the first end portion toward the second end portion of the first conductor in a region where the first conductor overlaps the first magnetoresistance effect element is defined as a first direction, a stacking direction of the first magnetoresistance effect element with the first conductor as a reference is defined as a first stacking direction, and a direction of an cross product between the first direction and the first stacking direction is defined as a first cross product direction, and when viewed in the stacking direction of the second magnetoresistance effect element, a direction from the first end portion toward the second end portion of the second conductor in a region where the second conductor overlaps the second magnetoresistance effect element is defined as a second direction, a stacking direction of the second magnetoresistance effect element with the second conductor as a reference is defined as a second stacking direction, and a direction of an cross product between the second direction and the second stacking direction is defined as a second cross product direction, a relative angle between the first cross product direction and the second cross product direction is 90 degrees or less.

(3) A magnetoresistance effect device according to the third aspect includes: a first port; a second port; a first circuit unit and a second circuit unit which are connected between the first port and the second port; a shared reference potential terminal which is connected to the first circuit unit and the second circuit unit by sharing or a first reference potential terminal and a second reference potential terminal which are connected to the first circuit unit and the second circuit unit, respectively; and a shared DC applying terminal which is capable of connecting a power source for applying a direct current or a direct current voltage to a first magnetoresistance effect element of the first circuit unit and a second magnetoresistance effect element of the second circuit unit by sharing, or a first DC applying terminal and a second DC applying terminal which are capable of connecting a power source for applying a direct current or a direct current voltage to a first magnetoresistance effect element of the first circuit unit and a second magnetoresistance effect element of the second circuit unit, respectively, wherein the first circuit unit includes the first magnetoresistance effect element including a magnetization fixed layer, a magnetization free layer, and a spacer layer sandwiched therebetween, and a first conductor connected to a first end face in a stacking direction of the first magnetoresistance effect element, the first conductor is formed such that a first end portion of the first conductor is connected to an input side of a high frequency current and a second end portion of the first conductor is connected to the shared reference potential terminal or the first reference potential terminal so that a high frequency current branches to flow to the first magnetoresistance effect element and the shared reference potential terminal or the first reference potential terminal, the second circuit unit includes the second magnetoresistance effect element including a magnetization fixed layer, a magnetization free layer, and a spacer layer sandwiched therebetween, and a second conductor connected to a first end face in a stacking direction of the second magnetoresistance effect element, the second conductor is formed such that a first end portion of the second conductor is connected to an input side of a high frequency current and a second end portion of the second conductor is connected to the shared reference potential terminal or the second reference potential terminal so that a high frequency current branches to flow to the second magnetoresistance effect element and the shared reference potential terminal or the second reference potential terminal, when the shared DC applying terminal or the first DC applying terminal and the second DC applying terminal are connected to a power source, a positional relationship between the first end face and a second end face opposite to the first end face of the first magnetoresistance effect element in the stacking direction of the first magnetoresistance effect element with respect to a flowing direction of a direct current flowing inside the first magnetoresistance effect element and a positional relationship between the first end face and a second end face opposite to the first end face of the second magnetoresistance effect element in the stacking direction of the second magnetoresistance effect element with respect to a flowing direction of a direct current flowing inside the second magnetoresistance effect element are the same, and in a case where, when viewed in the stacking direction of the first magnetoresistance effect element, a direction from the first end portion toward the second end portion of the first conductor in a region where the first conductor overlaps the first magnetoresistance effect element is defined as a first direction, a stacking direction of the first magnetoresistance effect element with the first conductor as a reference is defined as a first stacking direction, and a direction of an cross product between the first direction and the first stacking direction is defined as a first cross product direction, and when viewed in the stacking direction of the second magnetoresistance effect element, a direction from the first end portion toward the second end portion of the second conductor in a region where the second conductor overlaps the second magnetoresistance effect element is defined as a second direction, a stacking direction of the second magnetoresistance effect element with the second conductor as a reference is defined as a second stacking direction, and a direction of an cross product between the second direction and the second stacking direction is defined as a second cross product direction, a relative angle between the first cross product direction and the second cross product direction is larger than 90 degrees.

(4) A magnetoresistance effect device according to the fourth aspect includes: a first port; a second port; a first circuit unit and a second circuit unit which are connected between the first port and the second port; a shared reference potential terminal which is connected to the first circuit unit and the second circuit unit by sharing or a first reference potential terminal and a second reference potential terminal which are connected to the first circuit unit and the second circuit unit, respectively; and a shared DC applying terminal which is capable of connecting a power source for applying a direct current or a direct current voltage to a first magnetoresistance effect element of the first circuit unit and a second magnetoresistance effect element of the second circuit unit by sharing, or a first DC applying terminal and a second DC applying terminal which are capable of connecting a power source for applying a direct current or a direct current voltage to the first magnetoresistance effect element of the first circuit unit and the second magnetoresistance effect element of the second circuit unit, respectively, wherein the first circuit unit includes the first magnetoresistance effect element including a magnetization fixed layer, a magnetization free layer, and a spacer layer sandwiched therebetween, and a first conductor connected to a first end face in a stacking direction of the first magnetoresistance effect element, the first conductor is formed such that a first end portion of the first conductor is connected to an input side of a high frequency current and a second end portion of the first conductor is connected to the shared reference potential terminal or the first reference potential terminal so that a high frequency current branches to flow to the first magnetoresistance effect element and the shared reference potential terminal or the first reference potential terminal, the second circuit unit includes the second magnetoresistance effect element including a magnetization fixed layer, a magnetization free layer, and a spacer layer sandwiched therebetween, and a second conductor connected to a first end face in a stacking direction of the second magnetoresistance effect element, the second conductor is formed such that a first end portion of the second conductor is connected to an input side of a high frequency current and a second end portion of the second conductor is connected to the shared reference potential terminal or the second reference potential terminal so that a high frequency current branches to flow to the second magnetoresistance effect element and the shared reference potential terminal or the second reference potential terminal, a positional relationship between the first end face and a second end face opposite to the first end face of the first magnetoresistance effect element in the stacking direction of the first magnetoresistance effect element with respect to a connection point on an input side of a direct current or a direct current voltage of the first magnetoresistance effect element and a positional relationship between the first end face and a second end face opposite to the first end face of the second magnetoresistance effect element in the stacking direction of the second magnetoresistance effect element with respect to a connection point on an input side of a direct current or a direct current voltage of the second magnetoresistance effect element are the same, and in a case where, when viewed in the stacking direction of the first magnetoresistance effect element, a direction from the first end portion toward the second end portion of the first conductor in a region where the first conductor overlaps the first magnetoresistance effect element is defined as a first direction, a stacking direction of the first magnetoresistance effect element with the first conductor as a reference is defined as a first stacking direction, and a direction of an cross product between the first direction and the first stacking direction is defined as a first cross product direction, and when viewed in the stacking direction of the second magnetoresistance effect element, a direction from the first end portion toward the second end portion of the second conductor in a region where the second conductor overlaps the second magnetoresistance effect element is defined as a second direction, a stacking direction of the second magnetoresistance effect element with the second conductor as a reference is defined as a second stacking direction, and a direction of an cross product between the second direction and the second stacking direction is defined as a second cross product direction, a relative angle between the first cross product direction and the second cross product direction is larger than 90 degrees.

MODES FOR CARRYING OUT THE INVENTION

Figure 1:
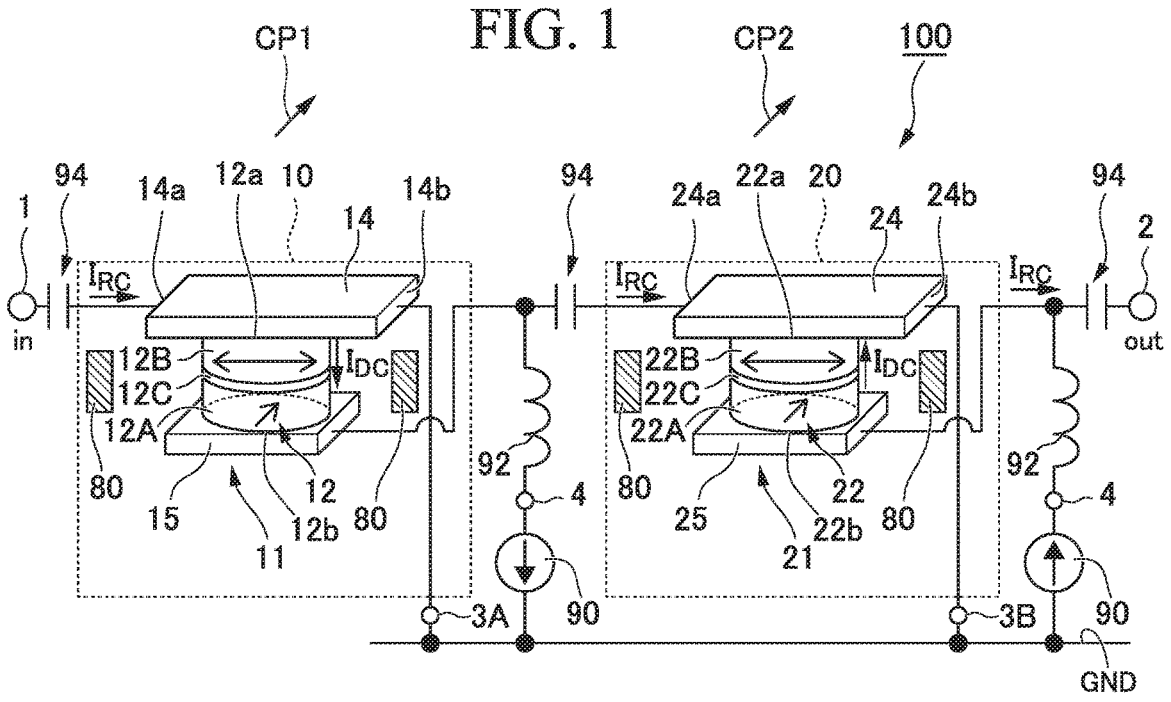
FIG. 1 is a schematic diagram showing a circuit configuration of a magnetoresistance effect device according to a first embodiment.

Hereinafter, the magnetoresistance effect module will be described in detail with reference to the drawings as appropriate. In the drawings used in the following description, in order to facilitate understanding of the features, the characteristic portions are sometimes enlarged for convenience, and the dimensional ratios and the like between the respective components may be different from actual ones. Materials, sizes, and the like illustrated in the following description are merely examples, and the present disclosure is not limited thereto, and may be appropriately modified and implemented within the range that achieves the effects of the present disclosure.

According to the magnetoresistance effect devices of the embodiments described below, it is possible to obtain excellent frequency characteristics in the vicinity of the cutoff frequency.

First Embodiment

FIG. 1 is a schematic diagram showing a circuit configuration of a magnetoresistance effect module 100 according to a first embodiment. A magnetoresistance effect device includes a first port 1, a second port 2, a first circuit unit 10, a second circuit unit 20, reference potential terminals 3A and 3B, and a DC applying terminal 4. The magnetoresistance effect module 100 is formed by connecting a power supply 90 to the DC applying terminal 4. The magnetoresistance effect module 100 receives signals from the first port 1 and outputs signals from the second port 2.

<First Port and Second Port>

The first port 1 is an input terminal of the magnetoresistance effect module 100. By connecting an alternating current signal source (not shown) to the first port 1, alternating current signals (high frequency signals) can be applied to the magnetoresistance effect module 100. The high frequency signals applied to the magnetoresistance effect module 100 are, for example, signals having a frequency of 100 MHz or more.

The second port 2 is an output terminal of the magnetoresistance effect module 100.

<First Circuit Unit>

The first circuit unit 10 is connected between the first port 1 and the second port 2. A current branch type element 11 is incorporated in the first circuit unit 10. The current branch type element 11 includes a first magnetoresistance effect element 12 and a first conductor 14. The first conductor 14 is connected to one end (a first end face 12*a*) in a stacking direction of the first magnetoresistance effect element 12. A first end portion 14*a* of the first conductor 14 is connected to an input side of a high frequency current of the first circuit unit 10 and a second end portion 14*b* of the first conductor 14 is connected to the reference potential terminal 3A. The high frequency current $I_{RC}$ flowing through the first conductor 14 branches to flow to the first magnetoresistance effect element 12 and the reference potential terminal 3A.

<First Conductor>

The first conductor 14 is a wiring for allowing passing of the high frequency current $I_{RC}$ and also functions as an electrode provided on the first end face 12*a* in the stacking direction of the first magnetoresistance effect element 12. The first conductor 14 is made of a material having conductivity. For example, Ta, Cu, Au, AuCu, Ru, Al, or the like can be used for the first conductor 14. A counter electrode 15 may be provided on the other end (a second end face 12*b*) in the stacking direction of the first magnetoresistance effect element 12. For the counter electrode 15, the same materials as exemplified for the first conductor 14 can be used. The other end (the second end face 12*b*) in the stacking direction of the first magnetoresistance effect element 12 is connected to an output side of the high frequency current $I_{RC}$ in the first circuit unit 10 via the counter electrode 15.

<Magnetoresistance Effect Element>

The first magnetoresistance effect element 12 has a magnetization fixed layer 12A, a magnetization free layer 12B, and a spacer layer 12C. The spacer layer 12C is positioned between the magnetization fixed layer 12A and the magnetization free layer 12B. It is more difficult for the magnetization of the magnetization fixed layer 12A to move than the magnetization of the magnetization free layer 12B and it is fixed in one direction under a predetermined magnetic field environment. The magnetization direction of the magnetization free layer 12B changes relatively with respect to the magnetization direction of the magnetization fixed layer 12A, thereby functioning as the first magnetoresistance effect element 12. Although FIG. 1 shows an example in which the magnetization fixed layer 12A is positioned on the counter electrode 15 side and the magnetization free layer 12B is positioned on the first conductor 14 side, the magnetization fixed layer 12A may be positioned on the first conductor 14 side and the magnetization free layer 12B may be positioned on the counter electrode 15 side.

The magnetization fixed layer 12A is made of a ferromagnetic material. Preferably, the magnetization fixed layer 12A is made of high spin polarization materials such as Fe, Co, Ni, an alloy of Ni and Fe, an alloy of Fe and Co, or an alloy of Fe, Co and B. By using these materials, a magnetoresistance change rate of the first magnetoresistance effect element 12 is increased. The magnetization fixed layer 12A may be made of a Heusler alloy. Preferably, a film thickness of the magnetization fixed layer 12A is 1 to 20 nm.

There is no particular limitation on a method of fixing the magnetization of the magnetization fixed layer 12A. For example, in order to fix the magnetization of the magnetization fixed layer 12A, an antiferromagnetic layer may be added to be in contact with the magnetization fixed layer 12A. Also, the magnetization of the magnetization fixed layer 12A may be fixed by utilizing the magnetic anisotropy caused by the crystal structure, the form, and the like. FeO, CoO, NiO, $CuFeS_2$, IrMn, FeMn, PtMn, Cr, Mn or the like can be used for the antiferromagnetic layer.

The magnetization free layer 12B is made of a ferromagnetic material the magnetization direction of which can be changed by an externally applied magnetic field or a spin polarized current.

For a material of the magnetization free layer 12B, CoFe, CoFeB, CoFeSi, CoMnGe, CoMnSi, CoMnAl, FeB, Co, a CoCr based alloy, a Co multilayer film, a CoCrPt based alloy, an FePt based alloy, an SmCo alloy including a rare earth element, a TbFeCo alloy or the like can be used. Also, the magnetization free layer 12B may be made of a Heusler alloy.

Preferably, a thickness of the magnetization free layer 12B is about 0.5 to 20 nm. Also, a high spin polarization material may be inserted between the magnetization free layer 12B and the spacer layer 12C. By inserting a high spin polarization material, a high magnetoresistance change rate can be obtained.

A CoFe alloy or a CoFeB alloy can be exemplified as a high spin polarization material. Preferably, a film thickness of both the CoFe alloy and the CoFeB alloy is set to about 0.2 to 1.0 nm.

The spacer layer 12C is a layer disposed between the magnetization fixed layer 12A and the magnetization free layer 12B. The spacer layer 12C is configured by a layer formed of a conductor, an insulator, or a semiconductor, or a layer including a conductive point formed of a conductor in an insulator. Preferably, the spacer layer 12C is a non-magnetic layer.

For example, the first magnetoresistance effect element 12 becomes a tunneling magnetoresistance (TMR) effect element when the spacer layer 12C is made of an insulator and becomes a giant magnetoresistance (GMR) effect element when the spacer layer 12C is made of metal.

When an insulating material is used as the spacer layer 12C, an insulating material such as $Al_2O_3$, MgO or $MgAl_2O_4$ can be used. A high magnetoresistance change rate can be obtained by adjusting a film thickness of the spacer layer 12C so that a coherent tunneling effect develops between the magnetization fixed layer 12A and the magnetization free layer 12B. In order to efficiently utilize the TMR effect, preferably, a film thickness of the spacer layer 12C is about 0.5 to 3.0 nm.

When the spacer layer 12C is made of a conductive material, a conductive material such as Cu, Ag, Au or Ru can be used. In order to efficiently utilize the GMR effect, preferably, the film thickness of the spacer layer 12C may be about 0.5 to 3.0 nm.

When the spacer layer 12C is made of a semiconductor material, a material such as ZnO, $In_2O_3$, $SnO_2$, ITO, $GaO_x$, or $Ga_2O_x$ can be used. In this case, preferably, the film thickness of the spacer layer 12C is about 1.0 to 4.0 nm.

When a layer including a conductive point formed of a conductor in a nonmagnetic insulator is used as the spacer layer 12C, preferably, it has a structure including a conductive point formed of a conductor such as CoFe, CoFeB, CoFeSi, CoMnGe, CoMnSi, CoMnAl, Fe, Co, Au, Cu, Al or Mg in a nonmagnetic insulator made of $Al_2O_3$ or MgO or the like. In this case, preferably, the film thickness of the spacer layer 12C is about 0.5 to 2.0 nm.

A cap layer may be provided on a side of the magnetization free layer 12B opposite to the spacer layer 12C side (between the magnetization free layer 12B and the first conductor 14). Preferably, the magnetization free layer 12B and the cap layer is in contact with each other. Further, a seed layer or a buffer layer may be provided between the first magnetoresistance effect element 12 and the counter electrode 15. As the cap layer, the seed layer, or the buffer layer, a metal film of Ru, Ta, Cu, Cr or the like, an oxide film of MgO or the like, or a stacked film thereof can be exemplified. When these layers are made of oxide films, thicknesses of these layers are thin enough to allow a current to flow. For example, preferably, the thickness is a thickness such that a current (including a tunneling current) flows when a voltage of 3 V is applied in the stacking direction of the first magnetoresistance effect element 12, and preferably, it is 5 nm or less, specifically.

Desirably, a size of the first magnetoresistance effect element 12 formed is such that a long side of the first magnetoresistance effect element 12 in a plan view shape is 500 nm or less. Also, desirably, a short side of the first magnetoresistance effect element 12 in a plan view shape is 50 nm or more. When the first magnetoresistance effect element 12 in a plan view shape is not a rectangle (including a square), a long side of a rectangle that circumscribes a shape of the first magnetoresistance effect element 12 in a plan view with a minimum area is defined as the long side of the first magnetoresistance effect element 12 in a plan view shape, and a short side of a rectangle that circumscribes a shape of the first magnetoresistance effect element 12 in a plan view with a minimum area is defined as the short side of the first magnetoresistance effect element 12 in a plan view shape.

When the long side is as small as 500 nm or less, a volume of the magnetization free layer 12B becomes small so that a highly efficient ferromagnetic resonance phenomenon can be realized. Here, the "a plan view shape" is a shape as viewed in the stacking direction of each layer which constitutes the first magnetoresistance effect element 12.

<Second Circuit Unit>

The second circuit unit 20 is connected between the first port 1 and the second port 2. The second circuit unit 20 shown in FIG. 1 is connected between the first circuit unit 10 and the second port 2 and the first circuit unit 10 and the second circuit unit 20 are connected in series. In the second circuit unit 20, the same current branch type element 21 as the current branch type element 11 incorporated in the first circuit unit 10 is incorporated.

The current branch type element 21 shown in FIG. 1 includes a second magnetoresistance effect element 22 and a second conductor 24. The second conductor 24 is connected to one end (a first end face 22*a*) in a stacking direction of the second magnetoresistance effect element 22. A first end portion 24*a* of the second conductor 24 is connected to an input side of the high frequency current $I_{RC}$ in the second circuit unit 20 and a second end portion 24*b* of the second conductor 24 is connected to the reference potential terminal 3B. The high frequency current $I_{RC}$ flowing through the second conductor 24 branches to flow to the second magnetoresistance effect element 22 and the reference potential terminal 3B. The second magnetoresistance effect element 22 has a magnetization fixed layer 22A, a magnetization free layer 22B, and a spacer layer 22C, and the second conductor 24 is provided at one end (the first end face 22*a*) in the stacking direction and a counter electrode 25 is provided at the other end (a second end face 22*b*) in the stacking direction. Although FIG. 1 shows an example in which the magnetization fixed layer 22A is positioned on the counter electrode 25 side and the magnetization free layer 22B is positioned on the second conductor 24 side, the magnetization fixed layer 22A may be positioned on the second conductor 24 side and the magnetization free layer 22B may be positioned on the counter electrode 25 side. For the second magnetoresistance effect element 22, the second conductor 24 and the counter electrode 25, ones similar to those exemplified for the first magnetoresistance effect element 12, the first conductor 14 and the counter electrode 15 can be used. The second end face 22*b* in the stacking direction of the second magnetoresistance effect element 22 is connected to an output side (the second port 2) of the high frequency current $I_{RC}$ in the second circuit unit 20 via the counter electrode 25.

<Reference Potential Terminal>

The reference potential terminals 3A and 3B are directly or indirectly connected to the first circuit unit 10 and the second circuit unit 20, respectively. The reference potential terminals 3A and 3B are connected to a reference potential and determine the reference potential of the magnetoresistance effect module 100. In FIG. 1, the reference potential is connected to the ground GND. The ground GND is provided outside the magnetoresistance effect module 100. The high frequency current IRE input to the first port 1 flows through the first circuit unit 10 and the second circuit unit 20 in accordance with a potential difference from the reference potential. In FIG. 1, the reference potential terminal 3A is connected to the first circuit unit 10 and the reference potential terminal 3B is connected to the second circuit unit 20. The reference potential terminals may be integrated into a common one for the first circuit unit 10 and the second circuit unit 20.

<DC Applying Terminal>

The DC applying terminal 4 is connected to the power supply 90 and applies a direct current or a direct current voltage in the stacking direction of the first magnetoresistance effect element 12 and the second magnetoresistance effect element 22. The first magnetoresistance effect element 12 is connected to the DC applying terminal 4 which is capable of connecting the power supply 90 for applying a direct current or a direct current voltage to the first magnetoresistance effect element 12. The second magnetoresistance effect element 22 is connected to the DC applying terminal 4 which is capable of connecting the power supply 90 for applying a direct current or a direct current voltage to the second magnetoresistance effect element 22. In the specification, the direct current is a current of which direction does not change with time and includes a current of which magnitude varies with time. Also, the direct current voltage is a voltage whose polarity does not change with time and also includes a voltage whose magnitude changes with time. The power supply 90 may be a direct current source or a direct current voltage source. The power supply 90 may be a direct current source capable of generating a constant direct current or a direct current voltage source capable of generating a constant direct current voltage. The power supply 90 may be a direct current source capable of changing the magnitude of the generated direct current value or a direct current voltage source capable of changing the magnitude of the generated direct current voltage value.

Preferably, a current density of a direct current applied to each of the first magnetoresistance effect element 12 and the second magnetoresistance effect element 22 is smaller than an oscillation threshold current density of each of the first magnetoresistance effect element 12 and the second magnetoresistance effect element 22. The oscillation threshold current density of each of the first magnetoresistance effect element 12 and the second magnetoresistance effect element 22 is a threshold value of a current density where, by applying a current having a current density equal to or larger than the threshold value, the magnetization of each of the magnetization free layers 12B and 22B starts precession at a constant frequency and constant amplitude, whereby each of the first magnetoresistance effect element 12 and the second magnetoresistance effect element 22 oscillates (outputs (resistance values) of each of the first magnetoresistance effect element 12 and the second magnetoresistance effect element 22 varies at a constant frequency and a constant amplitude).

As shown in FIG. 1, when the power supply 90 is a direct current source, the power supply 90 is connected to the DC applying terminal 4 such that the direct current $I_{DC}$ flows from the first end face 12*a* on the first conductor 14 side of the first magnetoresistance effect element 12 toward the second end face 12*b* and the direct current $I_{DC}$ flows from the second end face 22*b* of the second magnetoresistance effect element 22 toward the first end face 22*a* on the first conductor 24 side. That is, when the DC applying terminal 4 is connected to the power supply 90, the positional relationship between the first end face 12*a* and the second end face 12*b* of the first magnetoresistance effect element 12 in the flowing direction of the direct current $I_{DC}$ flowing through the first magnetoresistance effect element 12 and the positional relationship between the first end face 22*a* and the second end face 22*b* of the second magnetoresistance effect element 22 in the flowing direction of the direct current $I_{DC}$ flowing through the second magnetoresistance effect element 22 are opposite to each other.

In addition, when the power supply 90 is a direct current voltage source, the power supply 90 is connected to the DC applying terminal 4 such that a direct current voltage by which the first end face 12*a* of the first magnetoresistance effect element 12 is at a higher potential than the second end face 12*b* is applied from the DC applying terminal 4 and a direct current voltage by which the second end face 22*a* of the second magnetoresistance effect element 22 is at a higher potential than the first end face 22*a* is applied from the DC applying terminal 4.

Also, the positional relationship between the first end face 12*a* and the second end face 12*b* of the first magnetoresistance effect element 12 with respect to a connection point on an input side of a direct current or a direct current voltage of the first magnetoresistance effect element 12 and the positional relationship between the first end face 22*a* and the second end face 22*b* of the second magnetoresistance effect element 22 with respect to a connection point on an input side of a direct current or a direct current voltage of the second magnetoresistance effect element 22 are opposite to each other.

The "connection point on an input side of a direct current or a direct current voltage" is a connection point on a side where a direct current is applied to the circuit unit or a connection point on a higher potential side set by a direct current voltage source. In the example shown in FIG. 1, the connection point in the current branch type element 11 of the first circuit unit 10 is the second end portion 14*b* of the first conductor 14 and the connection point in the current branch type element 21 of the second circuit unit 20 is one end of the counter electrode 25. In the first magnetoresistance effect element 12, the first end face 12*a* and the second end face 12*b* are arranged in this order from the side close to the first conductor 14. In the second magnetoresistance effect element 22, the second end face 22*b* and the first end face 22*a* are arranged in this order from the side close to the counter electrode 25. In other words, the positional relationships between the first end faces 12*a* and 22*a* and the second end faces 12*b* and 22*b* with respect to the connection points on the input sides of the direct current or the direct current voltage are reversed between the first magnetoresistance effect element 12 and the second magnetoresistance effect element 22.

In FIG. 1, the stacking order of the magnetization fixed layers 12A and 22A, the spacer layers 12C and 22C, and the magnetization free layers 12B and 22B in the first magnetoresistance effect element 12 and the second magnetoresistance effect element 22 is the same. That is, after layers to be the first magnetoresistance effect element 12 and the second magnetoresistance effect element 22 are stacked, unnecessary portions are removed by a technique such as photolithography, whereby the first magnetoresistance effect element 12 and the second magnetoresistance effect element 22 can be manufactured at one time.

<Other Constituents>

Inductors 92 and capacitors 94 are disposed in the magnetoresistance effect module 100. The inductor 92 cuts off high frequency components of a current and passes invariant components of a current. The capacitor 94 passes high frequency components of a current and cuts of invariant components of a current. The inductor 92 is disposed in a portion in which flow of the high frequency current $I_{RC}$ is required to be inhibited, and the capacitor 94 is disposed in a portion in which flow of the direct current $I_{DC}$ is required to be inhibited. In FIG. 1, the inductor 92 controls the high frequency current $I_{RC}$ output from the counter electrode 15 such that it flows to the second conductor 24 without branching and controls the high frequency current $I_{RC}$ output from the counter electrode 25 such that it flows to the second port 2 without branching. Also, the capacitor 94 inhibits the direct current $I_{DC}$ flowing through the first magnetoresistance effect element 12 from flowing to the first port 1 and the second magnetoresistance effect element 22 and inhibits the direct current $I_{DC}$ flowing through the second magnetoresistance effect element 22 from flowing to the second port 2 and the first magnetoresistance effect element 12.

A chip inductor, an inductor with a pattern line, a resistance element with an inductor component, or the like can be used for the inductor 92. Preferably, the inductance of the inductor 92 is 10 nH or more. Known types of capacitor can be used for the capacitor 94.

Each circuit unit and each terminal are connected by a signal line. Preferably, the form of the signal line is defined as a microstrip line (MSL) type or a coplanar waveguide (CPW) type. When there is a design using a microstrip line (MSL) type or a coplanar waveguide (CPW) type, preferably, a line width and a distance between grounds is designed such that the characteristic impedance of the signal line is equal to the impedance of the circuit system. By designing in this manner, the transmission loss of the signal line can be reduced.

In addition, the relative angle between a first cross product direction in the first circuit unit 10 and a second cross product direction in the second circuit unit 20 in the magnetoresistance effect module 100 is 90 degrees or less. The first cross product direction CP1 and the second cross product direction CP2 are defined as follows. Also, in this specification, the "cross product" is a vector product.

When viewed in the stacking direction of the first magnetoresistance effect element 12, the direction from the first end portion 14*a* toward the second end portion 14*b* of the first conductor 14 in the region where the first conductor 14 and the first magnetoresistance effect element 12 overlap is defined as a first direction. In other words, when viewed in the stacking direction of the first magnetoresistance effect element 12, the direction from the input side of the high frequency current to the reference potential terminal side in the region where the first conductor 14 and the first magnetoresistance effect element 12 overlap is defined as the first direction. In the first circuit unit 10 of FIG. 1, the first direction is a direction from the left to the right of the drawing.

Further, the stacking direction of the first magnetoresistance effect element 12 with respect to the first conductor 14 is taken as a first stacking direction. In FIG. 1, the first magnetoresistance effect element 12 is positioned below the first conductor 14. The first stacking direction in the first circuit unit 10 of FIG. 1 is a direction from top to bottom of the drawing.

The first cross product direction CP1 is the direction of the cross product between the first direction and the first stacking direction. Here, "the cross product between the first direction and the first stacking direction" is expressed by the following equation (1).

[Math. 1]

$$\text{"The cross product between the first direction and the first stacking direction"} = a \times b \quad (1)$$

(a: a unit vector in the first direction, b: a unit vector in the first stacking direction)

The first cross product direction CP1 in the first circuit unit 10 of FIG. 1 is a direction from in front to behind the drawing.

The second cross product direction CP2 is defined in the same way as the first cross product direction CP1. When viewed in the stacking direction of the second magnetoresistance effect element 22, the direction from the first end portion 24*a* toward the second end portion 24*b* of the second conductor 24 in the region where the second conductor 24 and the second magnetoresistance effect element 22 overlap is defined as a second direction. In other words, when viewed in the stacking direction of the second magnetoresistance effect element 22, the direction from the input side of the high frequency current to the reference potential terminal side in the region where the second conductor 24 and the second magnetoresistance effect element 22 overlap is defined as the second direction. In the second circuit unit 20 of FIG. 1, the second direction is a direction from the left to the right of the drawing.

Further, the stacking direction of the second magnetoresistance effect element 22 with respect to the second conductor 24 is taken as a second stacking direction. In the second circuit unit 20 of FIG. 1, the second magnetoresistance effect element 22 is positioned below the first conductor 24. The second stacking direction in the second circuit unit 20 of FIG. 1 is a direction from top to bottom of the drawing.

The second cross product direction CP2 is the direction of the cross product between the second direction and the second stacking direction. Here, "the cross product between the second direction and the second stacking direction" is expressed by the following equation (2).

[Math. 2]

$$\text{"The cross product between the second direction and the second stacking direction"} = a' \times b' \quad (2)$$

(a': a unit vector in the second direction, b': a unit vector in the second stacking direction)

The second cross product direction CP2 in the second circuit unit 20 of FIG. 1 is a direction from in front to behind the drawing.

The relative angle between the first cross product direction CP1 and the second cross product direction CP2 in the magnetoresistance effect module 100 shown in FIG. 1 is 0 degrees, and the relative angle between the first cross product direction CP1 and the second cross product direction CP2 is 90 degrees or less.

In addition, preferably, the magnetoresistance effect module 100 has a frequency setting mechanism 80. The frequency setting mechanism 80 is a magnetic field applying mechanism that applies an external magnetic field serving as a static magnetic field to the first magnetoresistance effect element 12 and the second magnetoresistance effect element 22. The frequency setting mechanism 80 sets ferromagnetic resonance frequencies of the magnetization free layers 12B and 22B of the first magnetoresistance effect element 12 and the second magnetoresistance effect element 22. The frequency of the signal output by the magnetoresistance effect module 100 varies depending on the ferromagnetic resonance frequencies of the magnetization free layers 12B and 22B. That is, the frequency of the output signal can be set by the frequency setting mechanism 80.

The frequency setting mechanism 80 may be provided in each of the first magnetoresistance effect element 12 and the second magnetoresistance effect element 22 or may be provided in common. The frequency setting mechanism 80 is configured by a magnetic field applying mechanism of an electromagnetic type or a strip line type capable of variably controlling an applied magnetic field strength using either voltage or current, for example. Further, it may be configured by a combination of a magnetic field applying mechanism of an electromagnetic type or a strip line type capable of variably controlling an applied magnetic field strength and a permanent magnet for supplying only a constant magnetic field.

<Function of Magnetoresistance Effect Device>

When a high frequency signal is input from the first port 1 to the magnetoresistance effect module 100, a high frequency current $I_{RC}$ corresponding to a high frequency signal flows to the first circuit unit 10. The high frequency current $I_{RC}$ branches to flow to the first magnetoresistance effect element 12 and the reference potential terminal 3A.

The magnetization of the magnetization free layer 12B oscillates mainly due to receiving a high frequency magnetic field generated by the high frequency current $I_{RC}$ flowing through the first conductor 14. Due to the ferromagnetic resonance phenomenon, the magnetization of the magnetization free layer 12B greatly oscillates when the frequency of the high frequency current $I_{RC}$ is in the vicinity of the ferromagnetic resonance frequency of the magnetization free layer 12B. When the oscillation of the magnetization of the magnetization free layer 12B becomes large, a change in the resistance value in the first magnetoresistance effect element 12 increases. This change in the resistance value is output from the first magnetoresistance effect element 12 (the first circuit unit 10) by applying the direct current $I_{DC}$ in the stacking direction of the first magnetoresistance effect element 12. A sum of the output due to the change in the resistance value caused by the ferromagnetic resonance phenomenon and the output due to the high frequency current $I_{RC}$ that branches to flow to the first magnetoresistance effect element 12 is output from the first magnetoresistance effect element 12 (the first circuit unit 10). The output due to the change in the resistance value caused by the ferromagnetic resonance phenomenon increases as the change in the resistance value increases. That is, the output from the first magnetoresistance effect element 12 (the first circuit unit 10) becomes larger with respect to a signal having a frequency in the vicinity of the ferromagnetic resonance frequency of the magnetization free layer 12B, and becomes smaller with respect to a signal having a frequency deviating from the vicinity of the ferromagnetic resonance frequency of the magnetization free layer 12B since the amount of variation in the resistance value of the first magnetoresistance effect element 12 is small.

Then, the high frequency current $I_{RC}$ output from the first circuit unit 10 passes through the capacitor 94 and flows to the second circuit unit 20. In the second circuit unit 20, in the same manner as in the first circuit unit 10, the high frequency current $I_{RC}$ branches to flow to the second magnetoresistance effect element 22 and the reference potential terminal 3B. Also, the magnetization of the magnetization free layer 22B oscillates greatly when the frequency of the high frequency current $I_{RC}$ is in the vicinity of the ferromagnetic resonance frequency of the magnetization free layer 22B.

When the oscillation of the magnetization of the magnetization free layer 22B becomes large, a change in the resistance value in the second magnetoresistance effect element 22 increases. This change in the resistance value is output from the second magnetoresistance effect element 22 (the second circuit unit 20) by applying the direct current $I_{DC}$ in the stacking direction of the second magnetoresistance effect element 22. A sum of the output due to the change in the resistance value caused by the ferromagnetic resonance phenomenon and the output due to the high frequency current $I_{RC}$ that branches to flow to the second magnetoresistance effect element 22 is output from the second magnetoresistance effect element 22 (the second circuit unit 20) to be output from the second port 2. The output from the second magnetoresistance effect element 22 (the second circuit unit 20) becomes larger with respect to a signal having a frequency in the vicinity of the ferromagnetic resonance frequency of the magnetization free layer 22B, and becomes smaller with respect to a signal having a frequency deviating from the vicinity of the ferromagnetic resonance frequency of the magnetization free layer 22B since the amount of variation in the resistance value of the second magnetoresistance effect element 22 is small.

Figure 2A:
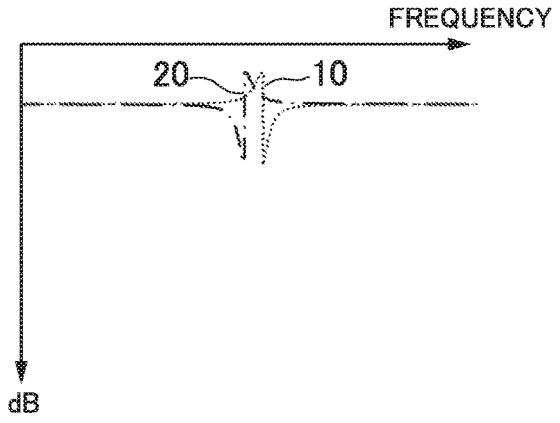
FIG. 2A is a schematic diagram showing signal characteristics when a first circuit unit and a second circuit unit are independent.
Figure 2B:
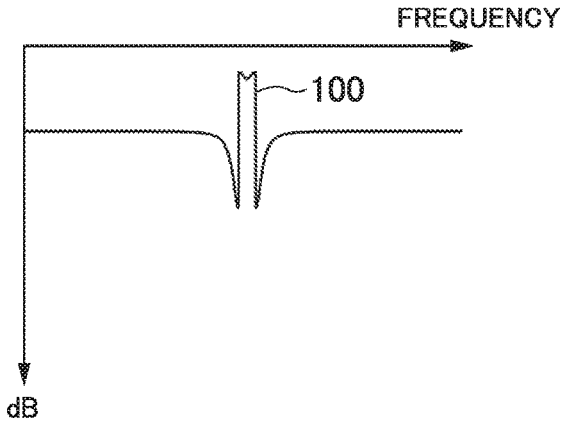
FIG. 2B is a schematic diagram showing signal characteristics of a magnetoresistance effect module including the first circuit unit and the second circuit unit.

FIGS. 2A and 2B are schematic diagrams showing the signal characteristics in a case where the first circuit unit 10 and the second circuit unit 20 are individually adopted and the signal characteristics of the magnetoresistance effect module 100 including these components. The signal characteristics correspond to the ratio of an output power to an input power. As shown in FIG. 2A, the first circuit unit 10 and the second circuit unit 20 exhibit anti-Lorentzian-like signal characteristics when individually adopted. Anti-Lorentzian signal characteristics are signal characteristics that can be fitted to an antisymmetric Cauchy-Lorentz distribution, and the anti-Lorentzian-like signal characteristics are signal characteristics having two peaks, that is, a peak in which a pass characteristic is increased (an upwardly convex peak) and a peak in which a pass characteristic is decreased (a downwardly convex peak). The signal characteristics in the case where the first circuit unit 10 and the second circuit unit 20 are individually adopted change abruptly between the upwardly convex peak and the downwardly convex peak. The positional relationship between the first end face 12*a* and the second end face 12*b* with respect to the direction of the direct current $I_{DC}$ flowing inside the first magnetoresistance effect element 12 is opposite to the positional relationship between the first end face 22*a* and the second end face 22*b* with respect to the direction of the direct current $I_{DC}$ flowing inside the second magnetoresistance effect element 22. In addition, the relative angle between the first cross product direction CP1 of the first circuit unit 10 and the second cross product direction CP2 of the second circuit unit 20 is 90 degrees or less. For that reason, the signal characteristics of the first circuit unit 10 and the signal characteristics of the second circuit unit 20 are in a relation of substantial line symmetry.

The position of the signal peak of the first circuit unit 10 (the ferromagnetic resonance frequency of the magnetization free layer 12B of the first magnetoresistance effect element 12) and the position of the signal peak of the second circuit unit 20 (the ferromagnetic resonance frequency of the magnetization free layer 22B of the second magnetoresistance effect element 22) are different from each other, and the frequency at the position of the signal peak of the first circuit unit 10 (the ferromagnetic resonance frequency of the magnetization free layer 12B of the first magnetoresistance effect element 12) is higher than the frequency at the position of the signal peak of the second circuit unit 20 (the ferromagnetic resonance frequency of the magnetization free layer 22B of the second magnetoresistance effect element 22). Preferably, the difference between the frequencies of the two signal peaks is within a range of 10% or less and more preferably, it is 5% or less with respect to a center frequency of the two signal peaks (the average value of the frequencies of the two signal peaks). Also, regarding a specific numerical value, the difference between the frequencies of the two signal peaks is preferably 200 MHz or less and more preferably, it is 100 MHz or less. Also, preferably, the difference between the frequencies of the two signal peaks is in the range of 0.5% or more with respect to the center frequency and more preferably, is 5 MHz or more.

Although the signal peak in the anti-Lorentzian-like signal characteristic has the upwardly convex peak and the downwardly convex peak, the difference between the frequencies of the two signal peaks described above have been taken as the difference between the frequencies of two downwardly convex peaks. The positions of the signal peaks of the first circuit unit 10 and the second circuit unit 20 can be controlled by the frequency setting mechanism 80. Further, the position of the signal peak of the circuit unit (the ferromagnetic resonance frequency of the magnetization free layer of the magnetoresistance effect element) can also be changed depending on a plan view shape of the magnetoresistance effect element and a configuration of layers of the magnetoresistance effect element.

When the signal characteristics of the first circuit unit 10 and the signal characteristics of the second circuit unit 20 are superimposed on each other, the signal characteristic of the magnetoresistance effect module 100 is obtained. As shown in FIG. 2B, the signal characteristics of the magnetoresistance effect module 100 get to have a passband excellent in steepness in the vicinity of the position of the upwardly convex signal peak in each of the first circuit unit 10 and the second circuit unit 20. By utilizing this signal characteristic, the magnetoresistance effect module 100 (or the magnetoresistance effect device) can be used as a high frequency filter that can selectively pass a high frequency signal having a specific frequency.

Although the embodiments of the present disclosure have been described above in detail with reference to the drawings, it should be understood that each configuration in each embodiment and combinations thereof are merely examples, and additions, omissions, substitutions and other changes of the configurations are possible without departing from the spirit of the present disclosure.

Figure 3:
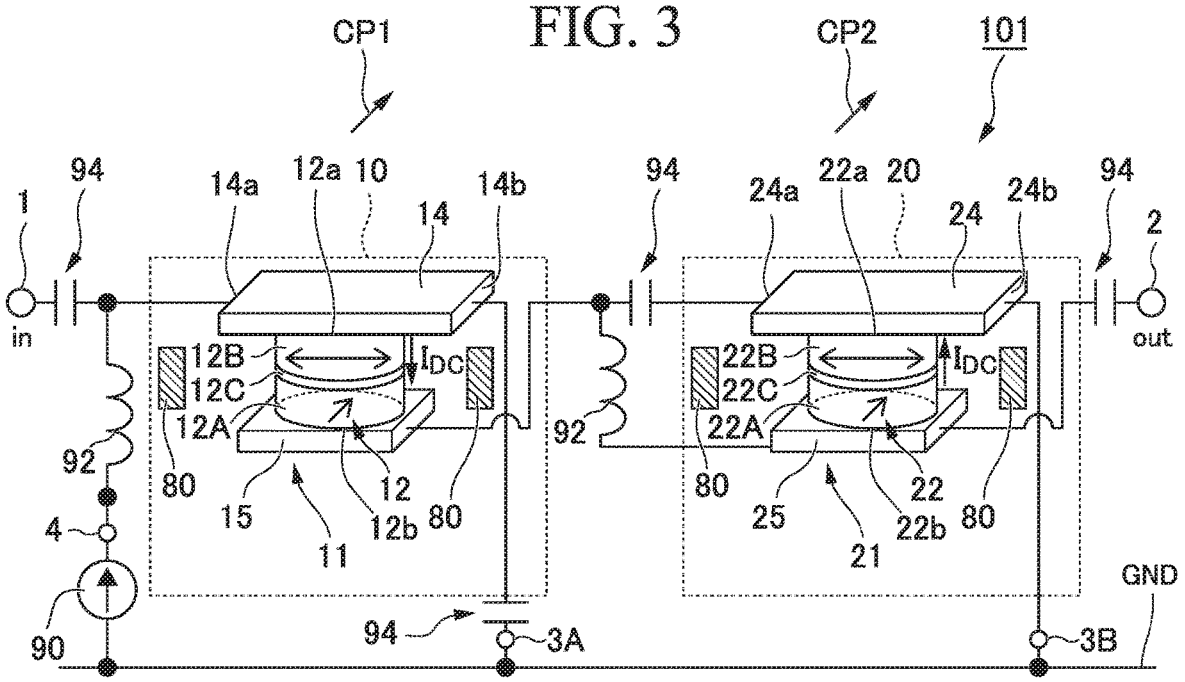
FIG. 3 is a schematic diagram showing a circuit configuration of another example of the magnetoresistance effect module according to the first embodiment.

FIG. 3 is a schematic diagram showing a circuit configuration of another example of the magnetoresistance effect module according to the first embodiment. In FIG. 3, the same components as those in FIG. 1 are denoted by the same reference numerals. The magnetoresistance effect module 101 shown in FIG. 3 is different from the magnetoresistance effect module 100 shown in FIG. 1 in that the first magnetoresistance effect element 12 and the second magnetoresistance effect element 22 share the DC applying terminal 4 and the power supply 90. The reference potential terminal 3A in FIG. 3 is connected (connected in an AC manner (in a high frequency manner) connection) to the first circuit unit 10 via the capacitor 94 and the reference potential terminal 3B is connected to the second circuit unit 20. Further, in FIG. 3, the reference potential terminal 3B is connected (connected in a DC manner) to the first circuit unit 10 via the second circuit unit 20 and the inductor 92.

In addition, in the magnetoresistance effect module 101 shown in FIG. 3, when the DC applying terminal 4 is connected to the power supply 90, the positional relationship between the first end face 12*a* and the second end face 12*b* of the first magnetoresistance effect element 12 with respect to the flowing direction of the direct current $I_{DC}$ flowing inside the first magnetoresistance effect element 12 and the positional relationship between the first end face 22*a* and the second end face 22*b* of the second magnetoresistance effect element 22 with respect to the flowing direction of the direct current $I_{DC}$ flowing inside the second magnetoresistance effect element 22 are opposite to each other. The direct current $I_{DC}$ in the first magnetoresistance effect element 12 flows from the first end face 12*a* side toward the second end face 12*b* and the direct current $I_{DC}$ in the second magnetoresistance effect element 22 flows from the second end face 22*b* side toward the first end face 22*a* side. In addition, the relative angle between the first cross product direction CP1 of the first circuit unit 10 and the second cross product direction CP2 of the second circuit unit 20 is 90 degrees or less. Therefore, the signal characteristics of the current branch type element 11 and the current branch type element 21 are superimposed on each other so that the signal characteristics having excellent steepness as shown in FIG. 2B can be obtained in the magnetoresistance effect module 101.

Further, in FIG. 3, the "connection point on an input side of a direct current or a direct current voltage" of the first magnetoresistance effect element 12 of the first circuit unit 10 is the first end portion 14*a* of the first conductor 14 in the current branch type element 11, and the "connection point on an input side of a direct current or a direct current voltage" of the second magnetoresistance effect element 22 of the second circuit unit 20 is an end portion of the counter electrode 25 in the current branch type element 21. Since there is the capacitor 94 between the first end portion 24*a* of the second conductor 24 and the DC applying terminal 4, the first end portion 24*a* of the second conductor 24 does not become the "connection point on an input side of a direct current or a direct current voltage."

The positional relationship between the first end face 12*a* and the second end face 12*b* of the first magnetoresistance effect element 12 with respect to the connection point on the input side of the direct current or the direct current voltage of the first magnetoresistance effect element 12 and the positional relationship between the first end face 22*a* and the second end face 22*b* of the second magnetoresistance effect element 22 with respect to the connection point on the input side of the direct current or the direct current voltage of the second magnetoresistance effect element 22 are opposite to each other.

Figure 4:
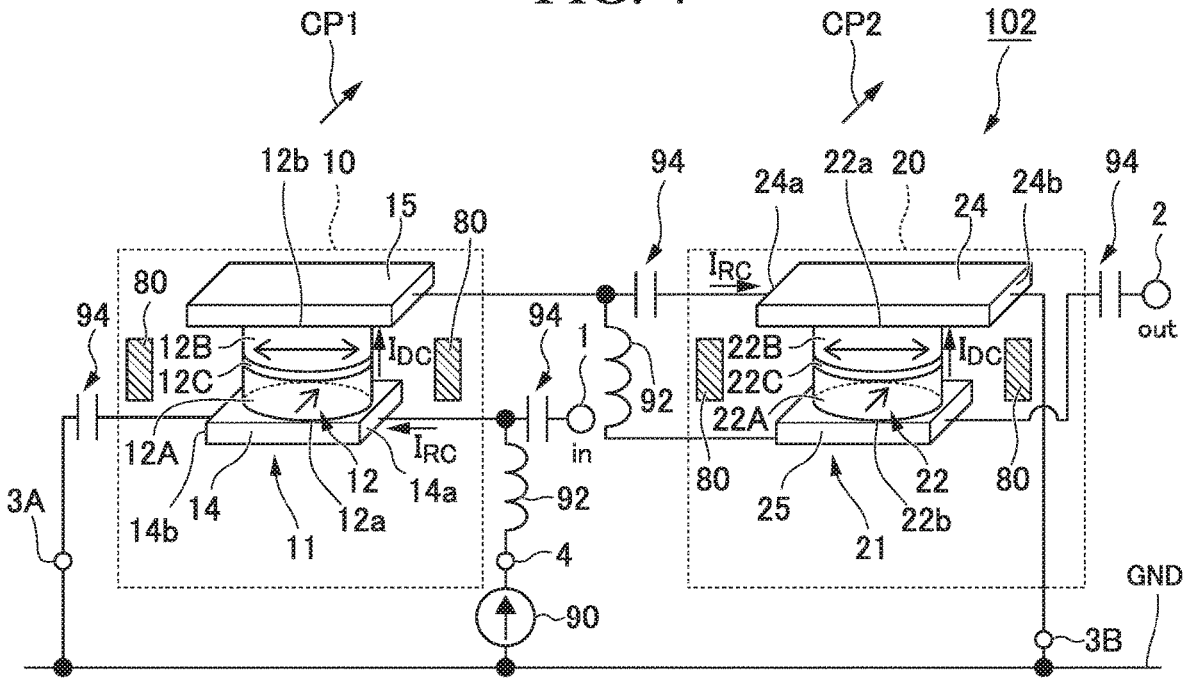
FIG. 4 is a schematic diagram showing a circuit configuration of another example of the magnetoresistance effect module according to the first embodiment.

Also, FIG. 4 is a schematic diagram showing a circuit configuration of another example of the magnetoresistance effect module according to the first embodiment. In FIG. 4, the same components as those in FIG. 1 are denoted by the same reference numerals. The magnetoresistance effect module 102 shown in FIG. 4 is different from the magnetoresistance effect module 100 shown in FIG. 1 in that the first magnetoresistance effect element 12 and the second magnetoresistance effect element 22 share the current applying terminal 4 and the power supply 90, the first direction and the second direction are opposite to each other, and the first stacking direction and the second stacking direction are opposite to each other. The reference potential terminal 3A in FIG. 4 is connected (connected in an AC manner (in a high frequency manner)) to the first circuit unit 10 via the capacitor 94 and the reference potential terminal 3B is connected to the second circuit unit 20. Further, in FIG. 4, the reference potential terminal 3B is connected (connected in a DC manner) to the first circuit unit 10 via the second circuit unit 20 and the inductor 92.

The high frequency current $I_{RC}$ input from the first port 1 branches to flow to the first magnetoresistance effect element 12 and the reference potential terminal 3A. When viewed in the stacking direction of the first magnetoresistance effect element 12, the first direction in the first circuit unit 10 of FIG. 4 is a direction from the first end portion 14*a* toward the second end portion 14*b* of the first conductor 14 in the region where the first conductor 14 and the first magnetoresistance effect element 12 overlap. That is, the first direction in the first circuit unit 10 of FIG. 4 is a direction from the right to the left of the drawing.

In addition, the first magnetoresistance effect element 12 is positioned above the first conductor 14 with the first conductor 14 as a reference. The first stacking direction in the first circuit unit 10 of FIG. 4 is a direction from the bottom to the top of the drawing.

The first cross product direction CP1 is the direction of the cross product between the first direction and the first stacking direction. That is, the first cross product direction CP1 in the first circuit unit 10 of FIG. 4 is a direction from in front to behind the drawing.

Also, the high frequency current $I_{RC}$ output from the first circuit unit 10 branches to flow to the second magnetoresistance effect element 22 and the reference potential terminal 3B. When viewed in the stacking direction of the second magnetoresistance effect element 22, the second direction in the second circuit unit 20 of FIG. 4 is a direction from the first end portion 24*a* to the second end portion 24*b* of the second conductor 24 in the region where the second conductor 24 overlaps the first magnetoresistance effect element 22. That is, the second direction in the second circuit unit 20 of FIG. 4 is a direction from the left to the right of the drawing.

In addition, the second magnetoresistance effect element 22 is positioned below the first conductor 24 with the first conductor 24 as a reference. The second stacking direction in the second circuit unit 20 of FIG. 4 is a direction from top to bottom of the drawing.

The second cross product direction CP2 is the direction of the cross product between the second direction and the second stacking direction. That is, the second cross product direction CP2 in the second circuit unit 10 of FIG. 4 is a direction from in front to behind the drawing. That is, the relative angle between the first cross product direction CP1 of the first circuit unit 10 and the second cross product direction CP2 of the second circuit unit 20 is 0 degrees and is 90 degrees or less.

Further, the direct current $I_{DC}$ in the first magnetoresistance effect element 12 flows from the first end face 12*a* side toward the second end face 12*b* and the direct current $I_{Dc}$ in the second magnetoresistance effect element 22 flows from the second end face 22*b* side toward the first end face 22*a* side. Therefore, also in the magnetoresistance effect module 102 shown in FIG. 4, the signal characteristics of the current branch type element 11 and the current branch type element 21 are superimposed on each other so that the signal characteristics having excellent steepness as shown in FIG. 2B can be obtained.

Figure 5:
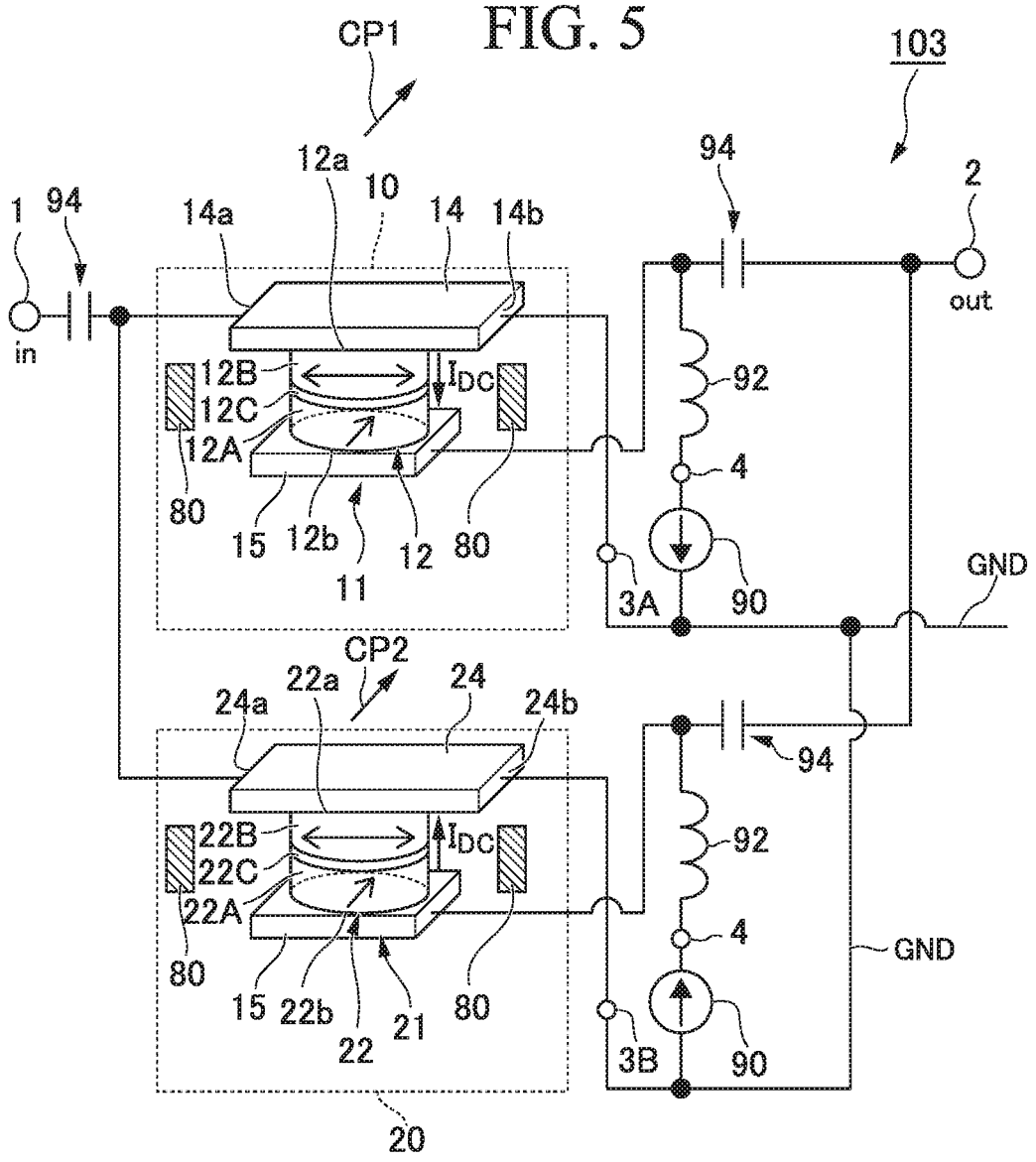
FIG. 5 is a schematic diagram showing a circuit configuration of another example of the magnetoresistance effect module according to the first embodiment.

Also, FIG. 5 is a schematic diagram showing a circuit configuration of another example of the magnetoresistance effect module according to the first embodiment. In FIG. 5, the same components as those in FIG. 1 are denoted by the same reference numerals. The magnetoresistance effect module 103 shown in FIG. 5 is different from the magnetoresistance effect module 100 shown in FIG. 1 in that the first circuit unit 10 and the second circuit unit 20 are connected in parallel with each other to the first port 1. In FIG. 5, the reference potential terminal 3A is connected to the first circuit unit 10 and the reference potential terminal 3B is connected to the second circuit unit 20.

As shown in FIG. 5, the first circuit unit 10 and the second circuit unit 20 may be connected not in series but in parallel. Also, in the magnetoresistance effect module 103 shown in FIG. 5, the signal characteristics of the current branch type elements 11 and 21 are superimposed on each other so that the signal characteristic having excellent steepness as shown in FIG. 2B can be obtained.

Figure 6:
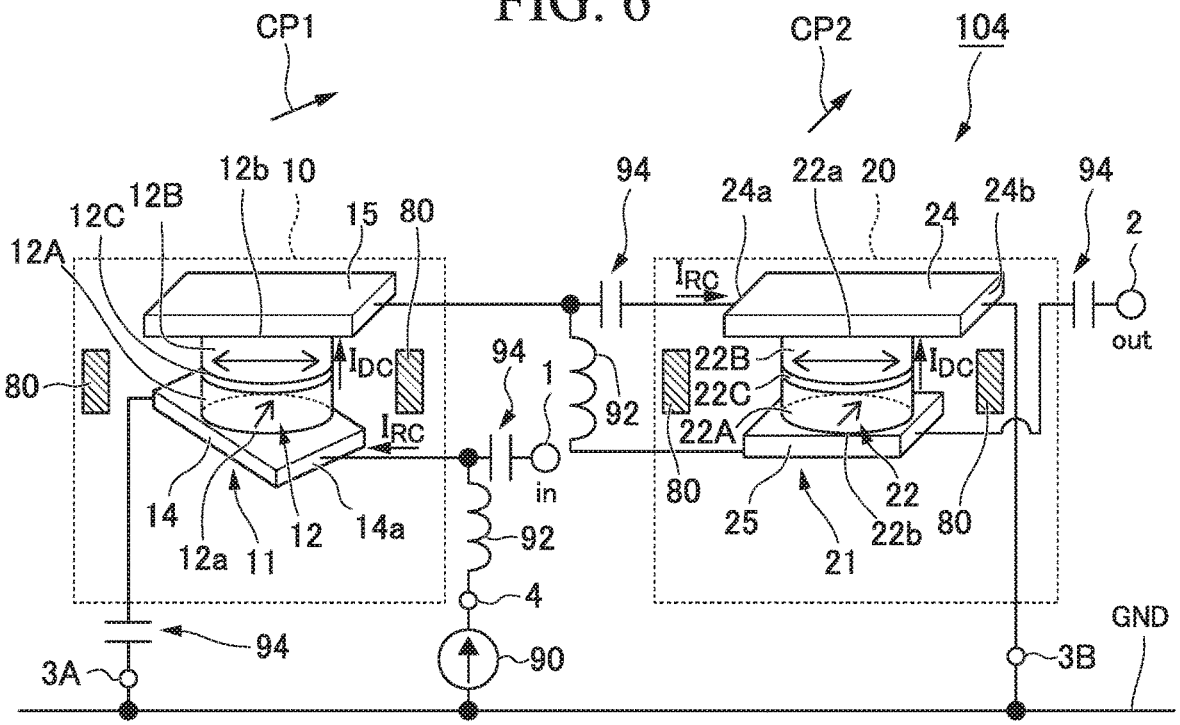
FIG. 6 is a schematic diagram showing a circuit configuration of another example of the magnetoresistance effect module according to the first embodiment.

Also, FIG. 6 is a schematic diagram showing a circuit configuration of another example of the magnetoresistance effect module according to the first embodiment. In FIG. 6, the same components as those in FIG. 4 are denoted by the same reference numerals. The magnetoresistance effect module 104 shown in FIG. 6 is different from the magnetoresistance effect module 102 shown in FIG. 4 in that the first conductor 14 and the second conductor 24 are disposed such that the first direction is oblique to the second direction. The reference potential terminal 3A in FIG. 6 is connected (connected in an AC manner (in a high frequency manner)) to the first circuit unit 10 via the capacitor 94 and the reference potential terminal 3B is connected to the second circuit unit 20. Further, in FIG. 6, the reference potential terminal 3B is connected (connected in a DC manner) to the first circuit unit 10 via the second circuit unit 20 and the inductor 92.

In this case, the first cross product direction CP1 is inclined from the first cross product direction CP1 shown in the case of FIG. 4. The relative angle between the first cross product direction CP1 of the first circuit unit 10 and the second cross product direction CP2 of the second circuit unit 20 is 45 degrees and is 90 degrees or less. In addition, the direct current $I_{DC}$ in the first magnetoresistance effect element 12 flows from the first end face 12*a* side toward the second end face 12*b* and the direct current $I_{DC}$ in the second magnetoresistance effect element 22 flows from the second end face 22*b* side toward the first end face 22*a* side. Therefore, also in the magnetoresistance effect module 104 shown in FIG. 6, the signal characteristics of the current branch type element 11 and the current branch type element 21 are superimposed on each other so that the signal characteristics having excellent steepness as shown in FIG. 2B can be obtained. As shown in FIG. 6, preferably, the relative angle between the first cross product direction CP1 and the second cross product direction CP2 is 45 degrees or less.

Figure 7A:
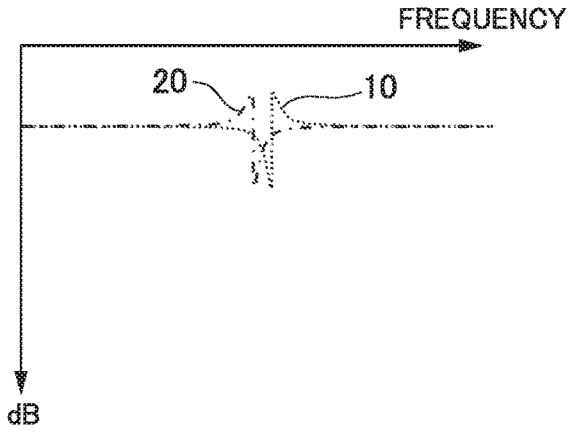
FIG. 7A is a schematic diagram showing signal characteristics in a case where the first circuit unit and the second circuit unit are independent when the magnetoresistance effect module is of a band stop type.
Figure 7B:
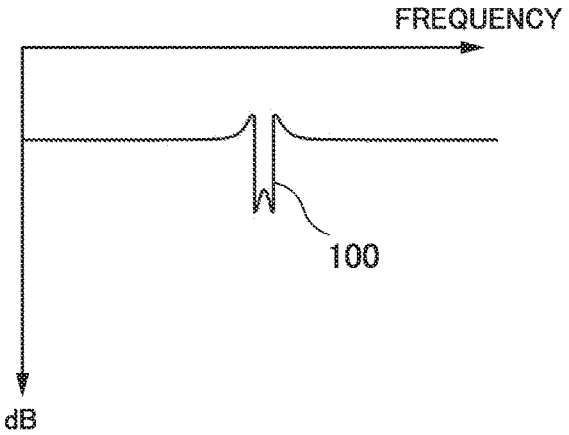
FIG. 7B is a schematic diagram showing signal characteristics of a magnetoresistance effect module including the first circuit unit and the second circuit unit in a case where the magnetoresistance effect module is of a band stop type.

As described above, the cases where the magnetoresistance effect module shows signal characteristics of a bandpass type have been exemplified. On the other hand, by reversing the direction of the direct current applied between the first magnetoresistance effect element 12 and the second magnetoresistance effect element 22, the trends of the signal characteristics of the first circuit unit 10 and the second circuit unit 20 are reversed, and therefore, the magnetoresistance effect module can also exhibit signal characteristics of a band stop type. FIGS. 7A and 7B are graphs showing a signal characteristic in the case where the first circuit unit 10 and the second circuit unit 20 in the magnetoresistance effect module shown in FIG. 1 are independently used and the direction of the applied direct current is opposite to that in FIG. 1, and a signal characteristic of the magnetoresistance effect module 100 including these components. The magnetoresistance effect module 100 according to the first embodiment can also function as a high frequency filter of a bandpass type and a high frequency filter of a band stop type by designing a direction for applying the direct current application current and the like.

In the case of the band stop type, it is preferable that the difference between the frequency at the position of the signal peak of the first circuit unit 10 (the ferromagnetic resonance frequency of the magnetization free layer 12B of the first magnetoresistance effect element 12) and the frequency at the position of the signal peak of the second circuit unit 20 (the ferromagnetic resonance frequency of the magnetization free layer 22B of the second magnetoresistance effect element 22) is in the same range as in the bandpass type. The difference between the frequencies of the two signal peaks in the case of the band stop type means the difference between the frequencies of the two downwardly convex peaks.

Second Embodiment

Figure 8:
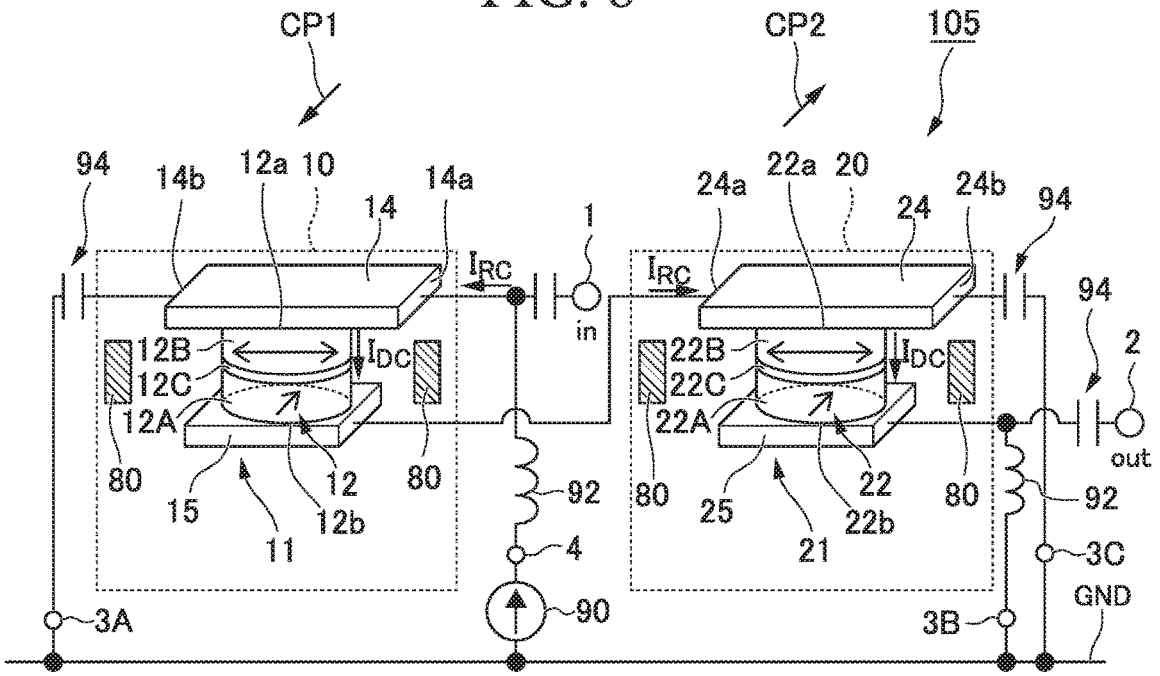
FIG. 8 is a schematic diagram showing a circuit configuration of a magnetoresistance effect module according to a second embodiment.

FIG. 8 is a schematic diagram showing a circuit configuration of a magnetoresistance effect module 105 according to a second embodiment. A magnetoresistance effect device includes a first port 1, a second port 2, a first circuit unit 10, a second circuit unit 20, reference potential terminals 3A, 3B and 3C, and a DC applying terminal 4. The magnetoresistance effect module 105 is formed by connecting a power supply 90 to the DC applying terminal 4. In the magnetoresistance effect module according to the second embodiment, the same components as those of the first embodiment are denoted by the same reference numerals and the explanations thereon will be omitted. In FIG. 8, the reference potential terminal 3A is connected (connected in an AC manner (in a high frequency manner)) to the first circuit unit 10 via a capacitor 94, the reference potential terminal 3B is connected (connected in a DC manner) to the second circuit unit 20 via an inductor 92, and the reference potential terminal 3C is connected (connected in an AC manner (in a high frequency manner)) to the second circuit unit 20 via a capacitor 94. Also, in FIG. 8, the reference potential terminal 3B is connected (connected in a DC manner) to the first circuit unit 10 via the inductor 92 and the second circuit unit 20.

A high frequency current $I_{RC}$ input from the first port 1 branches to flow to a first magnetoresistance effect element 12 and the reference potential terminal 3A. When viewed in a stacking direction of the first magnetoresistance effect element 12, a first direction in the first circuit unit 10 of FIG. 8 is a direction from a first end portion 14*a* of a first conductor 14 to a second end portion 14*b* in the region where the first conductor 14 overlaps the first magnetoresistance effect element 12. That is, the first direction in the first circuit unit 10 of FIG. 8 is a direction from the right to the left of the drawing.

In addition, the first magnetoresistance effect element 12 is positioned below the first conductor 14 with the first conductor 14 as a reference. A first stacking direction in the first circuit unit 10 of FIG. 8 is a direction from top to bottom of the drawing.

A first cross product direction CP1 is the direction of the cross product between the first direction and the first stacking direction. That is, the first cross product direction CP1 in the first circuit unit 10 of FIG. 8 is a direction from behind to in front of the drawing.

The high frequency current $I_{RC}$ output from the first circuit unit 10 branches to flow to a second magnetoresistance effect element 22 and the reference potential terminal 3C. When viewed in the stacking direction of the second magnetoresistance effect element 22, a second direction in the second circuit unit 20 of FIG. 8 is the direction from a first end portion 24*a* to a second end portion 24*b* of a second conductor 24 in the region where the first conductor 24 overlaps the first magnetoresistance effect element 22. That is, the second direction in the second circuit unit 20 of FIG. 8 is a direction from the left to the right of the drawing.

Also, the second magnetoresistance effect element 22 is positioned below the first conductor 24 with the first conductor 24 as a reference. A second stacking direction in the second circuit unit 20 of FIG. 8 is a direction from top to bottom of the drawing.

A second cross product direction CP2 is the direction of the cross product between the second direction and the second stacking direction. That is, the second cross product direction CP2 of the second circuit unit 10 of FIG. 8 is a direction from in front to behind the drawing. That is, the relative angle between the first cross product direction CP1 of the first circuit unit 10 and the second cross product direction CP2 of the second circuit unit 20 is 180 degrees and is larger than 90 degrees.

On the other hand, a direct current $I_{DC}$ in the first magnetoresistance effect element 12 flows from a first end face 12*a* side toward a second end face 12*b*. Also, a direct current $I_{DC}$ in the second magnetoresistance effect element 22 flows from a first end face 22*a* side toward a second end face 22*b*. That is, when the DC applying terminal 4 is connected to the power supply 90, the positional relationship between the first end face 12*a* and the second end face 12*b* of the first magnetoresistance effect element 12 with respect to the flowing direction of the direct current $I_{DC}$ flowing inside the first magnetoresistance effect element 12 and the positional relationship between the first end face 22*a* and the second end face 22*b* of the second magnetoresistance effect element 22 with respect to the flowing direction of the direct current $I_{DC}$ flowing inside the second magnetoresistance effect element 22 are the same.

Also, the positional relationship between the first end face 12*a* and the second end face 12*b* in the first magnetoresistance effect element 12 with respect to a connection point on an input side of a direct current or a direct current voltage of the first magnetoresistance effect element 12 and the positional relationship between the first end face 22*a* and the second end face 22*b* in the second magnetoresistance effect element 22 with respect to a connection point on an input side of a direct current or a direct current voltage of the second magnetoresistance effect element 22 are the same.

In the magnetoresistance effect module 105 according to the second embodiment, since the relationship between the first cross product direction CP1 and the second cross product direction CP2 and the relationships between the first end faces 12*a* and 22*a* and the second end faces 12*b* and 22*b* in the first magnetoresistance effect element 12 and the second magnetoresistance effect element 22 with respect to the direct current $I_{DC}$ satisfies the above relationships, the signal characteristics of the current branch type element 11 and the current branch type element 21 are superimposed on each other so that the signal characteristic having excellent steepness can be obtained. The signal characteristics of the magnetoresistance effect module 105 according to the second embodiment are the same as those in FIGS. 7A and 7B. When the direct currents $I_{DC}$ flowing inside the first magnetoresistance effect element 12 and the second magnetoresistance effect element 22 are reversed in direction with each other, the signal characteristics similar to those in FIGS. 2A and 2B can be obtained.

Figure 9:
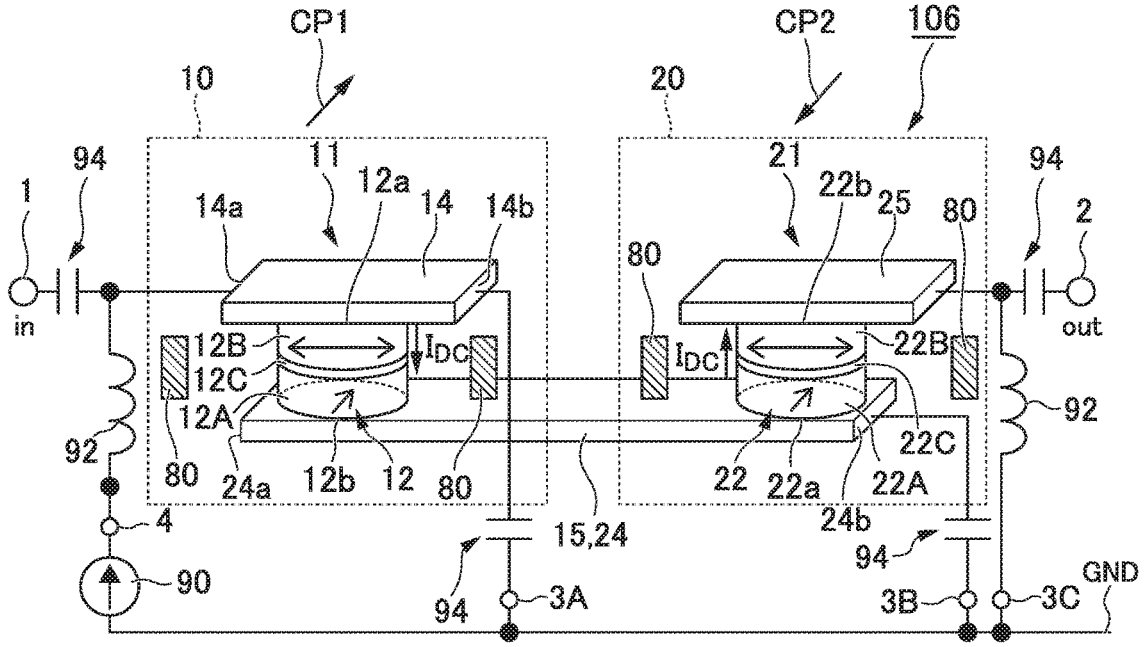
FIG. 9 is a schematic diagram showing a circuit configuration of another example of the magnetoresistance effect module according to the second embodiment.

Also, FIG. 9 is a schematic diagram showing a circuit configuration of another example of the magnetoresistance effect module according to the second embodiment. In FIG. 9, the same components as those in FIG. 8 are denoted by the same reference numerals. The magnetoresistance effect module 106 shown in FIG. 9 is different from the magnetoresistance effect module 105 shown in FIG. 8 in that a counter electrode 15 of the first magnetoresistance effect element 12 and the second conductor 24 of the second magnetoresistance effect element 22 are shared. In FIG. 9, the reference potential terminal 3A is connected (connected in an AC manner (in a high frequency manner)) to the first circuit unit 10 via the capacitor 94, the reference potential terminal 3B is connected (connected in an AC manner (in a high frequency manner)) to the second circuit unit 20 via the capacitor 94, and the reference potential terminal 3C is connected (connected in a DC manner) to the second circuit unit 20 via the inductor 92. In addition, in FIG. 9, the reference potential terminal 3C is connected (connected in a DC manner) to the first circuit unit 10 via the inductor 92 and the second circuit unit 20.

The relative angle between the first cross product direction CP1 and the second cross product direction CP2 is 180 degrees and is larger than 90 degrees. Further, when the DC applying terminal 4 is connected to the power supply 90, the positional relationship between the first end face 12*a* and the second end face 12*b* in the first magnetoresistance effect element 12 with respect to the flowing direction of the direct current $I_{DC}$ flowing inside the first magnetoresistance effect element 12 and the positional relationship between the first end face 22*a* and the second end face 22*b* in the second magnetoresistance effect element 22 with respect to the flowing direction of the direct current $I_{DC}$ flowing inside the second magnetoresistance effect element 22 are the same. Also, the positional relationship between the first end face 12*a* and the second end face 12*b* in the first magnetoresistance effect element 12 with respect to the connection point on the input side of the direct current or the direct current voltage of the first magnetoresistance effect element 12 and the positional relationship between the first end face 22*a* and the second end face 22*b* in the second magnetoresistance effect element 22 with respect to the connection point on the input side of the direct current or the direct current voltage of the second magnetoresistance effect element 22 are the same. Therefore, the signal characteristics of the first circuit unit 10 and the second circuit unit 20 are superimposed on each other so that the signal characteristic having excellent steepness as shown in FIG. 2B can be obtained in the magnetoresistance effect module 106. In the magnetoresistance effect module 106 shown in FIG. 9, the connection between the first magnetoresistance effect element 12 and the second magnetoresistance effect element 22 is simplified, which is advantageous for miniaturization and reduction in resistance.

Figure 10:
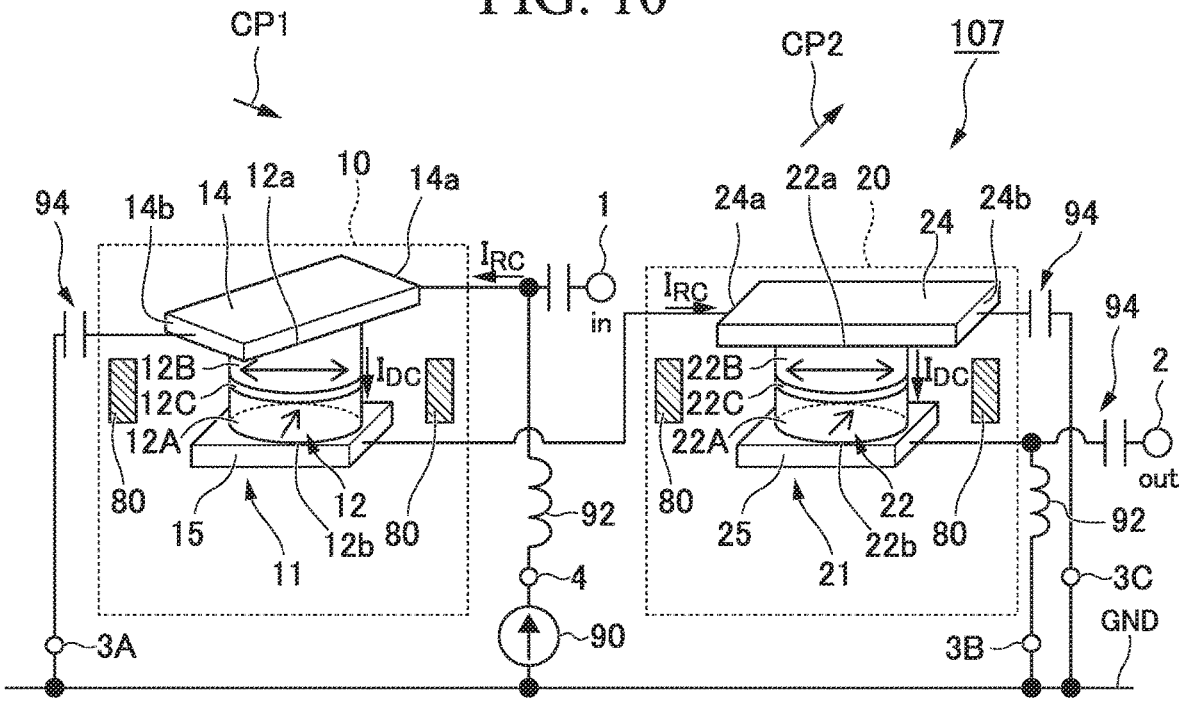
FIG. 10 is a schematic diagram showing a circuit configuration of another example of the magnetoresistance effect module according to the second embodiment.

Also, FIG. 10 is a schematic diagram showing a circuit configuration of another example of the magnetoresistance effect module according to the second embodiment. In FIG. 10, the same components as those in FIG. 8 are denoted by the same reference numerals. The magnetoresistance effect module 107 shown in FIG. 10 is different from the magnetoresistance effect module 105 shown in FIG. 8 in that the first conductor 14 and the second conductor 24 are arranged such that the first direction is oblique to the second direction. In FIG. 10, the reference potential terminal 3A is connected (connected in an AC manner (in a high frequency manner)) to the first circuit unit 10 via the capacitor 94, the reference potential terminal 3B is connected (connected in a DC manner) to the second circuit unit 20 via the inductor 92, and the reference potential terminal 3C is connected (connected in an AC manner (in a high frequency manner)) to the second circuit unit 20 via the capacitor 94. Also, in FIG. 10, the reference potential terminal 3B is connected (connected in a DC manner) to the first circuit unit 10 via the inductor 92 and the second circuit unit 20.

In this case, the first cross product direction CP1 is inclined from the first cross product direction CP1 shown in the case of FIG. 8. The relative angle between the first cross product direction CP1 of the first circuit unit 10 and the second cross product direction CP2 of the second circuit unit 20 is 135 degrees and is larger than 90 degrees. In addition, the direct current $I_{DC}$ in the first magnetoresistance effect element 12 flows from the first end face 12*a* side toward the second end face 12*b* and the direct current $I_{DC}$ in the second magnetoresistance effect element 22 flows from the first end face 22*a* side to the second end face 22*b* side. Therefore, also in the magnetoresistance effect module 107 shown in FIG. 10, the signal characteristics of the current branch type element 11 and the current branch type element 21 are superimposed on each other so that the signal characteristic having excellent steepness as shown in FIG. 7B can be obtained. As shown in FIG. 10, preferably, the relative angle between the first cross product direction CP1 and the second cross product direction CP2 is 135 degrees or more.

Further, although the second embodiment has been described on the basis of the example in which the first magnetoresistance effect element 12 and the second magnetoresistance effect element 22 share the current applying terminal 4 and the power supply 90, each of the first magnetoresistance effect element 12 and the second magnetoresistance effect element 22 may have a current applying terminal 4 and a power supply 90.

Third Embodiment

Figure 11:
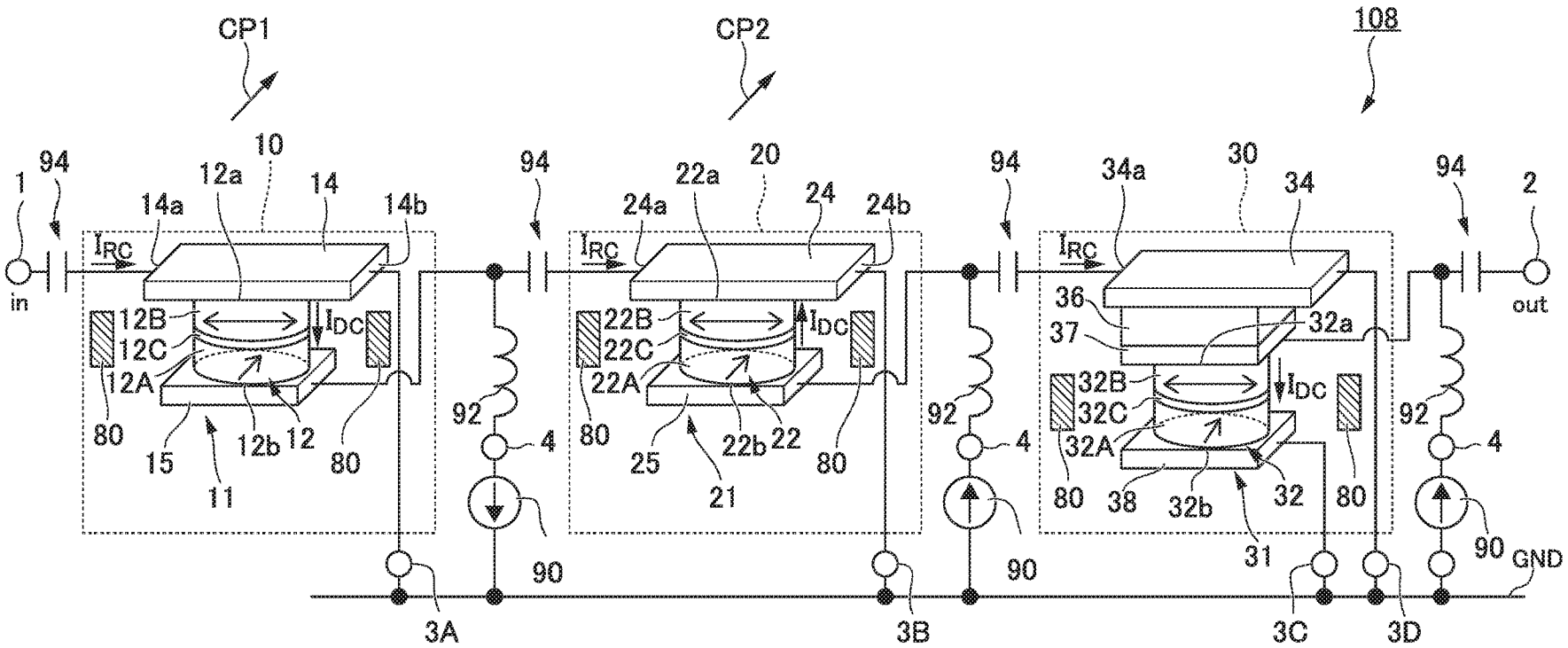
FIG. 11 is a schematic diagram showing a circuit configuration of a magnetoresistance effect module according to a third embodiment.

FIG. 11 is a schematic diagram showing a circuit configuration of a magnetoresistance effect module according to a third embodiment. The magnetoresistance effect module 108 shown in FIG. 11 is different from the magnetoresistance effect module 100 shown in FIG. 1 in that a third circuit unit 30 is connected thereto. In FIG. 11, the same components as those in FIG. 1 are denoted by the same reference numerals.

The third circuit unit 30 shown in FIG. 11 is connected between a first port 1 and a second port 2. The third circuit unit 30 in FIG. 11 is connected between a second circuit unit 20 and the second port 2, and a first circuit unit 10, the second circuit unit 20, and the third circuit unit 30 are connected in series. In FIG. 11, a reference potential terminal 3A is connected to the first circuit unit 10, a reference potential terminal 3B is connected to the second circuit unit 20, and a reference potential terminal 3C and a reference potential terminal 3D are connected to the third circuit unit 30.

In FIG. 11, the first circuit unit 10, the second circuit unit 20 and the third circuit unit 30 are connected in this order as an example, but there is no limitation in the connection order. A magnetic field driven type element 31 is incorporated in the third circuit unit 30. The magnetic field driven type element 31 includes a third magnetoresistance effect element 32 and a third conductor 34.

The third magnetoresistance effect element 32 has a magnetization fixed layer 32A, a magnetization free layer 32B, and a spacer layer 32C. A first electrode 37 is provided at one end (a first end face 32*a*) in a stacking direction of the third magnetoresistance effect element 32 and a counter electrode 38 is provided at the other end (a second end face 32*b*) in the stacking direction thereof. The third magnetoresistance effect element 32 is connected to a DC applying terminal 4 which is capable of connecting a power supply 90 for applying a direct current or a direct current voltage to the third magnetoresistance effect element 32.

The third conductor 34 is disposed separately from the third magnetoresistance effect element 32 with an insulator 36 interposed therebetween. The insulator 36 is thick enough to maintain the insulation between the third conductor 34 and the first electrode 37. For example, preferably, the thickness is such that a current (including a tunneling current) does not flow therethrough when a voltage of 4.5 V is applied in the stacking direction of the third magnetoresistance effect element 32, and specifically, it is preferably 10 nm or more. A first end portion 34*a* of the third conductor 34 is connected to an input side of a high frequency current $I_{RC}$ in the third circuit unit 30. In the example of FIG. 11, the high frequency current $I_{RC}$ output from the second circuit unit 20 is input to the third circuit unit 30. A high frequency magnetic field is generated by the high frequency current $I_{RC}$ flowing through the third conductor 34 and the generated high frequency magnetic field is applied to the magnetization free layer 32B of the third magnetoresistance effect element 32. In order to efficiently apply the high frequency magnetic field to the magnetization free layer 32B of the third magnetoresistance effect element 32, preferably, the thickness of the insulator 36 is 1,000 nm or less.

The magnetization of the magnetization free layer 32B oscillates upon receiving a high frequency magnetic field generated by the high frequency current $I_{RC}$ flowing through the third conductor 34. The magnetization of the magnetization free layer 32B oscillates greatly when the frequency of the high frequency current $I_{RC}$ is in the vicinity of the ferromagnetic resonance frequency of the magnetization free layer 32B. As the oscillation of the magnetization of the magnetization free layer 32B increases, a change in the resistance value in the third magnetoresistance effect element 32 increases. This change in the resistance value is output from the third magnetoresistance effect element 32 (the third circuit unit 30) by applying a direct current $I_{DC}$ in the stacking direction of the third magnetoresistance effect element 32.

Figure 12A:
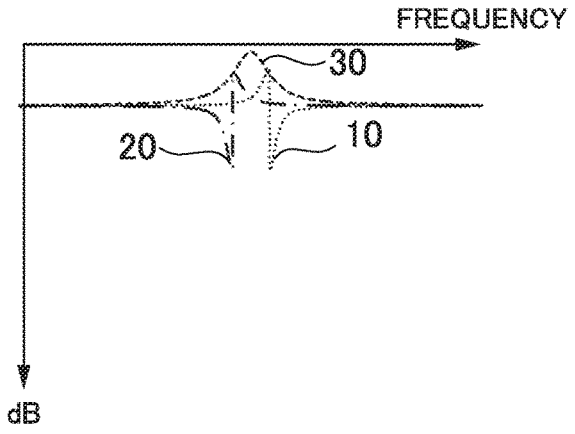
FIG. 12A is a schematic diagram showing signal characteristics when a first circuit unit, a second circuit unit, and a third circuit unit are independent.
Figure 12B:
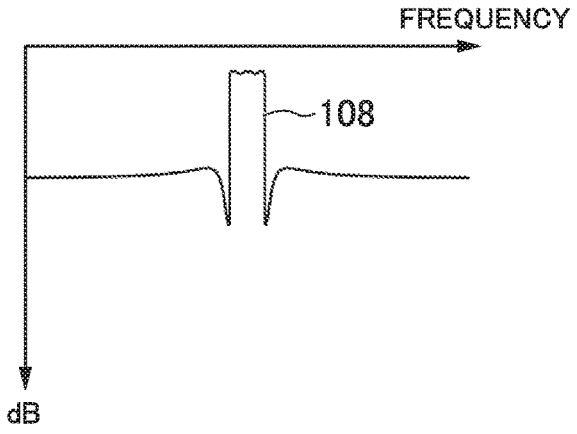
FIG. 12B is a schematic diagram showing signal characteristics of a magnetoresistance effect module including the first circuit unit, the second circuit unit, and the third circuit unit.

FIGS. 12A and 12B are schematic diagrams showing the signal characteristic in the case where the first circuit unit 10, the second circuit unit 20 and the third circuit unit 30 incorporating the magnetic field driven type element 31 are individually adopted and the signal characteristic of the magnetoresistance effect module 108 including these components. FIG. 12A shows the signal characteristic when the first circuit unit 10, the second circuit unit 20 and the third circuit unit 30 incorporating the magnetic field driven type element 31 are individually adopted, and FIG. 12B shows the signal characteristic of the magnetoresistance effect module 108.

As described above, the first circuit unit 10 and the second circuit unit 20 individually exhibit the anti-Lorentzian-like signal characteristic. On the other hand, the third circuit unit 30 incorporating the magnetic field driven type element 31 individually exhibits a Lorentzian-like signal characteristic. Lorentzian signal characteristics are signal characteristics that can be fitted to a Cauchy-Lorentz distribution, and Lorentzian-like signal characteristics are signal characteristics having either one of a peak in which a pass characteristic is increased or a peak in which a pass characteristic is decreased. It is considered that the difference between the signal characteristic of the third circuit unit 30 and the signal characteristic of the first circuit unit 10 and the second circuit unit 20 is caused by a difference in a configuration of an element, a difference in a flowing direction of the high frequency current with respect to the magnetoresistance effect element, and the like.

When the signal characteristic of the first circuit unit 10, the signal characteristic of the second circuit unit 20, and the signal characteristic of the third circuit unit 30 incorporating the magnetic field driven type element 31 are superimposed on each other, the signal characteristic of the magnetoresistance effect module 108 can be obtained. By superimposing the Lorentzian-like signal characteristic of the magnetic field driven type element 31, the bandwidth of the magnetoresistance effect module 108 can be widened. Preferably, the frequency at the position of the signal peak of the third circuit unit 30 is a frequency between the frequency at the position of the signal peak of the first circuit unit 10 and the frequency at the position of the signal peak of the second circuit unit 20. That is, preferably, the ferromagnetic resonance frequency of the magnetization free layer 32B of the third magnetoresistance effect element 32 in the magnetic field driven type element 31 is a frequency between the ferromagnetic resonance frequency of the magnetization free layer 12B of the first magnetoresistance effect element 12 and the ferromagnetic resonance frequency of the magnetization free layer 22B of the second magnetoresistance effect element 22.

Further, by adding the Lorentzian-like signal characteristic of the magnetic field driven type element 31, it is possible to increase the difference between the frequency at the position of the signal peak of the first circuit unit 10 (the ferromagnetic resonance frequency of the magnetization free layer 12B of the first magnetoresistance effect element 12) and the frequency at the position of the signal peak of the second circuit unit 20 (the ferromagnetic resonance frequency of the magnetization free layer 22B of the second magnetoresistance effect element 22). Preferably, the difference between the frequencies of the two signal peaks is in the range of 30% or less with respect to a center frequency of the two signal peaks and more preferably, is in the range of 15% or less. Also, regarding a specific numerical value as an example, preferably, the difference between the frequencies of the two signal peaks is 400 MHz or less and more preferably, is 200 MHz or less. Also, preferably, the difference between the frequencies of the two signal peaks is in the range of 0.5% or more with respect to the center frequency and more preferably, is 5 MHz or more. Although the signal peak in the anti-Lorentzian-like signal characteristic has a upwardly convex peak and a downwardly convex peak, the difference between the frequencies of the two signal peaks described above is taken as the difference between the frequencies of the two downwardly convex peaks. The positions of the signal peaks of the first circuit unit 10, the second circuit unit 20 and the third circuit unit 30 incorporating the magnetic field driven type element 31 can be controlled by a frequency setting mechanism 80. Also, the position of the signal peak of the circuit unit (the ferromagnetic resonance frequency of the magnetization free layer of the magnetoresistance effect element) can also be changed depending on a plan view shape of the magnetoresistance effect element and a configuration of layers of the magnetoresistance effect element.

In the magnetic field driven type element 31 shown in FIG. 11, the direct current $I_{DC}$ flows through the third magnetoresistance effect element 32 from the first end face 32*a* toward the second end face 32*b*. The signal characteristic of the magnetic field driven type element 31 is not reversed even if the flowing direction of the direct current $I_{DC}$ is reversed.

In the magnetoresistance effect module 108 shown in FIG. 11, the third circuit unit 30 is connected in series to the first circuit unit 10 and the second circuit unit 20 in the flowing direction of the high frequency current $I_{RC}$. The third circuit unit 30 may be connected in series to or in parallel with at least one of the first circuit unit 10 and the second circuit unit 20 and is not limited to the magnetoresistance effect module 108 shown in FIG. 11.

Figure 13A:
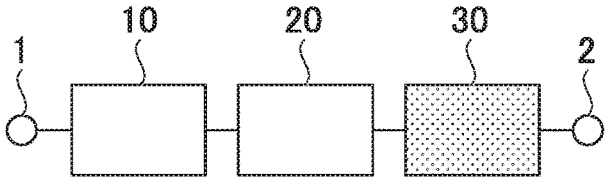
FIGS. 13A to 13H are schematic diagrams showing how to connect the first circuit unit, the second circuit unit, and the third circuit unit.
Figure 13B:
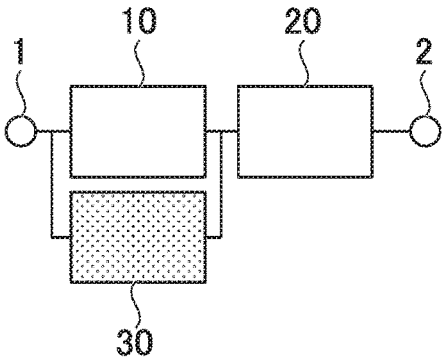
Figure 13C:
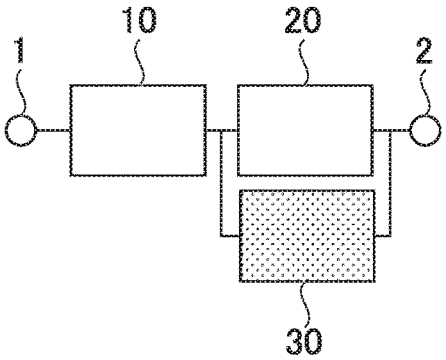
Figure 13D:
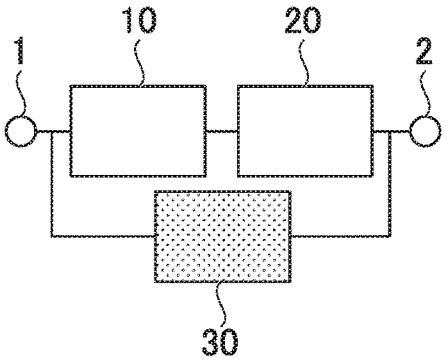
Figure 13E:
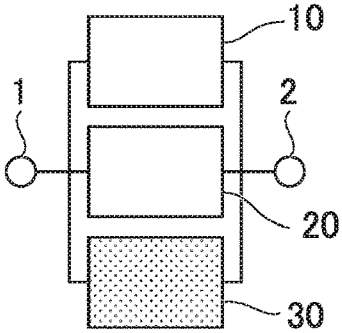
Figure 13F:
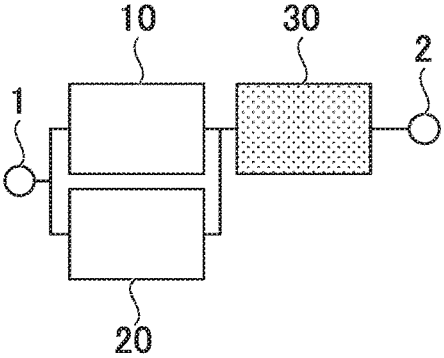
Figure 13G:
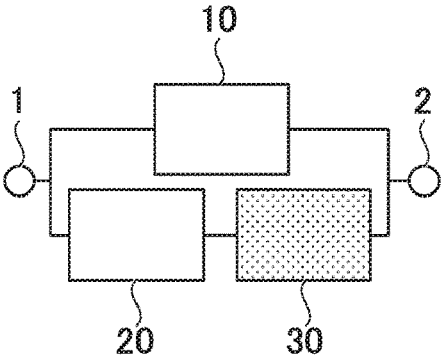
Figure 13H:
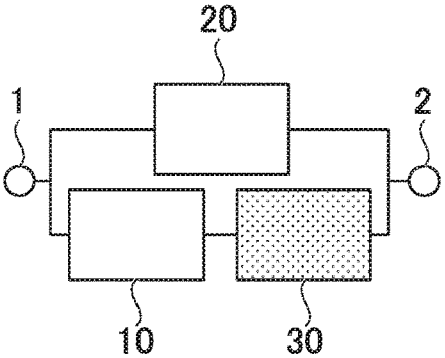

FIG. 13A and FIG. 13B are schematic diagrams showing how to connect the first circuit unit 10, the second circuit unit 20 and the third circuit unit 30. FIG. 13A shows all connected in series, which corresponds to FIG. 11. In FIG. 13B, the first circuit unit 10 and the second circuit unit 20 are connected in series and the third circuit unit 30 is in a parallel relationship only with the first circuit unit 10. In FIG. 13C, the first circuit unit 10 and the second circuit unit 20 are connected in series and the third circuit unit 30 is in a parallel relationship only with the second circuit unit 20. In FIG. 13D, the first circuit unit 10 and the second circuit unit 20 are connected in series and the third circuit unit 30 is in a parallel relationship with the first circuit unit 10 and the second circuit unit 20. In FIG. 13E, all are connected in parallel. In FIG. 13F, the first circuit unit 10 and the second circuit unit 20 are connected in parallel and the third circuit unit 30 is in a series relationship with the first circuit unit 10 and the second circuit unit 20. In FIG. 13G, the first circuit unit 10 and the second circuit unit 20 are connected in parallel and the third circuit unit 30 is in a series relationship with only the second circuit unit 20. In FIG. 13H, the first circuit unit 10 and the second circuit unit 20 are connected in parallel and the third circuit unit 30 is in a series relationship with only the first circuit unit 10.

Figure 14:
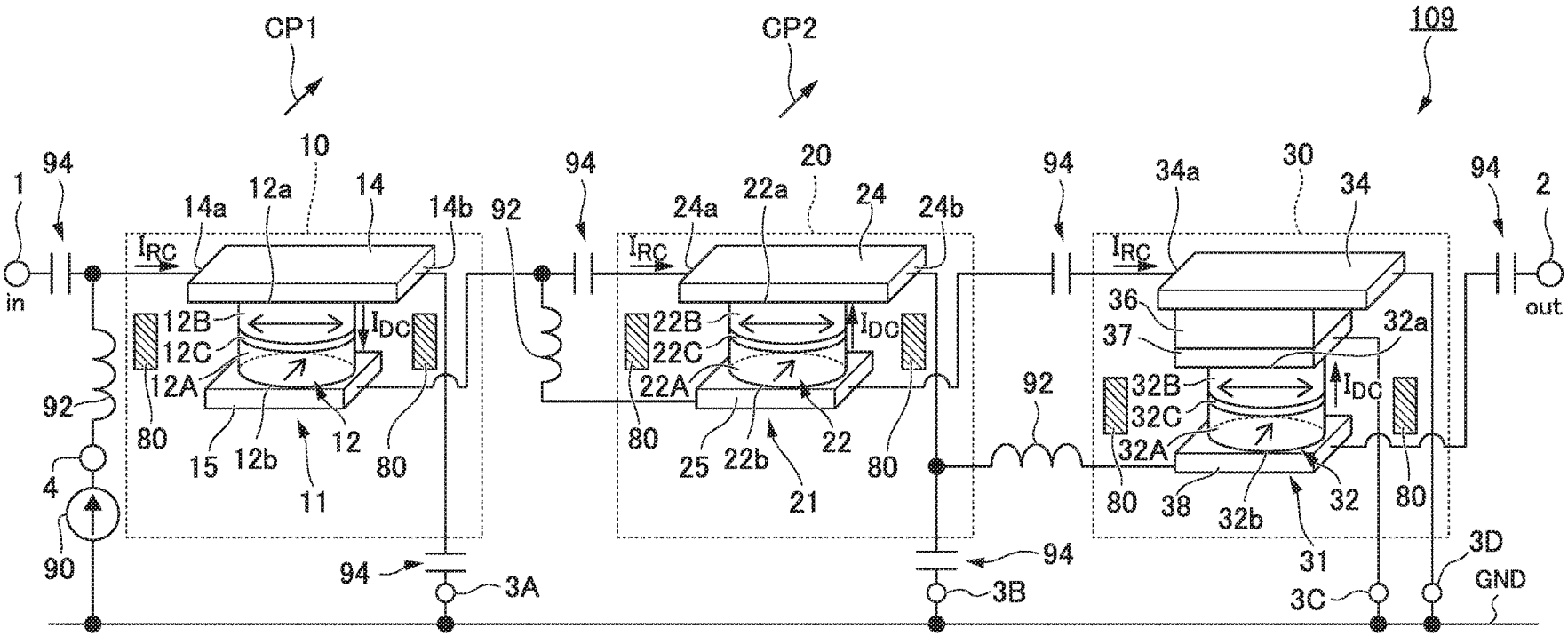
FIG. 14 is a schematic diagram showing a circuit configuration of another example of the magnetoresistance effect module according to the third embodiment.

In addition, as in the magnetoresistance effect module 109 shown in FIG. 14, the first magnetoresistance effect element 12, the second magnetoresistance effect element 22 and the third magnetoresistance effect element 32 may share the DC applying terminal 4 and the power supply 90. In FIG. 14, the reference potential terminal 3A is connected (connected in an AC manner (in a high frequency manner)) to the first circuit unit 10 via the capacitor 94, the reference potential terminal 3B is connected (connected in an AC manner (in a high frequency manner)) to the second circuit unit 20 via the capacitor 94, and the reference potential terminal 3C and the reference potential terminal 3D are connected to the third circuit unit 30. Further, in FIG. 14, the reference potential terminal 3C is connected (connected in a DC manner) to the second circuit unit 20 via the third circuit unit 30 and the inductor 92. Also, in FIG. 14, the reference potential terminal 3C is connected (connected in a DC manner) to the first circuit unit 10 via the third circuit unit 30, the second circuit unit 20, and the inductor 92.

In FIG. 14, the second conductor 24 and the counter electrode 38 are connected via the inductor 92, the first electrode 37 and the reference potential terminal 3C are connected, and the counter electrode 38 and the second port 2 are connected via the capacitor 94. However, the present disclosure is not limited thereto, and the second conductor 24 and the first electrode 37 may be connected via the inductor 92, the counter electrode 38 and the reference potential terminal 3C may be connected, and the first electrode 37 and the second port 2 may be connected via the capacitor 94. In this case, the flowing direction of the direct current $I_{DC}$ flowing inside the third magnetoresistance effect element 32 is reversed.

Figure 15:
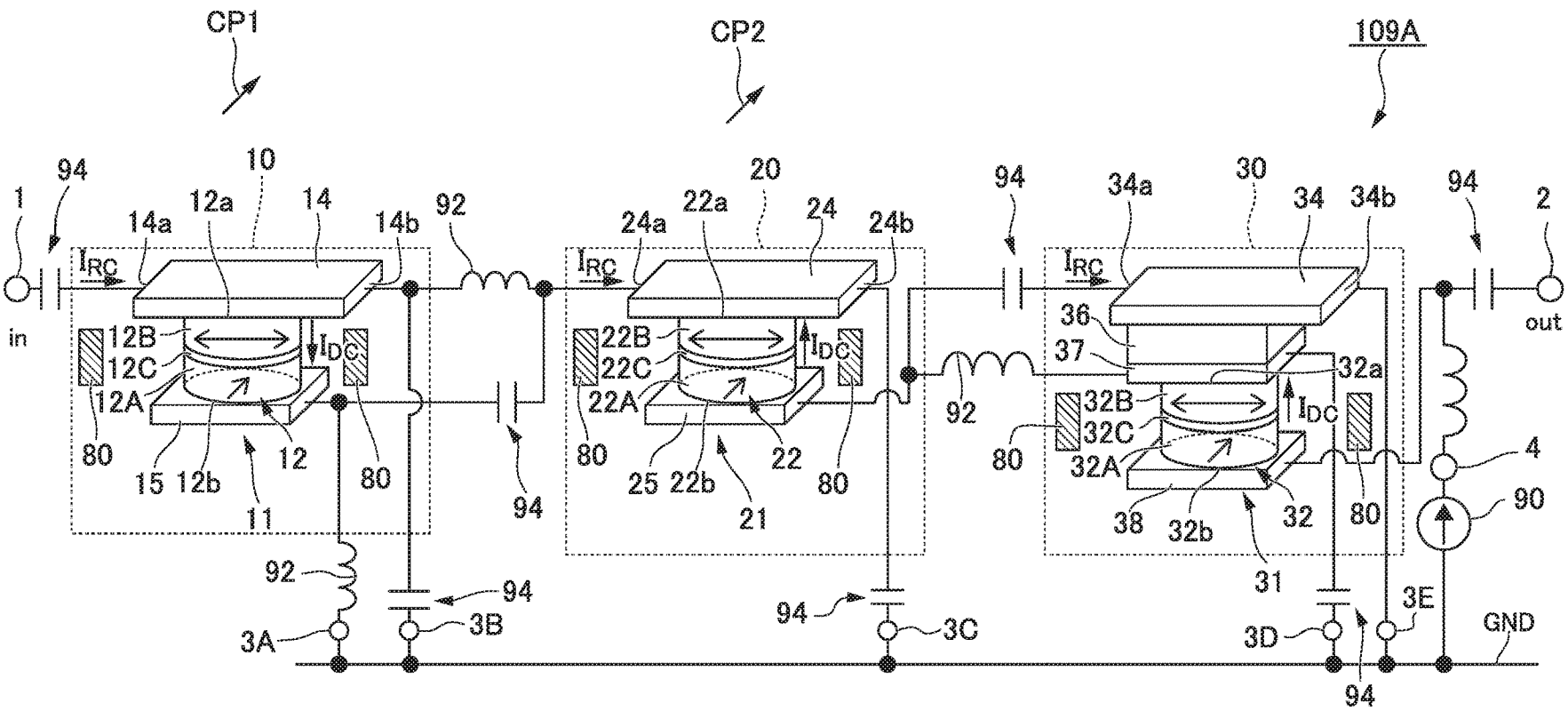
FIG. 15 is a schematic diagram showing a circuit configuration of another example of the magnetoresistance effect module according to the third embodiment.

Also, in FIG. 14, the DC applying terminal 4 and the power supply 90 are connected to the first port 1 side which is the input side of the high frequency current $I_{RC}$. However, as in the magnetoresistance effect module 109A shown in FIG. 15, the DC applying terminal 4 and the power supply 90 may be connected to the second port 2 side which is the output side of the high frequency current $I_{RC}$. In FIG. 15, the reference potential terminal 3A is connected (connected in a DC manner) to the first circuit unit 10 via the inductor 92, the reference potential terminal 3B is connected (connected in an AC manner (in a high frequency manner)) to the first circuit unit 10 via the capacitor 94, the reference potential terminal 3C is connected (connected in an AC manner (in a high frequency manner)) to the second circuit unit 20 via the capacitor 94, the reference potential terminal 3D is connected (connected in an AC manner (in a high frequency manner)) to the third circuit unit 30 via the capacitor 94, and the reference potential terminal 3E is connected to the third circuit unit 30. Further, in FIG. 15, the reference potential terminal 3A is connected (connected in a DC manner) to the second circuit unit 20 via the inductor 92 and the first circuit unit 10. Also, in FIG. 15, the reference potential terminal 3A is connected (connected in a DC manner) to the third circuit unit 30 via the inductor 92, the first circuit unit 10 and the second circuit unit 20.

Figure 16:
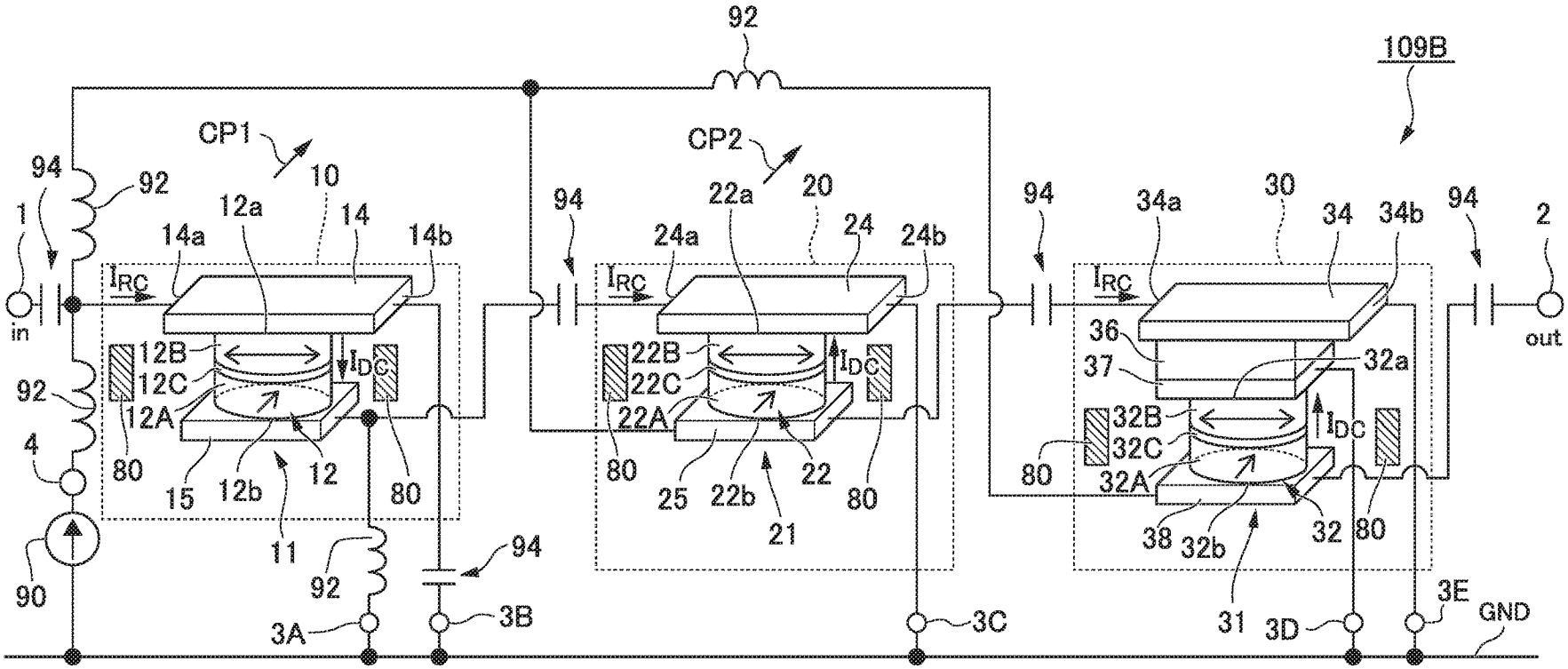
FIG. 16 is a schematic diagram showing a circuit configuration of another example of the magnetoresistance effect module according to the third embodiment.

In addition, FIGS. 14 and 15 show the positional relationship in which the first magnetoresistance effect element 12, the second magnetoresistance effect element 22, and the third magnetoresistance effect element 32 are in series with respect to one power supply 90 (in the flowing direction of the direct current $I_{DC}$). On the other hand, as in the magnetoresistance effect module 109B shown in FIG. 16, the first magnetoresistance effect element 12, the second magnetoresistance effect element 22 and the third magnetoresistance effect element 32 may be in a parallel positional relationship with respect to one power supply 90 (in the flowing direction of the direct current $I_{DC}$). In this case, since the same voltage is applied to each of the magnetoresistance effect elements, the control becomes easy when the power supply 90 is a direct current voltage source. In FIG. 16, the reference potential terminal 3A is connected (connected in a DC manner) to the first circuit unit 10 via the inductor 92, the reference potential terminal 3B is connected (connected in an AC manner (in a high frequency manner)) to the first circuit unit 10 via the capacitor 94, the reference potential terminal 3C is connected to the second circuit unit 20, and the reference potential terminals 3D and 3E are connected to the third circuit unit 30.

Figure 17:
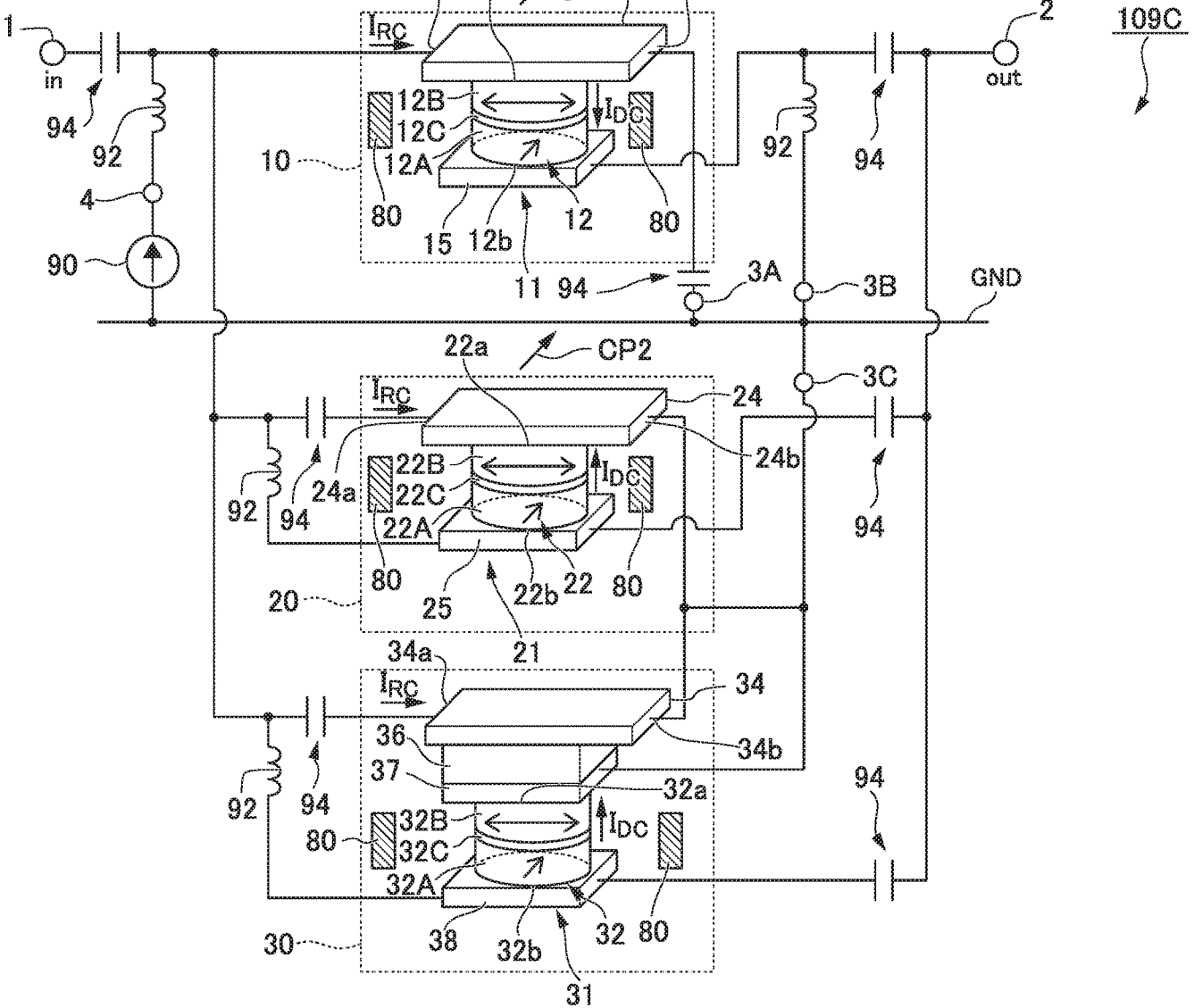
FIG. 17 is a schematic diagram showing a circuit configuration of another example of the magnetoresistance effect module according to the third embodiment.
Figure 18:
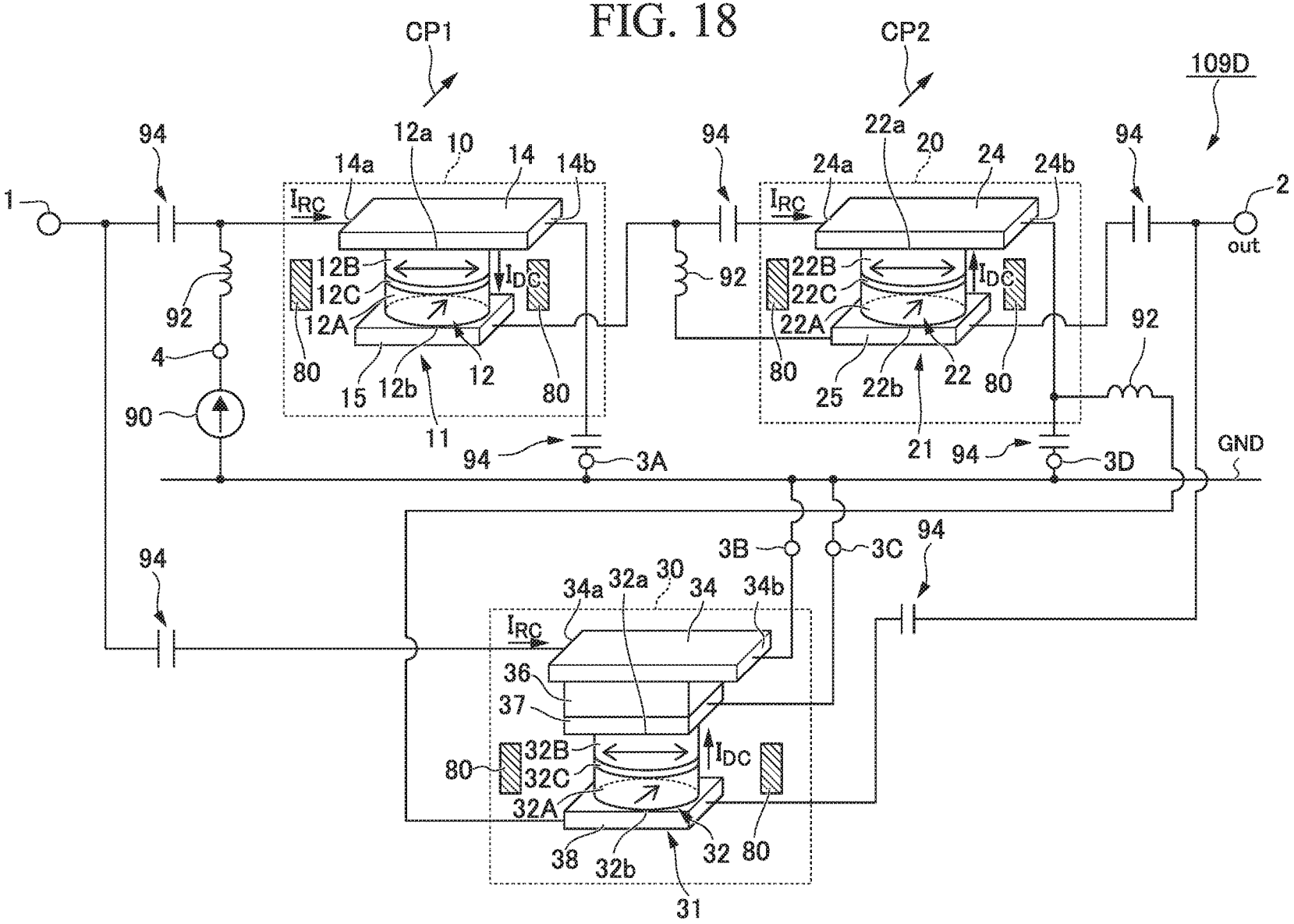
FIG. 18 is a schematic diagram showing a circuit configuration of another example of the magnetoresistance effect module according to the third embodiment.

Also, in each connection state of the circuit units shown in FIGS. 13A to 13H, the DC applying terminal 4 and the power supply 90 can be shared by the magnetoresistance effect element of each circuit unit. The magnetoresistance effect module 109C shown in FIG. 17 is an example in which the DC applying terminal 4 and the power supply 90 are shared in the connection state of FIG. 13E and the magnetoresistance effect module 109D shown in FIG. 18 is an example in which the DC applying terminal 4 and the power supply 90 are shared in the connection state of FIG. 13D. In addition, the reference potential terminals 3A, 3B and 3C may be shared by the first circuit unit 10, the second circuit unit 20, and the third circuit unit 30, or may be provided for each thereof.

Figure 19:
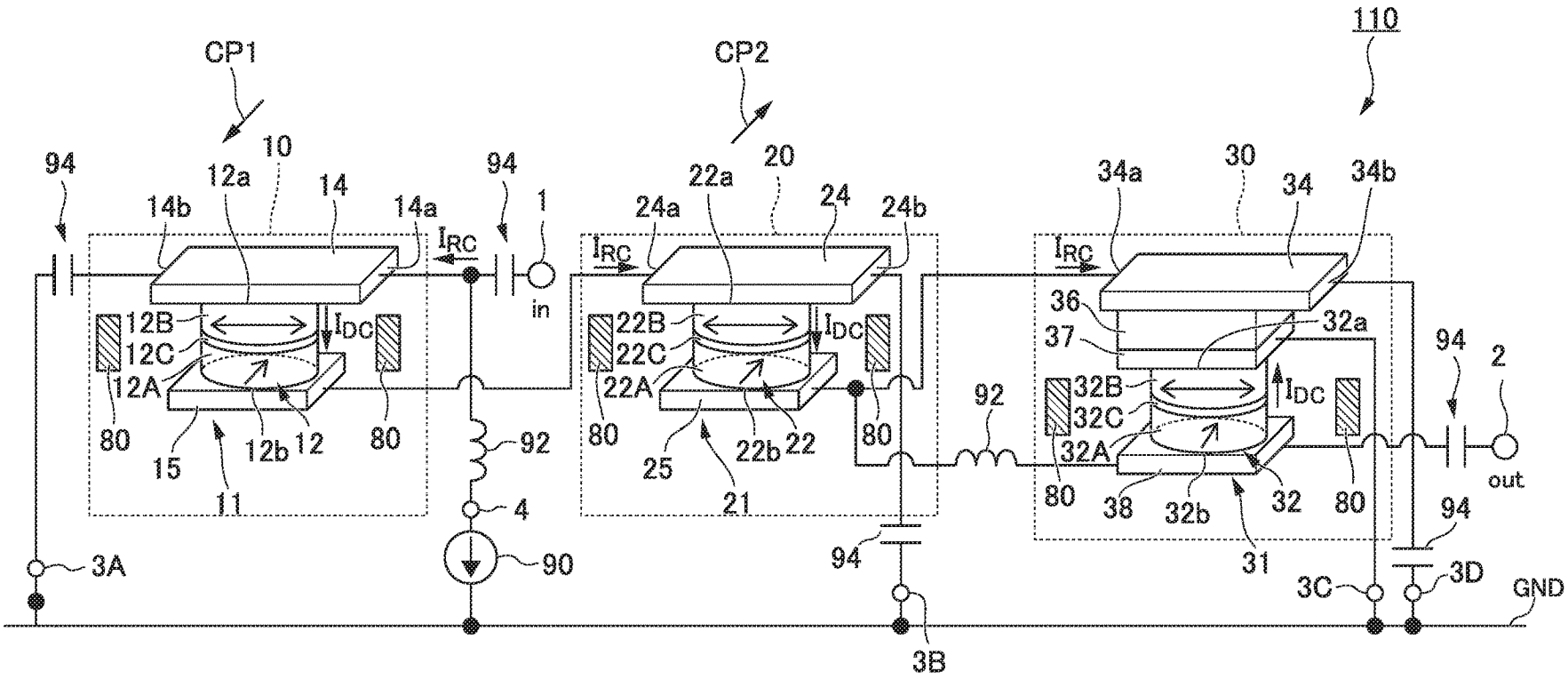
FIG. 19 is a schematic diagram showing a circuit configuration of another example of the magnetoresistance effect module according to the third embodiment.

Also, FIG. 19 is a schematic diagram showing a circuit configuration of another example of the magnetoresistance effect module according to the third embodiment. In FIG. 19, the same components as those in FIG. 11 are denoted by the same reference numerals. The magnetoresistance effect module 110 shown in FIG. 19 is different from the configuration shown in FIG. 11 in that the relative angle between the first cross product direction CP1 of the first circuit unit 10 and the second cross product direction CP2 of the second circuit unit 20 is larger than 90 degrees, and that, when the DC applying terminal 4 is connected to the power supply 90, the positional relationship between the first end face 12*a* and the second end face 12*b* in the first magnetoresistance effect element 12 with respect to the flowing direction of the direct current $I_{DC}$ flowing inside the first magnetoresistance effect element 12 and the positional relationship between the first end face 22*a* and the second end face 22*b* in the second magnetoresistance effect element 22 with respect to the flowing direction of the direct current $I_{DC}$ flowing inside the second magnetoresistance effect element 22 are the same (the positional relationship between the first end face 12*a* and the second end face 12*b* in the first magnetoresistance effect element 12 with respect to the connection point on the input side of the direct current or the direct current voltage of the first magnetoresistance effect element 12 and the positional relationship between the first end face 22*a* and the second end face 22*b* in the second magnetoresistance effect element 22 with respect to the connection point on the input side of the direct current or the direct current voltage of the second magnetoresistance effect element 22 are the same). In FIG. 19, the reference potential terminal 3A is connected (connected in an AC manner (in a high frequency manner)) to the first circuit unit 10 via the capacitor 94, the reference potential terminal 3B is connected (connected in an AC manner (in a high frequency manner)) to the second circuit unit 20 via the capacitor 94, the reference potential terminal 3C is connected to the third circuit unit 30, and the reference potential terminal 3D is connected (connected in an AC manner (in a high frequency manner)) to the third circuit unit 30 via the capacitor 94. Also, in FIG. 19, the reference potential terminal 3C is connected (connected in a DC manner) to the second circuit unit 20 via the third circuit unit 30 and the inductor 92. Also, in FIG. 19, the reference potential terminal 3C is connected (connected in a DC manner) to the first circuit unit 10 via the third circuit unit 30, the inductor 92 and the second circuit unit 20.

Specifically, the relative angle between the first cross product direction CP1 of the first circuit unit 10 and the second cross product direction CP2 of the second circuit unit 20 is 180 degrees and is larger than 90 degrees.

Further, the direct current $I_{DC}$ in the first magnetoresistance effect element 12 flows from the second end face 12*b* side toward the first end face 12*a*. Also, the direct current $I_{Dc}$ in the second magnetoresistance effect element 22 flows from the second end face 22*b* side toward the first end face 22*a*. That is, when the DC applying terminal 4 is connected to the power supply 90, the positional relationship between the first end face 12*a* and the second end face 12*b* in the first magnetoresistance effect element 12 with respect to the flowing direction of the direct current $I_{DC}$ flowing inside the first magnetoresistance effect element 12 and the positional relationship between the first end face 22*a* and the second end face 22*b* in the second magnetoresistance effect element 22 with respect to the flowing direction of the direct current $I_{DC}$ flowing inside the second magnetoresistance effect element 22 are the same.

As described above, according to the magnetoresistance effect modules 108, 109, 109A to 109D and 110 according to the present embodiment, as shown in FIG. 12B, excellent steepness of the magnetoresistance effect modules 108, 109, 109A to 109D and 110 can be obtained. In addition, by superimposing the Lorentzian-like signal characteristic of the magnetic field driven type element 31, it is possible to widen the bandwidth of the magnetoresistance effect modules 108, 109, 109A to 109D and 110.

Fourth Embodiment

Figure 20:
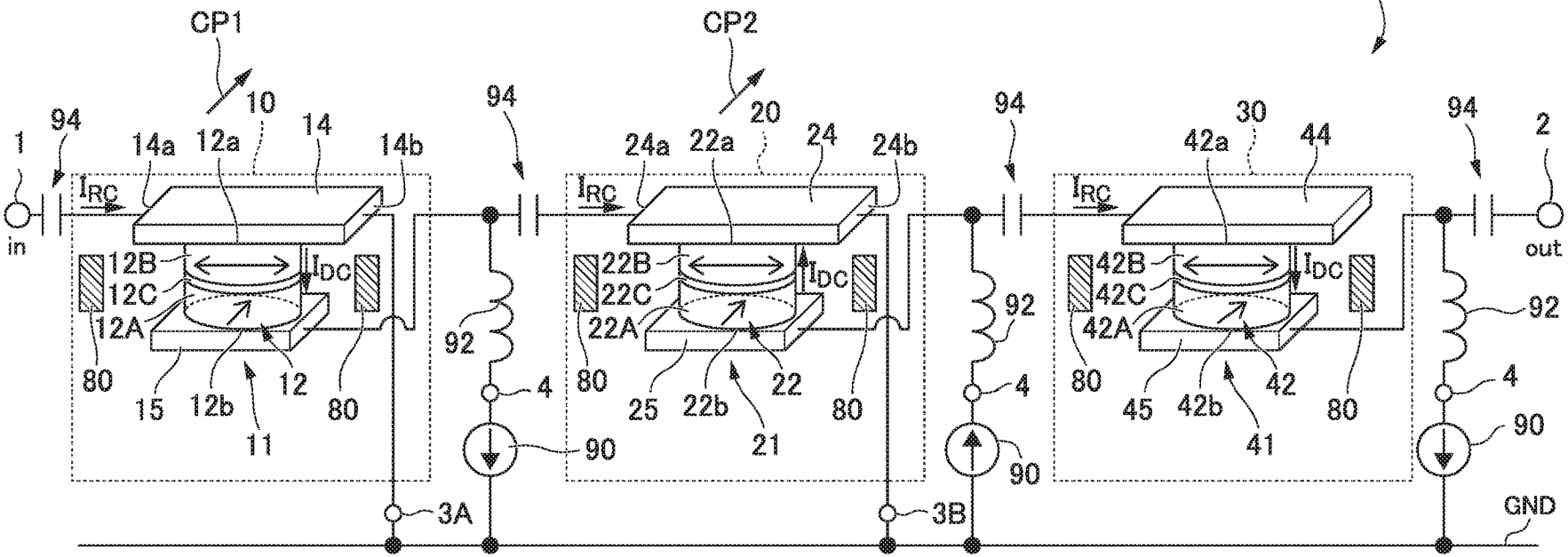
FIG. 20 is a schematic diagram showing a circuit configuration of a magnetoresistance effect module according to a fourth embodiment.

FIG. 20 is a schematic diagram showing a circuit configuration of a magnetoresistance effect module according to a fourth embodiment. The magnetoresistance effect module 111 shown in FIG. 20 is different from the magnetoresistance effect module 100 shown in FIG. 1 in that a third circuit unit 30 is connected thereto. Also, the configuration of the elements incorporated in the third circuit unit 30 is different from that of the magnetoresistance effect module 108 according to the third embodiment. In FIG. 20, the same components as those in FIG. 1 are denoted by the same reference numerals. In FIG. 20, a reference potential terminal 3A is connected to a first circuit unit 10 and a reference potential terminal 3B is connected to a second circuit unit 20.

The third circuit unit 30 shown in FIG. 20 is connected in series to the first circuit unit 10 and the second circuit unit 20. A current driven type element 41 is incorporated in the third circuit unit 30. The current driven type element 41 includes a fourth magnetoresistance effect element 42. The current driven type element 41 is different from the current branch type element in that a first electrode 44 at one end in a stacking direction of the fourth magnetoresistance effect element 42 is not directly connected to a reference potential and a high frequency current $I_{RC}$ flows into the fourth magnetoresistance effect element 42 without branching to the reference potential side.

The fourth magnetoresistance effect element 42 has a magnetization fixed layer 42A, a magnetization free layer 42B and a spacer layer 42C. When a cap layer is provided on a side of the magnetization free layer 42B opposite to the spacer layer 42C side (between the magnetization free layer 42B and the first electrode 44), preferably, the cap layer is a metal film. Preferably, the magnetization free layer 42B and the cap layer are in contact with each other. The first electrode 44 is provided at one end in a stacking direction of the fourth magnetoresistance effect element 42 and a counter electrode 45 is provided at the other end in the stacking direction. One end (a first end face 42*a*) of the fourth magnetoresistance effect element 42 in the stacking direction is connected to an input side of a high frequency current $I_{RC}$ in the third circuit unit 30, the other end (a second end face 42*b*) of the fourth magnetoresistance effect element 42 in the stacking direction is connected to an output side of the high frequency current $I_{RC}$ in the third circuit unit 30, and the high frequency current $I_{RC}$ flows through the fourth magnetoresistance effect element 42 without branching to the reference potential terminal 3 side. The first port 1, the fourth magnetoresistance effect element 42 and the second port 2 are connected in series in this order. In the example of FIG. 20, the high frequency current $I_{RC}$ output from the second circuit unit 20 is input to the third circuit unit 30. In addition, the fourth magnetoresistance effect element 42 is connected to a DC applying terminal 4 which is capable of connecting a power supply 90 for applying a direct current or a direct current voltage to the fourth magnetoresistance effect element 42. In the current driven type element 41 shown in FIG. 20, the direct current $I_{DC}$ flows through the fourth magnetoresistance effect element 42 from the magnetization free layer 42B toward the magnetization fixed layer 42A.

The magnetization of the magnetization free layer 42B oscillates when receiving a spin transfer torque accompanying the high frequency current $I_{RC}$ flowing through the fourth magnetoresistance effect element 42. The magnetization of the magnetization free layer 42B oscillates greatly when the frequency of the high frequency current $I_{RC}$ is in the vicinity of the ferromagnetic resonance frequency of the magnetization free layer 42B. When the oscillation of the magnetization of the magnetization free layer 42B increases, a change in the resistance value in the fourth magnetoresistance effect element 42 increases. This change in the resistance value is output from the fourth magnetoresistance effect element 42 (the third circuit unit 30) by applying the direct current $I_{DC}$ in the stacking direction of the fourth magnetoresistance effect element 42. A sum of the output due to the change in the resistance value resulting from this ferromagnetic resonance phenomenon and the output due to the high frequency current $I_{RC}$ flowing through the fourth magnetoresistance effect element is output from the fourth magnetoresistance effect element 42 (the third circuit unit 30).

The signal characteristic of the third circuit unit 30 incorporating the current driven type element 41 is the Lorentzian-like signal characteristic when individually adopted. It is considered that the difference in the signal characteristic of the third circuit unit 30 with respect to the first circuit unit 10 and the second circuit unit 20 results from a configuration of an element, a way of flowing the high frequency current with respect the magnetoresistance effect element, a difference of the driving force for oscillating the magnetization of the magnetization free layer 42B, and the like. For that reason, as in FIG. 12A and FIG. 12B, by superimposing the signal characteristic of the first circuit unit 10, the signal characteristic of the second circuit unit 20 and the signal characteristic of the third circuit unit 30 incorporating the current driven type element 41 on each other, the signal characteristic as shown in FIG. 12B can be obtained in the magnetoresistance effect module 111.

By superimposing t the Lorentzian-like signal characteristic of the third circuit unit 30 incorporating the current driven type element 41, the bandwidth of the magnetoresistance effect module 111 is widened. Preferably, the frequency at the position of the signal peak of the third circuit unit 30 is a frequency between the frequency at the position of the signal peak of the first circuit unit 10 and the frequency at the position of the signal peak of the second circuit unit 20. That is, preferably, the ferromagnetic resonance frequency of the magnetization free layer 42B of the fourth magnetoresistance effect element 42 in the current driven type element 41 is a frequency between the ferromagnetic resonance frequency of the magnetization free layer 12B of the first magnetoresistance effect element 12 and the ferromagnetic resonance frequency of the magnetization free layer 22B of the second magnetoresistance effect element 22.

In addition, by adding the Lorentzian-like signal characteristic of the third circuit unit 30 incorporating the current driven type element 41, the difference between the frequency at the position of the signal peak of the first circuit unit 10 (the ferromagnetic resonance frequency of the magnetization free layer 12B of the first magnetoresistance effect element 12) and the frequency at the position of the signal peak of the second circuit unit 20 (the ferromagnetic resonance frequency of the magnetization free layer 22B of the second magnetoresistance effect element 22) can be increased. Preferably, the difference between the frequencies of the two signal peaks is in the range of 30% or less with respect to a center frequency of the two signal peaks and more preferably, is in the range of 15% or less. Also, regarding a specific numerical value, preferably, the difference between the frequencies of the two signal peaks is 400 MHz or less and more preferably, is 200 MHz or less. Also, preferably, the difference between the frequencies of the two signal peaks is in the range of 0.5% or more with respect to the center frequency and more preferably, is 5 MHz or more. Although the signal peak in the anti-Lorentzian-like signal characteristic has an upwardly convex peak and a downwardly convex peak, the difference between the frequencies of the two signal peaks described above is taken as a difference between the frequencies of the two downwardly convex peaks. The positions of the signal peaks of the first circuit unit 10, the second circuit unit 20 and the third circuit unit 30 incorporating the current driven type element 41 can be controlled by a frequency setting mechanism 80. Further, the position of the signal peak of the circuit unit (the ferromagnetic resonance frequency of the magnetization free layer of the magnetoresistance effect element) can also be changed depending on a plan view shape of the magnetoresistance effect element and a configuration of layers of the magnetoresistance effect element.

Also, in the fourth embodiment, the third circuit unit 30 may be connected in series or in parallel with at least one of the first circuit unit 10 and the second circuit unit 20. For that reason, all of the connection types shown in FIGS. 13A to 13H can be selected.

Further, desirably, the size of the fourth magnetoresistance effect element 42 formed is such that a long side of the fourth magnetoresistance effect element 42 in a plan view shape is set to 250 nm or less. In addition, desirably, a short side of the fourth magnetoresistance effect element 42 in a plan view shape is 20 nm or more. In the case of the current driven type element 41, preferably, the size of the fourth magnetoresistance effect element 42 is small. When the size of the fourth magnetoresistance effect element 42 becomes smaller, the effect of the spin transfer torque becomes greater, so that a highly efficient ferromagnetic resonance phenomenon can be obtained.

Preferably, the area of the fourth magnetoresistance effect element 42 in a plan view shape is smaller than the area of the first magnetoresistance effect element 12 in a plan view shape and the area of the second magnetoresistance effect element 22 in a plan view shape.

Figure 21A:
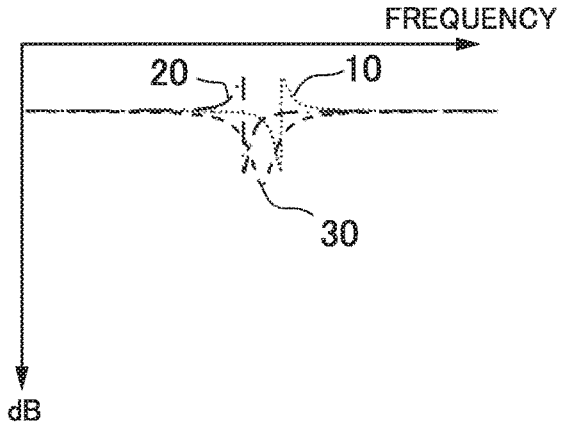
FIG. 21A is a schematic diagram showing signal characteristics when a first circuit unit, a second circuit unit, and a third circuit unit are independent.
Figure 21B:
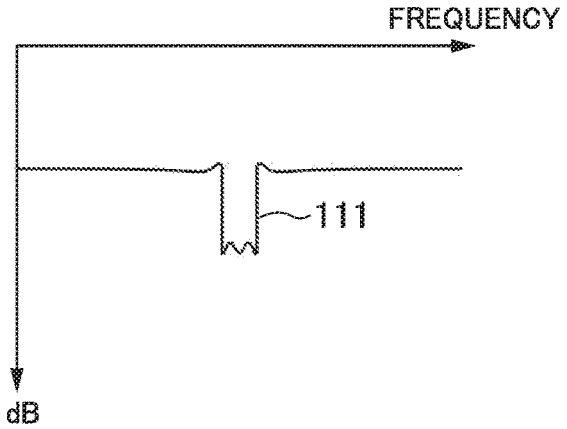
FIG. 21B is a schematic diagram showing signal characteristics of a magnetoresistance effect module including the first circuit unit, the second circuit unit, and the third circuit unit.

Also, similarly to the first circuit unit 10 and the second circuit unit 20, when the flowing direction of the direct current $I_{DC}$ flowing into the fourth magnetoresistance effect element 42 is reversed, the tendency of the signal characteristic of the third circuit unit 30 incorporating the current driven type element 41 is reversed. FIGS. 21A and 21B are schematic diagrams showing the signal characteristics in the case where the first circuit unit 10, the second circuit unit 20, and the third circuit unit 30 incorporating the current driven type element 41 are individually adopted when the direct current $I_{DC}$ flows through the first magnetoresistance effect element 12 from the second end face 12*b* toward the first end face 12*a* (flows from the magnetization fixed layer 12A toward the magnetization free layer 12B), flows through the second magnetoresistance effect element 22 from the first end face 22*a* toward the second end face 22*b* (flows from the magnetization free layer 22B toward the magnetization fixed layer 22A), and flows through the fourth magnetoresistance effect element 42 from the second end face 42*b* toward the first end face 42*a* (flows from the magnetization fixed layer 42A toward the magnetization free layer 42B), and the signal characteristic of the magnetoresistance effect module 111 including these components. FIG. 21A shows the signal characteristic in the case where the first circuit unit 10, the second circuit unit 20, and the third circuit unit 30 incorporating the current driven type element 41 are individually adopted, and FIG. 21B shows the signal characteristic of the magnetoresistance effect module 111.

As shown in FIG. 21B, even when the trends of the signal characteristics of the first circuit unit 10, the second circuit unit 20, and the third circuit unit 30 incorporating the current driven type element 41 are reversed, excellent steepness of the magnetoresistance effect module 111 can be obtained. In this case, the magnetoresistance effect module 111 functions as a high frequency filter of a band stop type.

In the case of the band stop type, it is preferable that the difference between the frequency at the position of the signal peak of the first circuit unit 10 (the ferromagnetic resonance frequency of the magnetization free layer 12B of the first magnetoresistance effect element 12) and the frequency at the position of the signal peak of the second circuit unit 20 (the ferromagnetic resonance frequency of the magnetization free layer 22B of the second magnetoresistance effect element 22) is in the same range as in of the bandpass type. The difference between the frequencies of the two signal peaks in the case of the band stop type means a difference between the frequencies of the two downwardly convex peaks.

Figure 22:
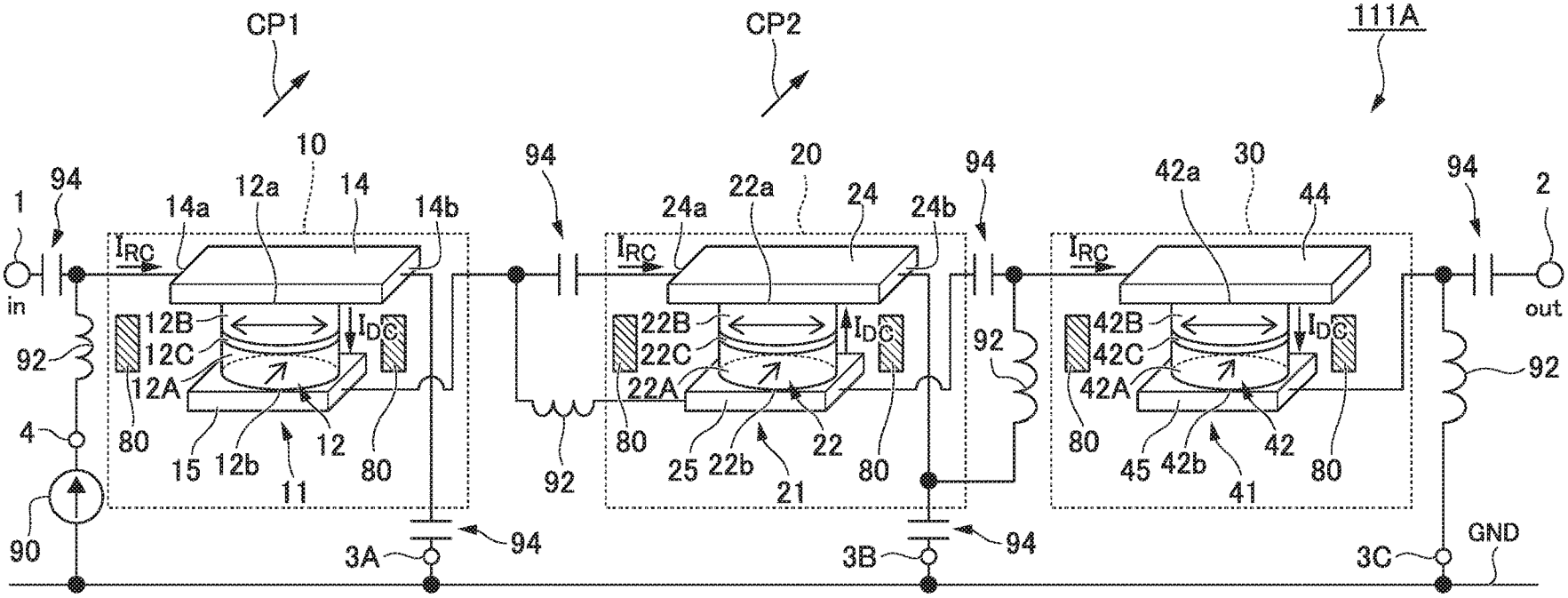
FIG. 22 is a schematic diagram showing a circuit configuration of another example of the magnetoresistance effect module according to the fourth embodiment.

Also, as in the magnetoresistance effect module 111A shown in FIG. 22, the DC applying terminal 4 and the power supply 90 may be shared by the first magnetoresistance effect element 12, the second magnetoresistance effect element 22 and the fourth magnetoresistance effect element 42. In FIG. 22, the reference potential terminal 3A is connected (connected in an AC manner (in a high frequency manner)) to the first circuit unit 10 via the capacitor 94, the reference potential terminal 3B is connected (connected in an AC manner (in a high frequency manner)) to the second circuit unit 20 via the capacitor 94, and the reference potential terminal 3C is connected (connected in a DC manner) to the third circuit unit 30 via the inductor 92. In addition, in FIG. 22, the reference potential terminal 3C is connected (connected in a DC manner) to the second circuit unit 20 via the inductor 92 and the third circuit unit 30. Further, in FIG. 22, the reference potential terminal 3C is connected (connected in a DC manner) to the first circuit unit 10 via the inductor 92, the third circuit unit 30 and the second circuit unit 20. Also, the reference potential terminals 3A, 3B and 3C may be shared by the first circuit unit 10, the second circuit unit 20 and the third circuit unit 30 or may be provided for each.

Figure 23:
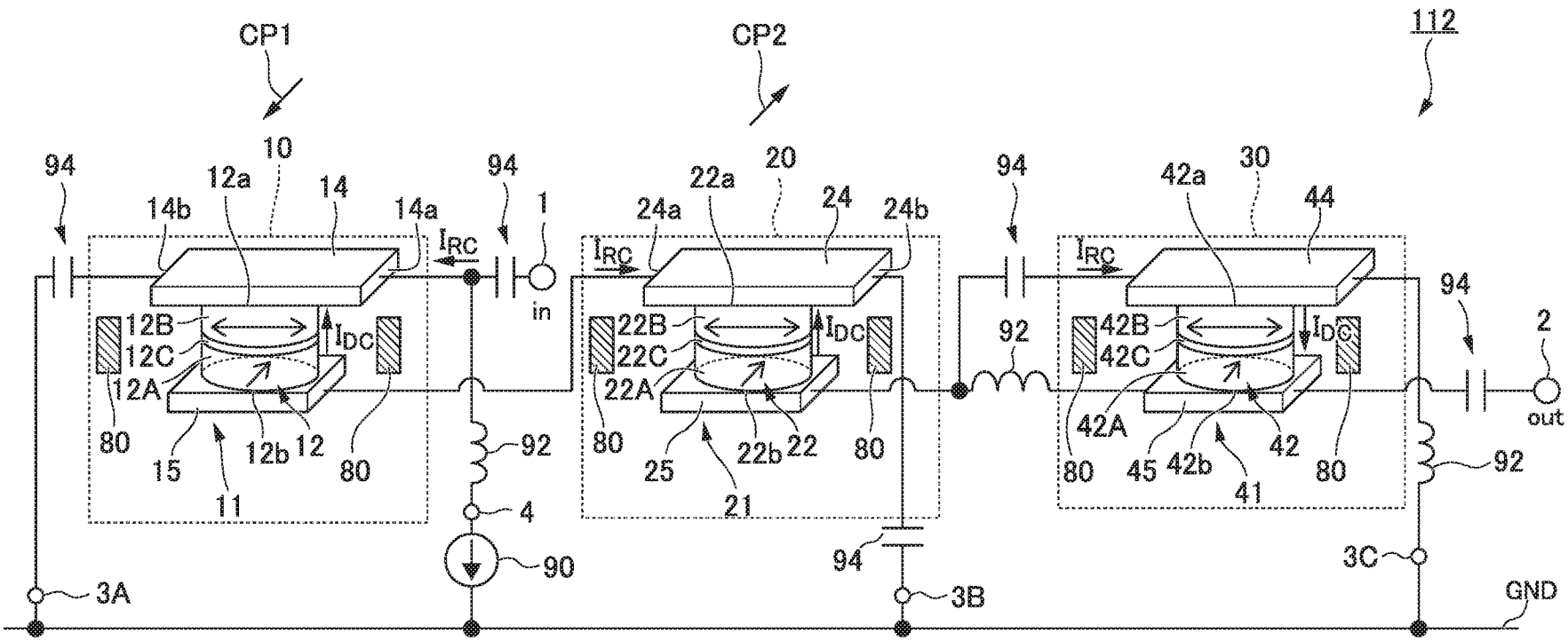
FIG. 23 is a schematic diagram showing a circuit configuration of another example of the magnetoresistance effect module according to the fourth embodiment.

Also, FIG. 23 is a schematic diagram showing a circuit configuration of another example of the magnetoresistance effect module according to the fourth embodiment. In FIG. 23, the same components as those in FIG. 20 are denoted by the same reference numerals. The magnetoresistance effect module 112 shown in FIG. 23 is different from the configuration shown in FIG. 20 in that the relative angle between the first cross product direction CP1 of the first circuit unit 10 and the second cross product direction CP2 of the second circuit unit 20 is larger than 90 degrees, and that, when the DC applying terminal 4 is connected to the power supply 90, the positional relationship between the first end face 12*a* and the second end face 12*b* in the first magnetoresistance effect element 12 with respect to the flowing direction of the direct current $I_{DC}$ flowing inside the first magnetoresistance effect element 12 and the positional relationship between the first end face 22*a* and the second end face 22*b* in the second magnetoresistance effect element 22 with respect to the flowing direction of the direct current $I_{DC}$ flowing inside the second magnetoresistance effect element 22 are the same (the positional relationship between the first end face 12*a* and the second end face 12*b* in the first magnetoresistance effect element 12 with respect to the connection point on the input side of the direct current or the direct current voltage of the first magnetoresistance effect element 12 and the positional relationship between the first end face 22*a* and the second end face 22*b* in the second magnetoresistance effect element 22 with respect to the connection point on the input side of the direct current or the direct current voltage of the second magnetoresistance effect element 22 are the same). In addition, in FIG. 23, the reference potential terminal 3A is connected (connected in an AC manner (in a high frequency manner)) to the first circuit unit 10 via the capacitor 94, the reference potential terminal 3B is connected (connected in an AC manner (in a high frequency manner)) to the second circuit unit 20 via the capacitor 94, and the reference potential terminal 3C is connected (connected in a DC manner) to the third circuit unit 30 via the inductor 92. Further, in FIG. 23, the reference potential terminal 3C is connected (connected in a DC manner) to the second circuit unit 20 via the inductor 92 and the third circuit unit 30. Also, in FIG. 22, the reference potential terminal 3C is connected (connected in a DC manner) to the first circuit unit 10 via the inductor 92, the third circuit unit 30 and the second circuit unit 20.

Specifically, the relative angle between the first cross product direction CP1 of the first circuit unit 10 and the second cross product direction CP2 of the second circuit unit 20 is 180 degrees and is larger than 90 degrees.

Also, in the first magnetoresistance effect element 12, the direct current $I_{DC}$ flows from the second end face 12*b* side toward the first end face 12*a*. Also, in the second magnetoresistance effect element 22, the direct current $I_{DC}$flows from the second end face 22*b* side toward the first end face 22*a*. That is, when the DC applying terminal 4 is connected to the power supply 90, the positional relationship between the first end face 12*a* and the second end face 12*b* in the first magnetoresistance effect element 12 with respect to the flowing direction of the direct current $I_{DC}$ flowing inside the first magnetoresistance effect element 12 and the positional relationship between the first end face 22*a* and the second end face 22*b* in the second magnetoresistance effect element 22 with respect to the flowing direction of the direct current $I_{DC}$ flowing inside the second magnetoresistance effect element 22 are the same.

As described above, according to the magnetoresistance effect modules 111, 111A and 112 according to the present embodiment, excellent steepness of the magnetoresistance effect modules 111, 111A and 112 can be obtained as shown in FIG. 12B or FIG. 21B. In addition, by superimposing the Lorentzian-like signal characteristic of the third circuit unit 30 incorporating the current driven type element 41, it is possible to widen the bandwidth of the magnetoresistance effect modules 111 and 111A.

Fifth Embodiment

Figure 24:
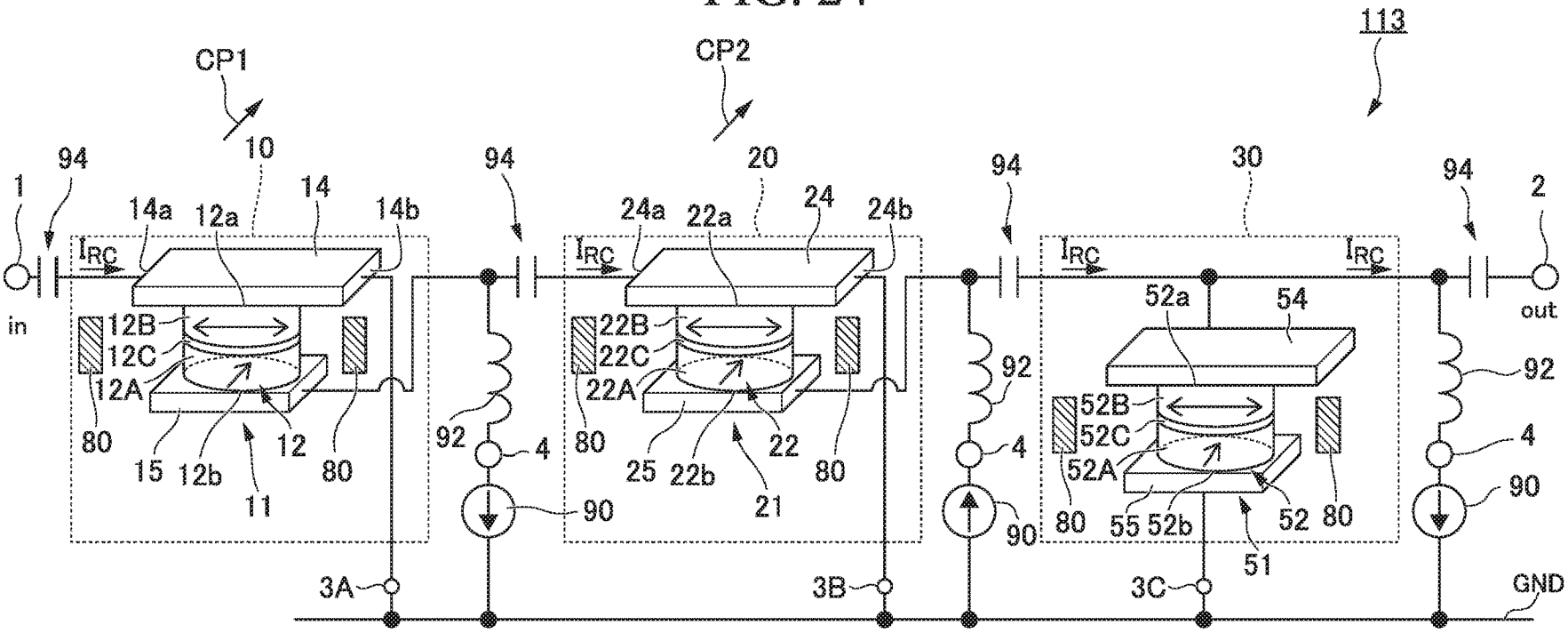
FIG. 24 is a schematic diagram showing a circuit configuration of a magnetoresistance effect module according to a fifth embodiment.

FIG. 24 is a schematic diagram showing a circuit configuration of a magnetoresistance effect module according to a fifth embodiment. The magnetoresistance effect module 113 shown in FIG. 24 is different from the magnetoresistance effect module 100 shown in FIG. 1 in that a third circuit unit 30 is connected thereto. Also, the configuration of the element incorporated in the third circuit unit 30 is different from the magnetoresistance effect modules according to the second embodiment and the third embodiment. In FIG. 24, the same components as those in FIG. 1 are denoted by the same reference numerals.

The third circuit unit 30 shown in FIG. 24 is connected in series with a first circuit unit 10 and a second circuit unit 20. A current driven type element 51 is incorporated in the third circuit unit 30. The current driven type element 51 includes a fifth magnetoresistance effect element 52. In FIG. 24, a reference potential terminal 3A is connected to the first circuit unit 10, a reference potential terminal 3B is connected to the second circuit unit 20, and a reference potential terminal 3C is connected to the third circuit unit 30.

The fifth magnetoresistance effect element 52 has a magnetization fixed layer 52A, a magnetization free layer 52B and a spacer layer 52C. When a cap layer is provided on a side of the magnetization free layer 52B opposite to the spacer layer 52C side (between the magnetization free layer 52B and a first electrode 54), preferably, the cap layer is a metal film. Preferably, the magnetization free layer 52B and the cap layer are in contact with each other. The first electrode 54 is provided at one end of the fifth magnetoresistance effect element 52 in the stacking direction and a counter electrode 55 is provided at the other end thereof in the stacking direction. One end (a first end face 52*a*) of the fifth magnetoresistance effect element 52 is connected to an input side and an output side (a second port 2) of a high frequency current $I_{RC}$ in the third circuit unit 30, and the other end (a second end face 52*b*) of the fifth magnetoresistance effect element 52 is connected to the reference potential terminal 3. When viewed from the input side of the high frequency current $I_{RC}$ in the third circuit unit 30, the output side (the second port 2) of the high frequency current $I_{RC}$ and the reference potential terminal 3 are in a parallel positional relationship. That is, for the high frequency current $I_{RC}$, the second port 2 and the reference potential terminal 3 are in a parallel positional relationship. In other words, the fifth magnetoresistance effect element 52 is connected in parallel to the first port 1 and the second port 2. The high frequency current $I_{RC}$ branches to flow to the output side of the high frequency current $I_{RC}$ in the third circuit unit 30 and the fifth magnetoresistance effect element 52. In the example of FIG. 24, the high frequency current $I_{RC}$ output from the second circuit unit 20 is input to the third circuit unit 30. The fifth magnetoresistance effect element 52 is connected to a DC applying terminal 4 which is capable of connecting a power supply 90 for applying a direct current or a direct current voltage to the fifth magnetoresistance effect element 52. In the current driven type element 51 shown in FIG. 24, the direct current $I_{DC}$ flows through the fifth magnetoresistance effect element 52 from the magnetization fixed layer 52A toward the magnetization free layer 52B.

The magnetization of the magnetization free layer 52B oscillates when receiving a spin transfer torque accompanying the high frequency current $I_{RC}$ flowing in the fifth magnetoresistance effect element 52. The magnetization of the magnetization free layer 52B oscillates greatly when the frequency of the high frequency current $I_{RC}$ is in the vicinity of the ferromagnetic resonance frequency of the magnetization free layer 52B. When the oscillation of the magnetization of the magnetization free layer 52B increases, a change in the resistance value in the fifth magnetoresistance effect element 52 increases. This change in the resistance value is output from the fifth magnetoresistance effect element 52 by applying the direct current $I_{DC}$ in the stacking direction of the fifth magnetoresistance effect element 52. A sum of the output due to the change in the resistance value resulting from this ferromagnetic resonance phenomenon and the output due to the high frequency current $I_{RC}$ flowing on the output side of the high frequency current $I_{RC}$ in the third circuit unit 30 is output from the third circuit unit 30.

The signal characteristic of the third circuit unit 30 incorporating the current driven type element 51 is the Lorentzian-like signal characteristic when individually adopted. It is considered that the difference in the signal characteristic of the third circuit unit 30 with respect to the first circuit unit 10 and the second circuit unit 20 results from a configuration of an element, a way of flowing the high frequency current with respect the magnetoresistance effect element, a difference of the driving force for oscillating the magnetization of the magnetization free layer 52B, and the like. For that reason, as in FIG. 12A and FIG. 12B, by superimposing the signal characteristic of the first circuit unit 10, the signal characteristic of the second circuit unit 20 and the signal characteristic of the third circuit unit 30 incorporating the current driven type element 51, the signal characteristic as shown in FIG. 12B can be obtained in the magnetoresistance effect module 113.

By superimposing the Lorentzian-like signal characteristic of the third circuit unit 30 incorporating the current driven type element 51, the bandwidth of the magnetoresistance effect module 113 is widened. Preferably, the frequency at the position of the signal peak of the third circuit unit 30 is a frequency between the frequency at the position of the signal peak of the first circuit unit 10 and the frequency at the position of the signal peak of the second circuit unit 20. That is, preferably, the ferromagnetic resonance frequency of the magnetization free layer 52B of the fifth magnetoresistance effect element 52 in the current driven type element 51 is a frequency between the ferromagnetic resonance frequency of the magnetization free layer 12B of the first magnetoresistance effect element 12 and the ferromagnetic resonance frequency of the magnetization free layer 22B of the second magnetoresistance effect element 22.

In addition, by adding the Lorentzian-like signal characteristic of the third circuit unit 30 incorporating the current driven type element 51, the difference between the frequency at the position of the signal peak of the first circuit unit 10 (the ferromagnetic resonance frequency of the magnetization free layer 12B of the first magnetoresistance effect element 12) and the frequency at the position of the signal peak of the second circuit unit 20 (the ferromagnetic resonance frequency of the magnetization free layer 22B of the second magnetoresistance effect element 22) can be increased. Preferably, the difference between the frequencies of the two signal peaks is in the range of 30% or less with respect to a center frequency of the two signal peaks and more preferably, is in the range of 15% or less. Also, regarding a specific numerical value, preferably, the difference between the frequencies of the two signal peaks is 400 MHz or less and more preferably, is 200 MHz or less. Also, preferably, the difference between the frequencies of the two signal peaks is in the range of 0.5% or more with respect to the center frequency and more preferably, is 5 MHz or more. Although the signal peak in the anti-Lorentzian-like signal characteristic has an upwardly convex peak and a downwardly convex peak, the difference between the frequencies of the two signal peaks described above is taken as a difference between the frequencies of the two downwardly convex peaks. The positions of the signal peaks of the first circuit unit 10, the second circuit unit 20 and the third circuit unit 30 incorporating the current driven type element 51 can be controlled by a frequency setting mechanism 80. Further, the position of the signal peak of the circuit unit (the ferromagnetic resonance frequency of the magnetization free layer of the magnetoresistance effect element) can also be changed depending on a plan view shape of the magnetoresistance effect element and a configuration of layers of the magnetoresistance effect element.

Also, in the fourth embodiment, the third circuit unit 30 may be connected in series or in parallel with at least one of the first circuit unit 10 and the second circuit unit 20. For that reason, all of the connection types shown in FIGS. 13A to 13H can be selected.

Further, desirably, the size of the fifth magnetoresistance effect element 52 formed is such that a long side of the fifth magnetoresistance effect element 52 in a plan view shape is set to 250 nm or less. In addition, desirably, a short side of the fifth magnetoresistance effect element 52 in a plan view shape is 20 nm or more. In the case of the current driven type element 51, preferably, the size of the fifth magnetoresistance effect element 52 is small. When the size of the fifth magnetoresistance effect element 52 becomes smaller, the effect of the spin transfer torque becomes greater, so that a highly efficient ferromagnetic resonance phenomenon can be obtained. Preferably, the area of the fifth magnetoresistance effect element 52 in a plan view shape is smaller than the area of the first magnetoresistance effect element 12 in a plan view shape and the area of the second magnetoresistance effect element 22 in a plan view shape.

Also, similarly to the first circuit unit 10 and the second circuit unit 20, when the flowing direction of the direct current $I_{DC}$ flowing in the fifth magnetoresistance effect element 52 is reversed, the tendency of the signal characteristic of the third circuit unit 30 incorporating the current driven type element 51 is reversed. That is, the signal characteristic of the magnetoresistance effect module 107 is the same as the signal characteristic shown in FIG. 21B in the case where the direct current $I_D$c flows through the first magnetoresistance effect element 12 from the second end face 12*b* toward the first end face 12*a* (flows from the magnetization fixed layer 12A toward the magnetization free layer 12B), flows through the second magnetoresistance effect element 22 from the first end face 22*a* toward the second end face 22*b* (flows from the magnetization free layer 22B toward the magnetization fixed layer 22A), and flows through the fifth magnetoresistance effect element 52 from the first end face 52*a* toward the second end face 52*b* (flows from the magnetization free layer 52B toward the magnetization fixed layer 52A). In this case, the magnetoresistance effect module 113 functions as a high frequency filter of a band stop type.

In the case of the band stop type, it is preferable that the difference between the frequency at the position of the signal peak of the first circuit unit 10 (the ferromagnetic resonance frequency of the magnetization free layer 12B of the first magnetoresistance effect element 12) and the frequency at the position of the signal peak of the second circuit unit 20 (the ferromagnetic resonance frequency of the magnetization free layer 22B of the second magnetoresistance effect element 22) is in the same range as in the bandpass type. The difference between the frequencies of the two signal peaks in the case of the band stop type means a difference between the frequencies of the two downwardly convex peaks.

Figure 25:
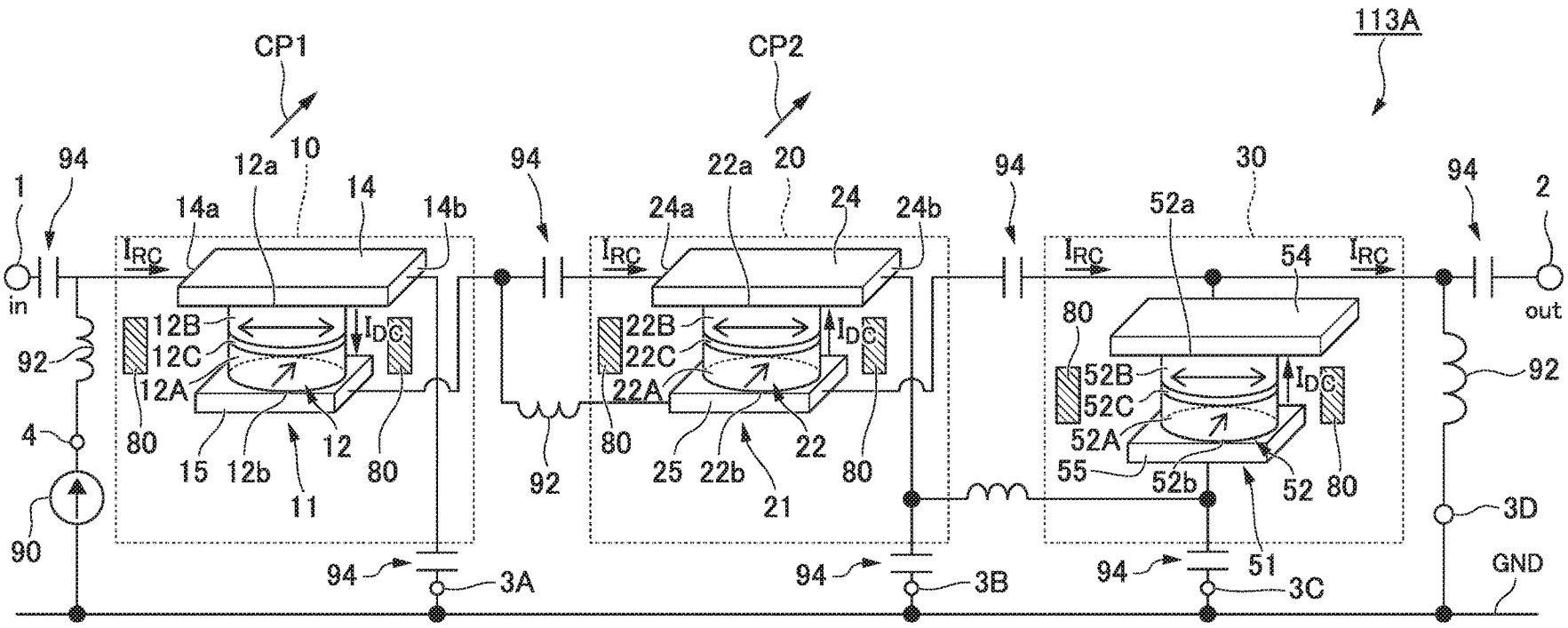
FIG. 25 is a schematic diagram showing a circuit configuration of another example of the magnetoresistance effect module according to the fifth embodiment.

Also, as in the magnetoresistance effect module 113A shown in FIG. 25, the DC applying terminal 4 and the power supply 90 may be shared by the first magnetoresistance effect element 12, the second magnetoresistance effect element 22 and the fifth magnetoresistance effect element 52. In FIG. 25, the reference potential terminal 3A is connected (connected in an AC manner (in a high frequency manner)) to the first circuit unit 10 via the capacitor 94, the reference potential terminal 3B is connected (connected in an AC manner (in a high frequency manner)) to the second circuit unit 20 via the capacitor 94, the reference potential terminal 3C is connected (connected in an AC manner (in a high frequency manner)) to the third circuit unit 30 via the capacitor 94, and the reference potential terminal 3D is connected (connected in a DC manner) to the third circuit unit 30 via the inductor 92. In addition, in FIG. 25, the reference potential terminal 3D is connected (connected in a DC manner) to the second circuit unit 20 via the inductor 92 and the third circuit unit 30. Further, in FIG. 25, the reference potential terminal 3D is connected (connected in a DC manner) to the first circuit unit 10 via the inductor 92, the third circuit unit 30 and the second circuit unit 20. Also, the reference potential terminals 3A, 3B, 3C and 3D may be shared by the first circuit unit 10, the second circuit unit 20 and the third circuit unit 30 or may be provided for each.

Figure 26:
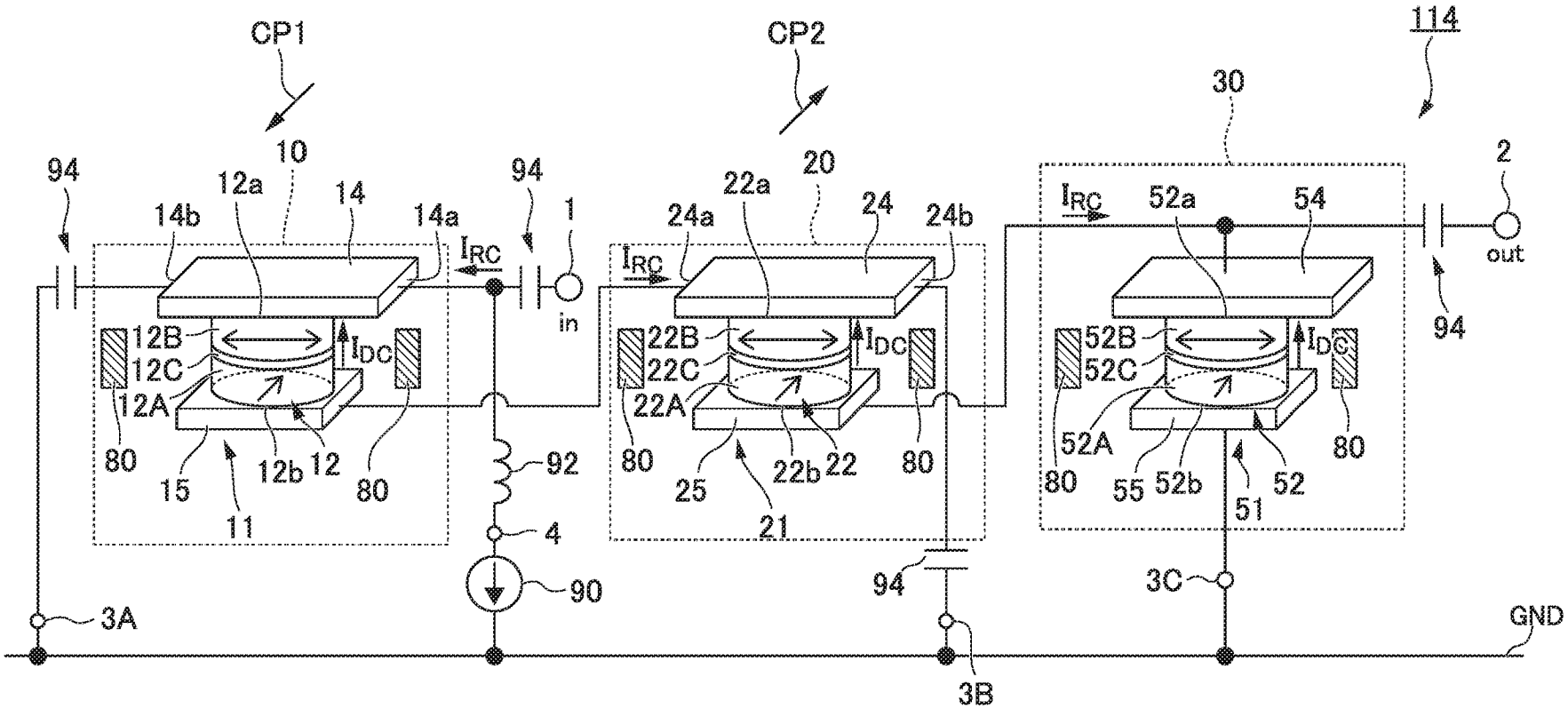
FIG. 26 is a schematic diagram showing a circuit configuration of another example of the magnetoresistance effect module according to the fifth embodiment.

Also, FIG. 26 is a schematic diagram showing a circuit configuration of another example of the magnetoresistance effect module according to the fifth embodiment. In FIG. 26, the same components as those in FIG. 24 are denoted by the same reference numerals. The magnetoresistance effect module 114 shown in FIG. 26 is different from the configuration shown in FIG. 24 in that the relative angle between the first cross product direction CP1 of the first circuit unit 10 and the second cross product direction CP2 of the second circuit unit 20 is larger than 90 degrees, and that, when the DC applying terminal 4 is connected to the power supply 90, the positional relationship between the first end face 12*a* and the second end face 12*b* in the first magnetoresistance effect element 12 with respect to the flowing direction of the direct current $I_{DC}$ flowing inside the first magnetoresistance effect element 12 and the positional relationship between the first end face 22*a* and the second end face 22*b* in the second magnetoresistance effect element 22 with respect to the flowing direction of the direct current $I_{DC}$ flowing inside the second magnetoresistance effect element 22 are the same (the positional relationship between the first end face 12*a* and the second end face 12*b* in the first magnetoresistance effect element 12 with respect to the connection point on the input side of the direct current or the direct current voltage of the first magnetoresistance effect element 12 and the positional relationship between the first end face 22*a* and the second end face 22*b* in the second magnetoresistance effect element 22 with respect to the connection point on the input side of the direct current or the direct current voltage of the magnetoresistance effect element 22 are the same). In FIG. 26, the reference potential terminal 3A is connected (connected in an AC manner (in a high frequency manner)) to the first circuit unit 10 via the capacitor 94, the reference potential terminal 3B is connected (connected in an AC manner (in a high frequency manner)) to the second circuit unit 20 via the capacitor 94, and the reference potential terminal 3C is connected to the third circuit unit 30. Further, in FIG. 26, the reference potential terminal 3C is connected to the second circuit unit 20 via the third circuit unit 30. Also, in FIG. 26, the reference potential terminal 3C is connected to the first circuit unit 10 via the third circuit unit 30 and the second circuit unit 20.

Specifically, the relative angle between the first cross product direction CP1 of the first circuit unit 10 and the second cross product direction CP2 of the second circuit unit 20 is 180 degrees and is larger than 90 degrees.

Also, in the first magnetoresistance effect element 12, the direct current $I_{DC}$ flows from the second end face 12*b* side toward the first end face 12*a*. Also, in the second magnetoresistance effect element 22, the direct current $I_{DC}$ flows from the second end face 22*b* side toward the first end face 22*a*. That is, when the DC applying terminal 4 is connected to the power supply 90, the positional relationship between the first end face 12*a* and the second end face 12*b* in the first magnetoresistance effect element 12 with respect to the flowing direction of the direct current $I_{DC}$ flowing inside the first magnetoresistance effect element 12 and the positional relationship between the first end face 22*a* and the second end face 22*b* in the second magnetoresistance effect element 22 with respect to the flowing direction of the direct current $I_{DC}$ flowing inside the second magnetoresistance effect element 22 are the same.

As described above, according to the magnetoresistance effect modules 113, 113A and 114 according to the present embodiment, excellent steepness of the magnetoresistance effect modules 113, 113A and 114 can be obtained as shown in FIG. 12B or FIG. 21B. In addition, by superimposing the Lorentzian-like signal characteristic of the third circuit unit 30 incorporating the current driven type element 51, it is possible to widen the bandwidth of the magnetoresistance effect modules 113, 113A and 114.

Figure 27:
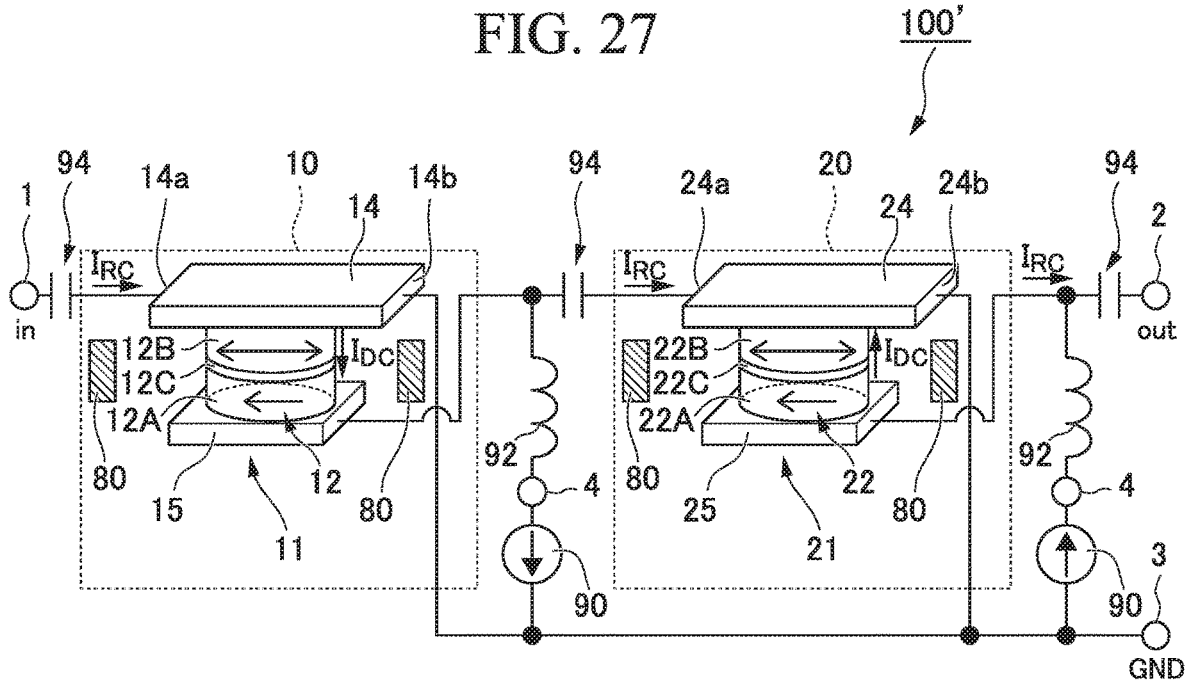
FIG. 27 is a schematic diagram showing a circuit configuration of a modified example of the magnetoresistance effect module shown in FIG. 1.
Figure 28:
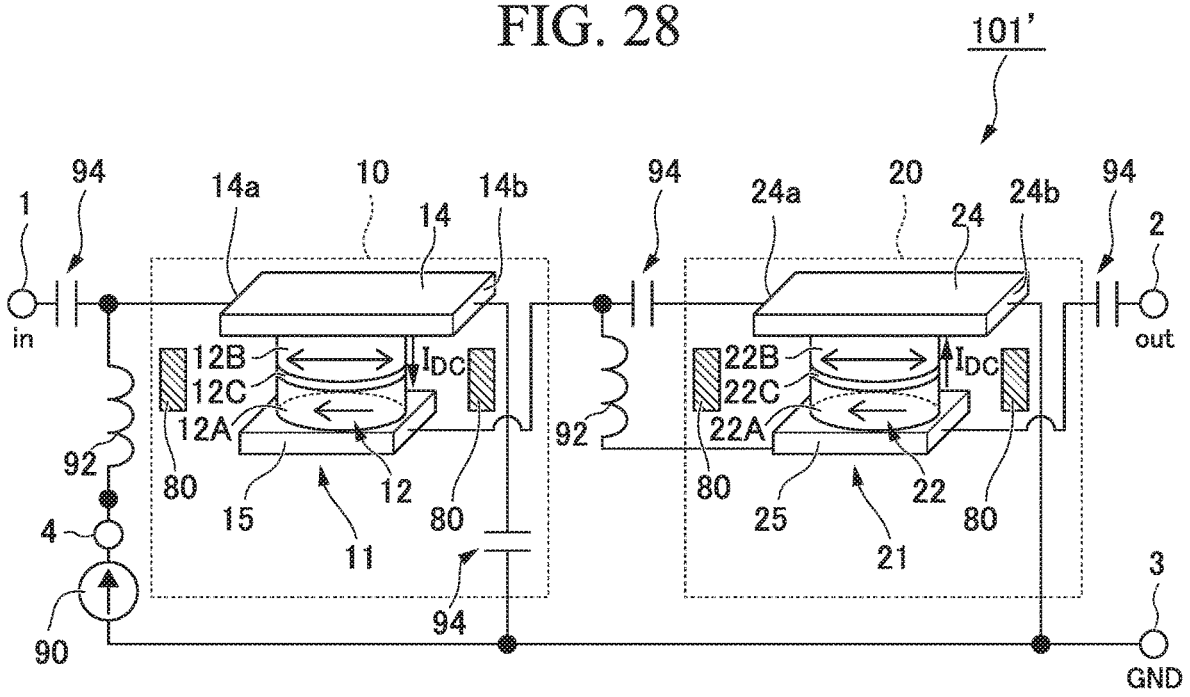
FIG. 28 is a schematic diagram showing a circuit configuration of a modified example of the magnetoresistance effect module shown in FIG. 3.
Figure 29:
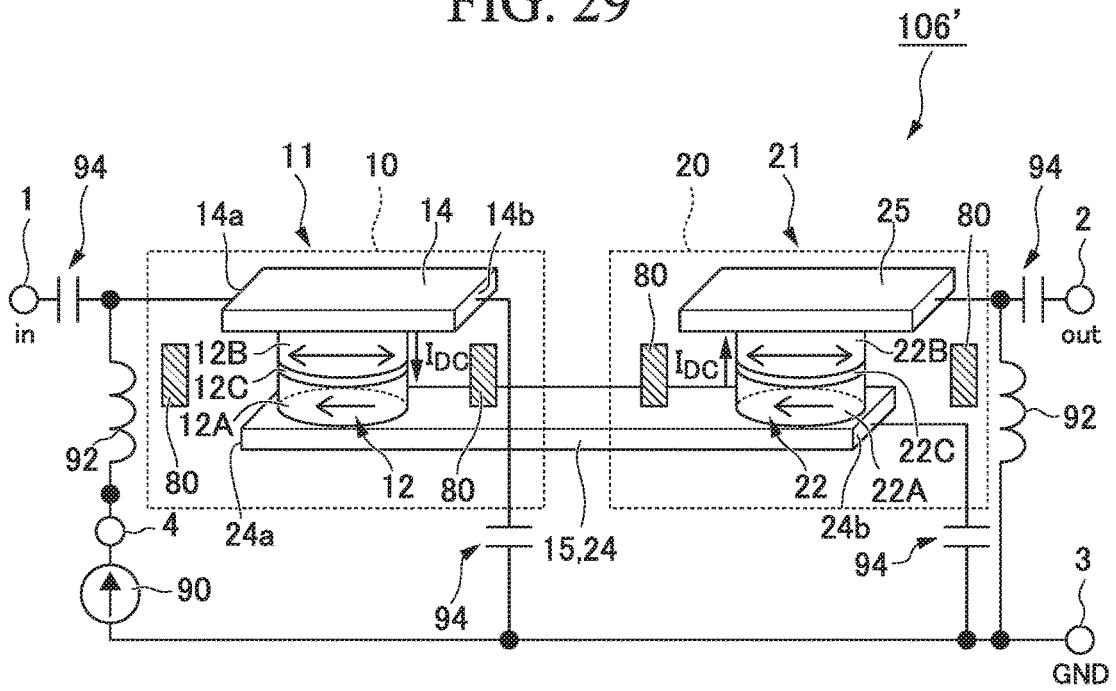
FIG. 29 is a schematic diagram showing a circuit configuration of a modified example of the magnetoresistance effect module shown in FIG. 9.
Figure 30:
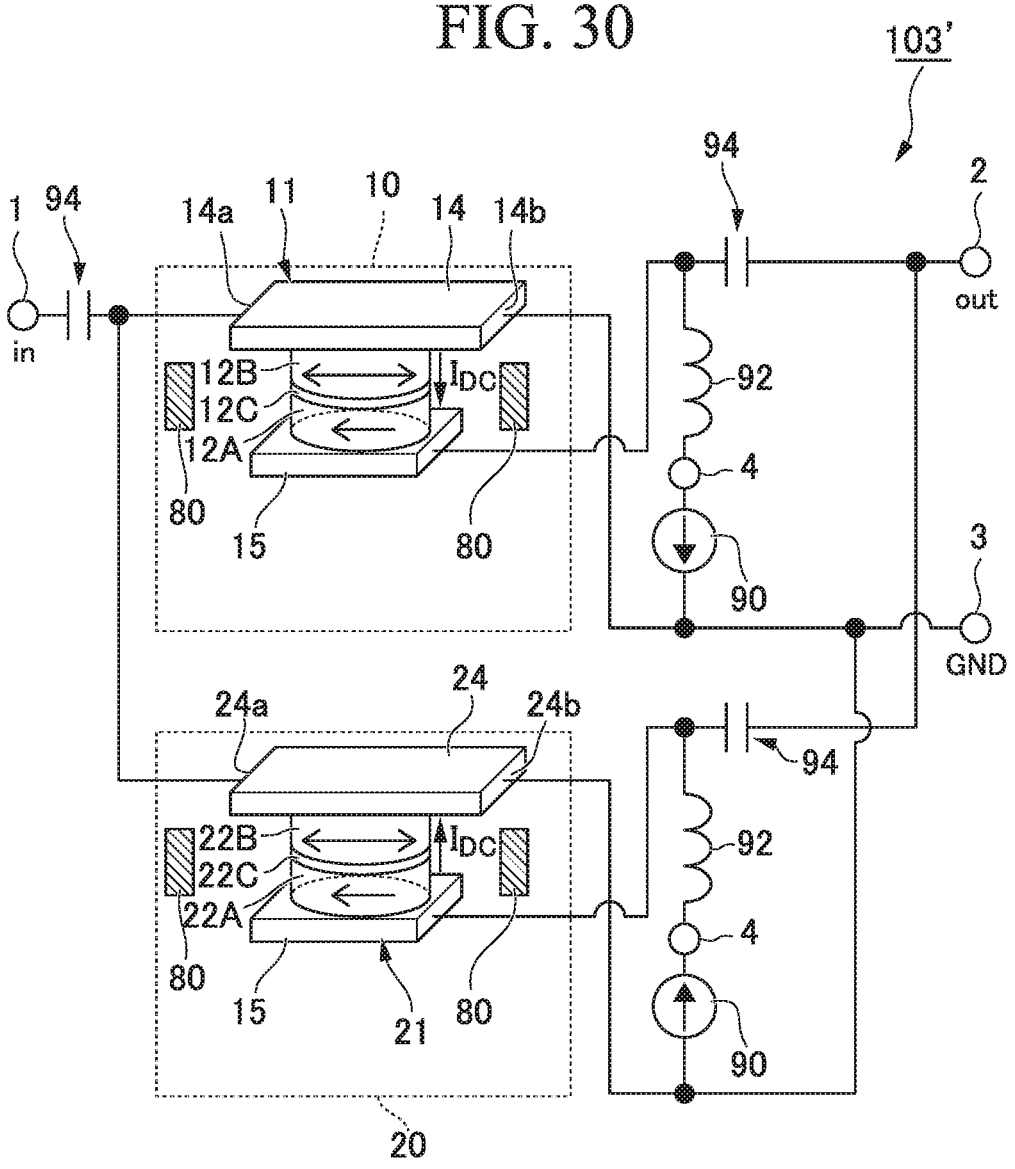
FIG. 30 is a schematic diagram showing a circuit configuration of a modified example of the magnetoresistance effect module shown in FIG. 5.
Figure 31:
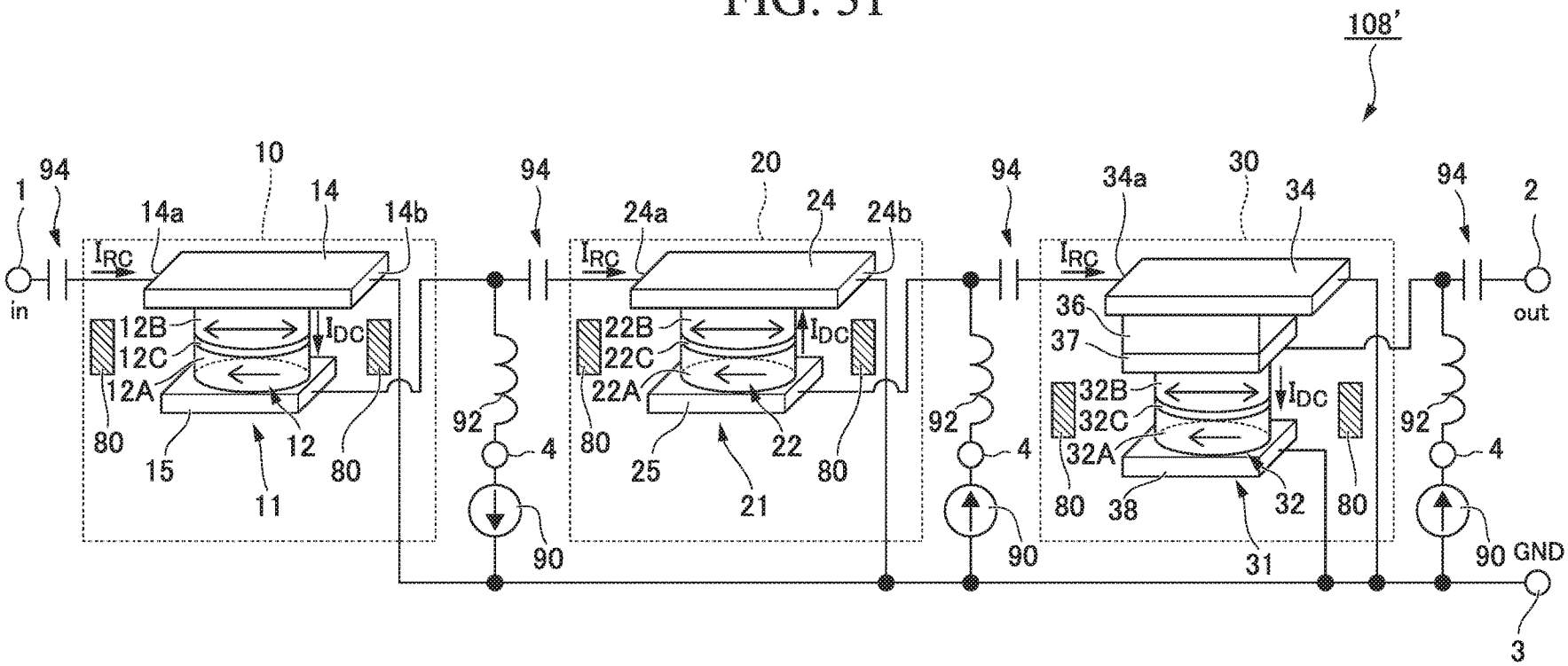
FIG. 31 is a schematic diagram showing a circuit configuration of a modified example of the magnetoresistance effect module shown in FIG. 11.
Figure 32:
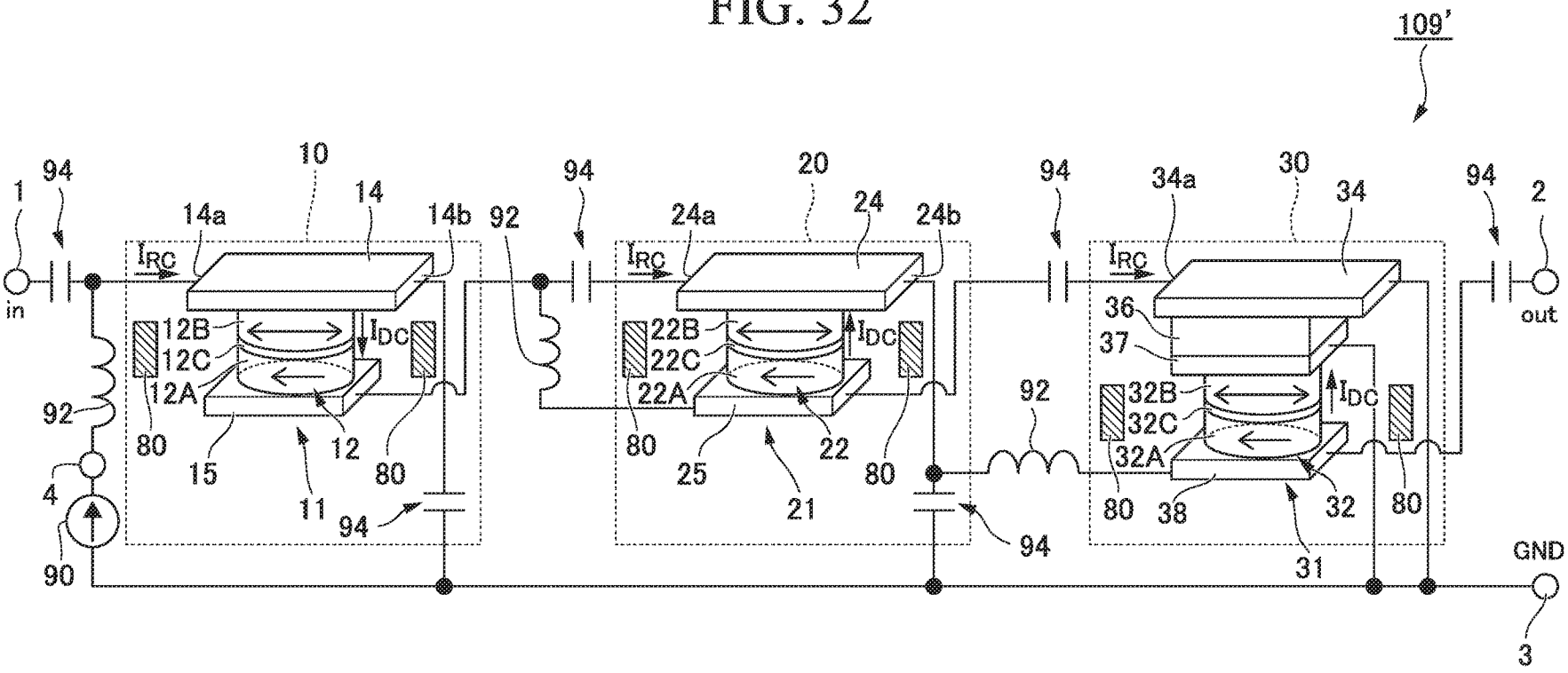
FIG. 32 is a schematic diagram showing a circuit configuration of a modified example of the magnetoresistance effect module shown in FIG. 14.
Figure 33:
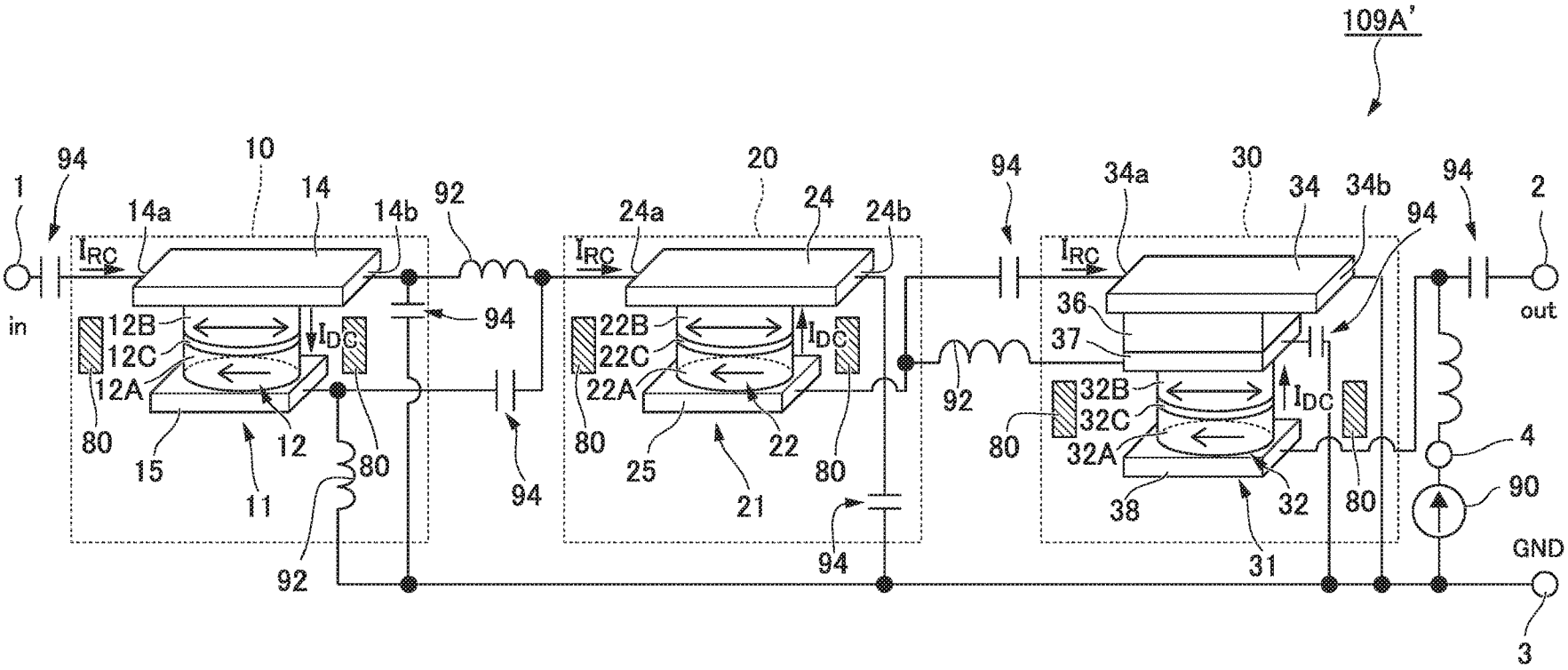
FIG. 33 is a schematic diagram showing a circuit configuration of a modified example of the magnetoresistance effect module shown in FIG. 15.
Figure 34:
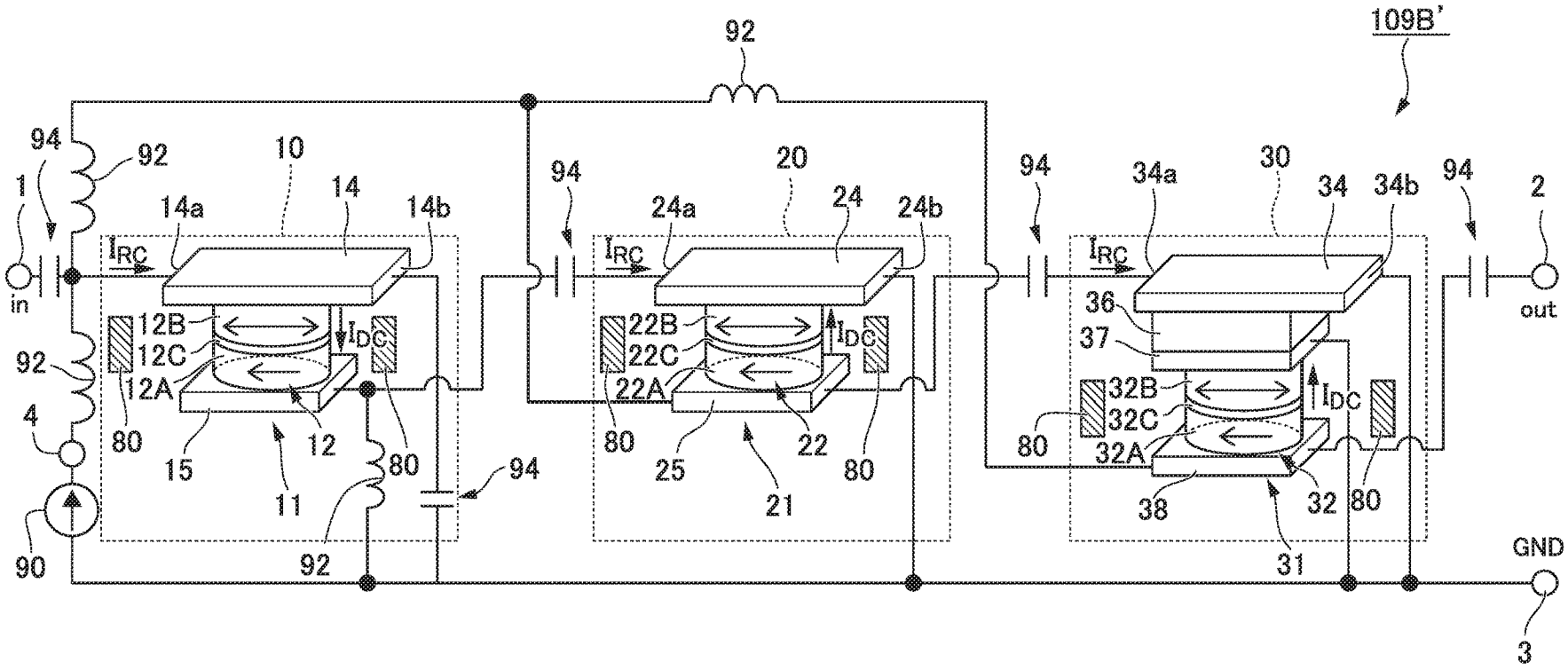
FIG. 34 is a schematic diagram showing a circuit configuration of a modified example of the magnetoresistance effect module shown in FIG. 16.
Figure 35:
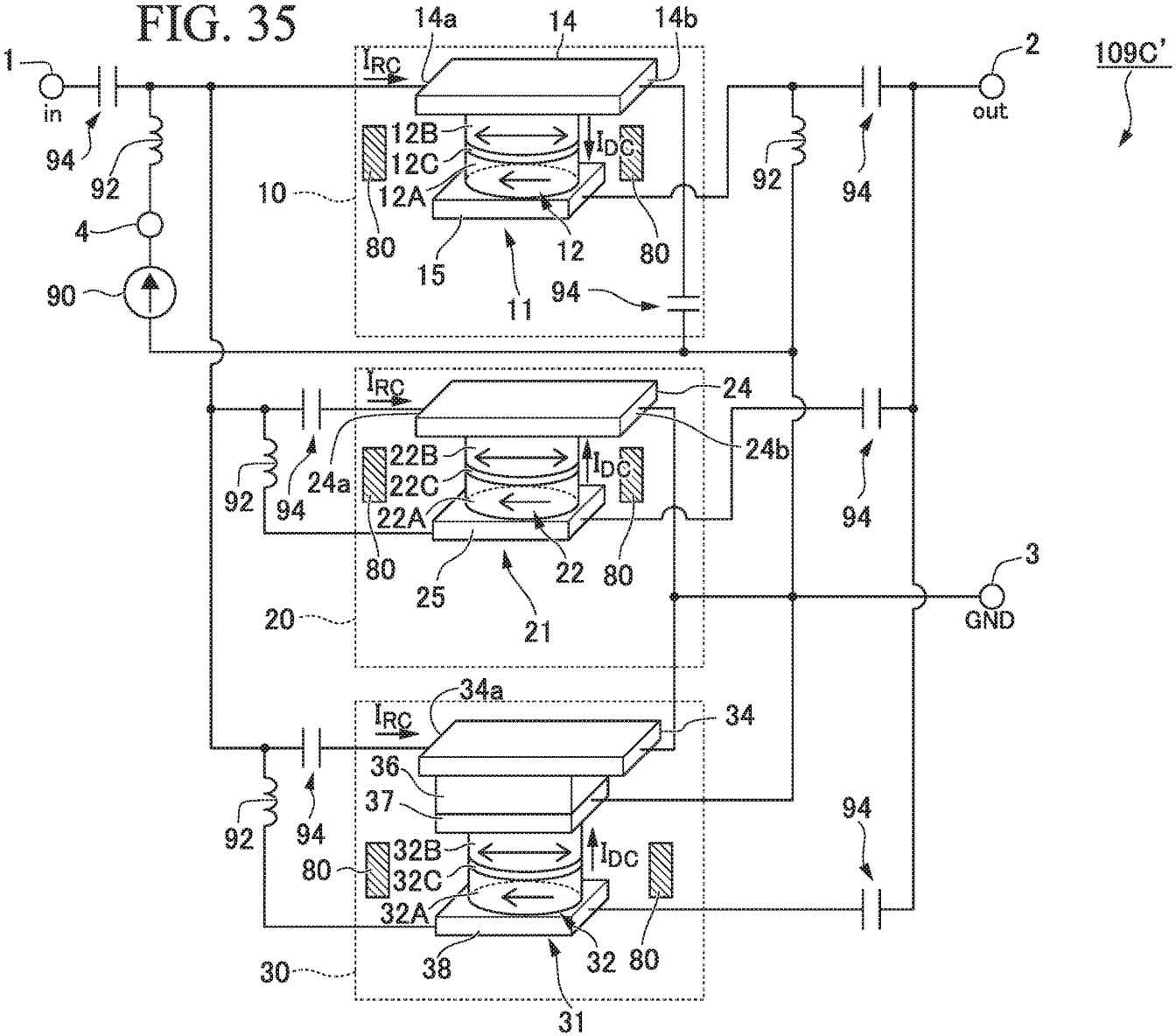
FIG. 35 is a schematic diagram showing a circuit configuration of a modified example of the magnetoresistance effect module shown in FIG. 17.
Figure 36:
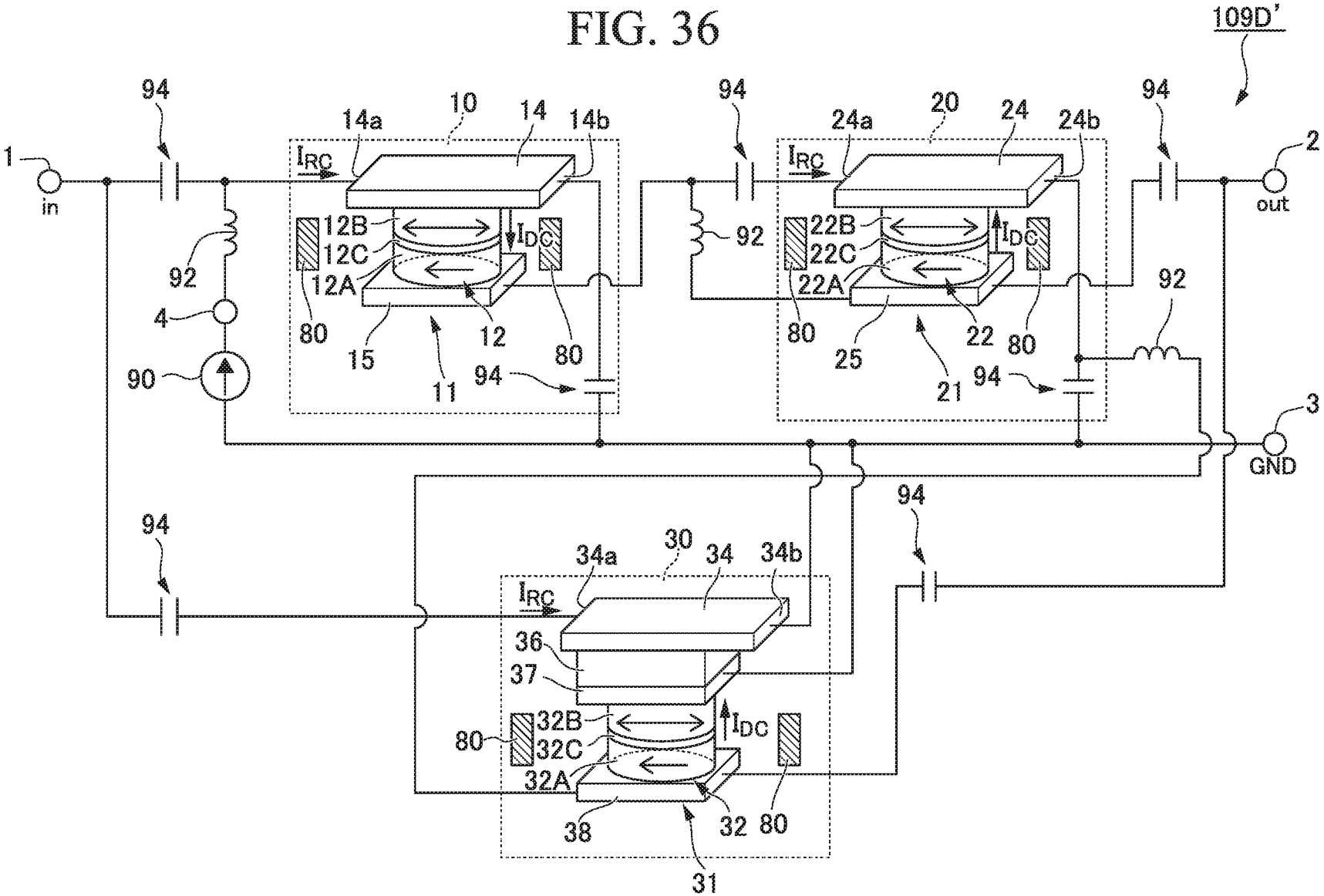
FIG. 36 is a schematic diagram showing a circuit configuration of a modified example of the magnetoresistance effect module shown in FIG. 18.
Figure 37:
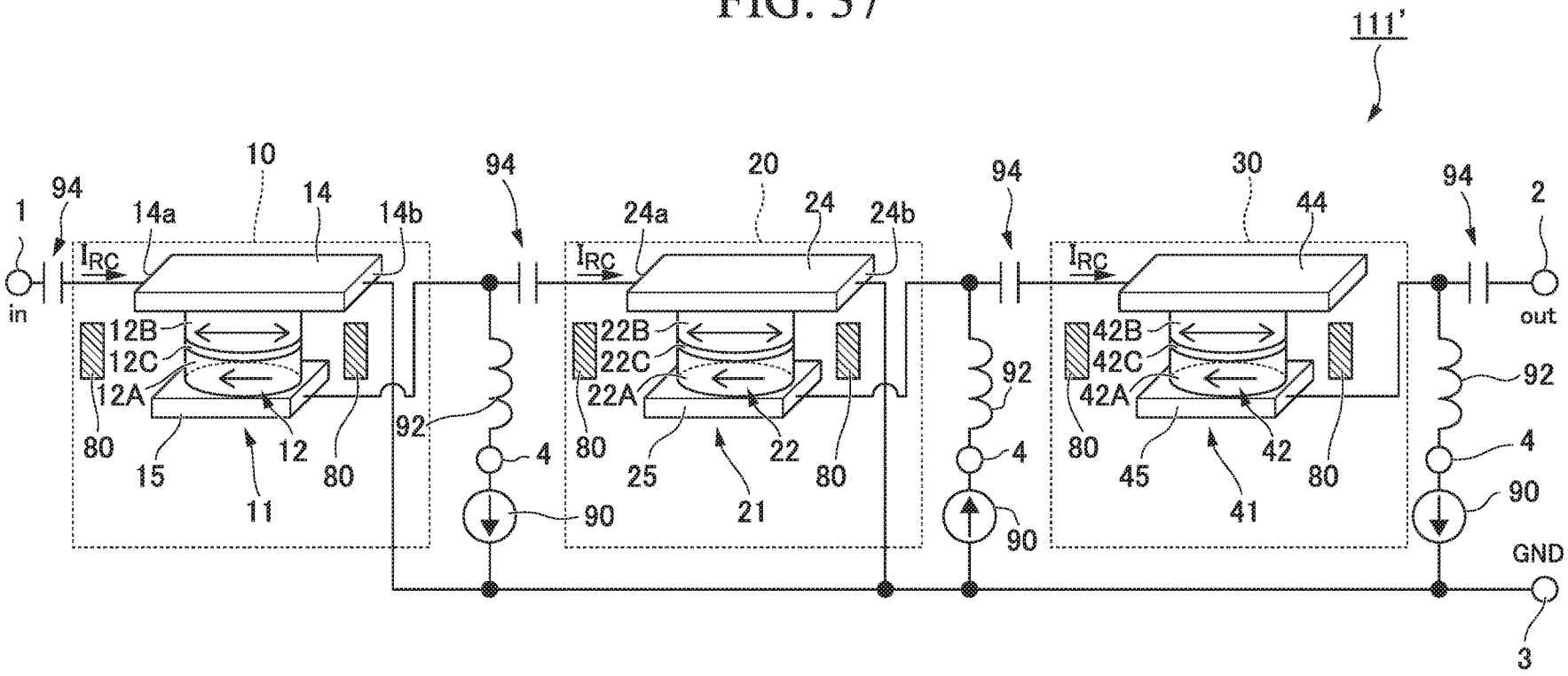
FIG. 37 is a schematic diagram showing a circuit configuration of a modified example of the magnetoresistance effect module shown in FIG. 20.
Figure 38:
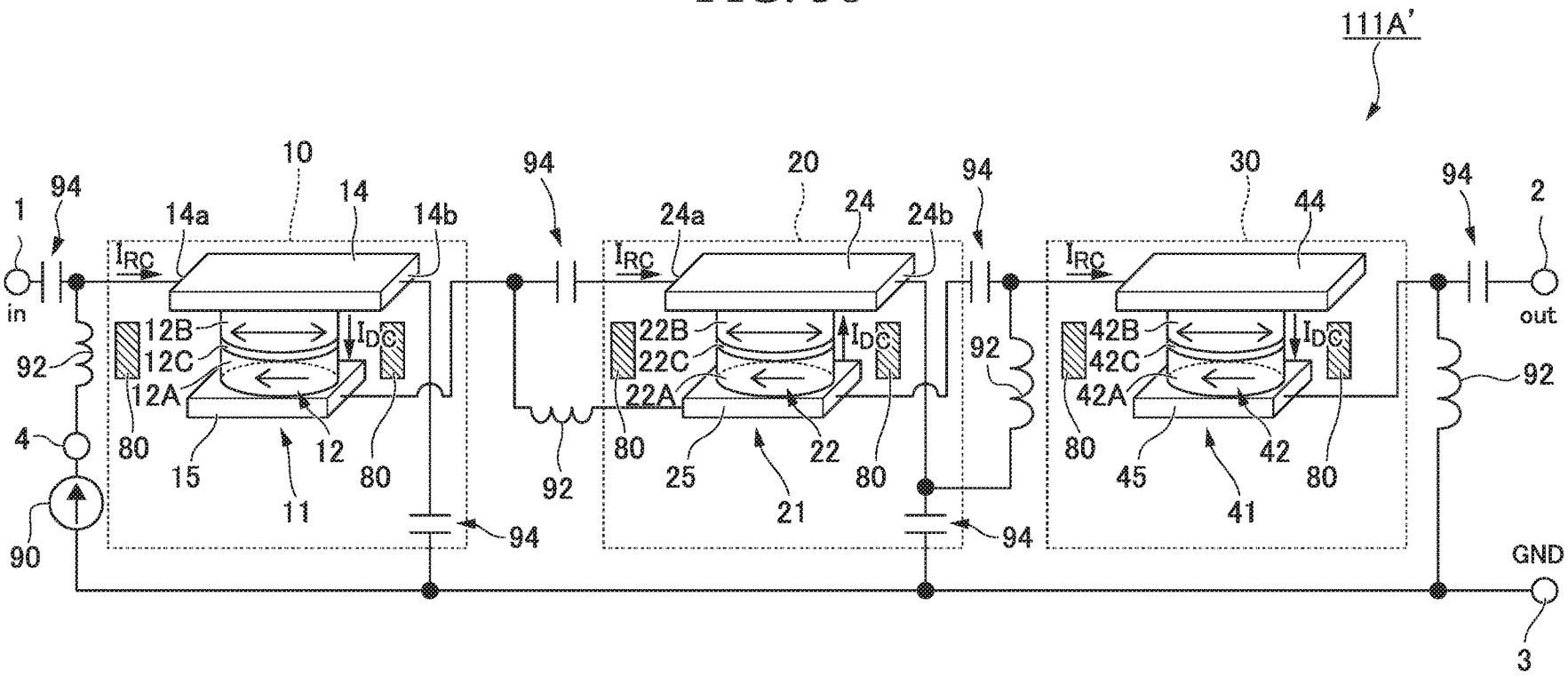
FIG. 38 is a schematic diagram showing a circuit configuration of a modified example of the magnetoresistance effect module shown in FIG. 22.
Figure 39:
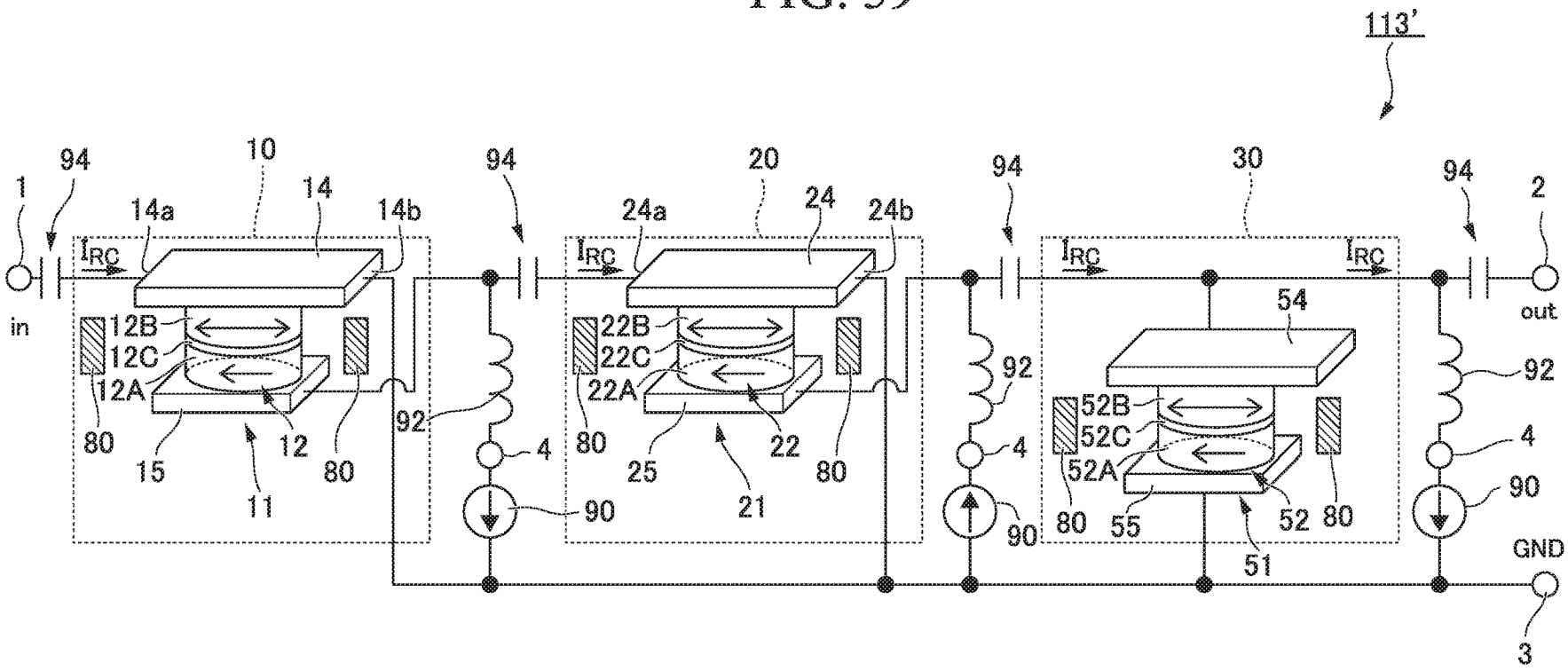
FIG. 39 is a schematic diagram showing a circuit configuration of a modified example of the magnetoresistance effect module shown in FIG. 24.
Figure 40:
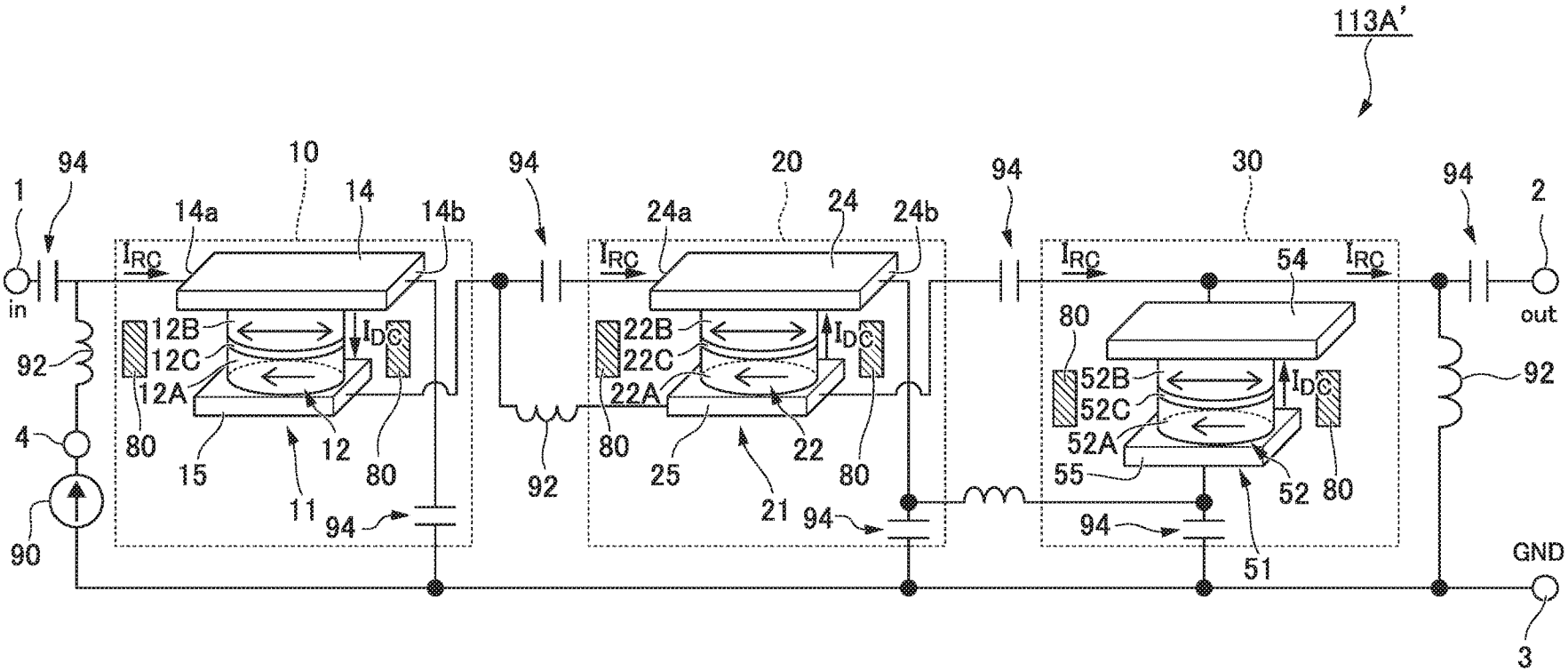
FIG. 40 is a schematic diagram showing a circuit configuration of a modified example of the magnetoresistance effect module shown in FIG. 25.

Also, FIG. 27 is a schematic diagram showing a circuit configuration of a modified example of the magnetoresistance effect module 100 shown in FIG. 1. FIG. 28 is a schematic diagram showing a circuit configuration of a modified example of the magnetoresistance effect module 101 shown in FIG. 3. FIG. 29 is a schematic diagram showing a circuit configuration of a modified example of the magnetoresistance effect module 106 shown in FIG. 9. FIG. 30 is a schematic diagram showing a circuit configuration of a modified example of the magnetoresistance effect module 103 shown in FIG. 5. FIG. 31 is a schematic diagram showing a circuit configuration of a modified example of the magnetoresistance effect module 108 shown in FIG. 11. FIG. 32 is a schematic diagram showing a circuit configuration of a modified example of the magnetoresistance effect module 109 shown in FIG. 14. FIG. 33 is a schematic diagram showing a circuit configuration of a modified example of the magnetoresistance effect module 109A shown in FIG. 15. FIG. 34 is a schematic diagram showing a circuit configuration of a modified example of the magnetoresistance effect module 109B shown in FIG. 16. FIG. 35 is a schematic diagram showing a circuit configuration of a modified example of the magnetoresistance effect module 109C shown in FIG. 17. FIG. 36 is a schematic diagram showing a circuit configuration of a modified example of the magnetoresistance effect module 109D shown in FIG. 18. FIG. 37 is a schematic diagram showing a circuit configuration of a modified example of the magnetoresistance effect module 111 shown in FIG. 20. FIG. 38 is a schematic diagram showing a circuit configuration of a modified example of the magnetoresistance effect module 111A shown in FIG. 22. FIG. 39 is a schematic diagram showing a circuit configuration of a modified example of the magnetoresistance effect module 113 shown in FIG. 24. FIG. 40 is a schematic diagram showing a circuit configuration of a modified example of the magnetoresistance effect module 113A shown in FIG. 25. In the magnetoresistance effect module shown in FIGS. 27 to 30, the reference potential terminals 3 are integrated into a common one for the first circuit unit 10 and the second circuit unit 20. Also, in the magnetoresistance effect module shown in FIGS. 31 to 40, the reference potential terminal 3 is commonly integrated into one with respect to the first circuit unit 10, the second circuit unit 20 and the third circuit unit 30. In addition, a power supply 90 is incorporated in the circuit of the magnetoresistance effect module. Even in the configurations of these modified examples, the magnetoresistance effect module has a pass band excellent in steepness on the low frequency side and the high frequency side.

The inductor 92 in the above embodiment can be changed to a resistance element. This resistance element has a function of cutting a high frequency component of a current by a resistance component. This resistance element may be any of a chip resistor and a resistor based on a pattern line. Preferably, a resistance value of the resistance element is equal to or higher than the characteristic impedance of the signal line output from the magnetoresistance effect element. For example, when the characteristic impedance of the signal line is 50Ω and the resistance value of the resistance element is 50Ω, high frequency power of 45% can be cut by the resistance element. In addition, when the characteristic impedance of the signal line is 50Ω and the resistance value of the resistance element is 500Ω, high frequency power of 90% can be cut by the resistance element. Even in this case, the output signal output from the magnetoresistance effect element can flow efficiently to the second port 2.

In the above embodiment, the inductor 92 may be omitted if the power supply 90 connected to the DC applying terminal 4 has a function of passing an invariant component of a current at the same time as cutting the high frequency component of the current off. Also in this case, the output signal output from the magnetoresistance effect element can flow efficiently to the second port 2.

Also, in the above embodiment, the frequency setting mechanism 80 has been described as a magnetic field applying mechanism. However, other examples described below can be used for the frequency setting mechanism 80. For example, an electric field applying mechanism that applies an electric field to the magnetoresistance effect element may be used as a frequency setting mechanism. When the electric field applied to the magnetization free layer of the magnetoresistance effect element is changed by the electric field applying mechanism, an anisotropic magnetic field in the magnetization free layer is changed and an effective magnetic field in the magnetization free layer is changed. Then, the ferromagnetic resonance frequency of the magnetization free layer is set.

Also, for example, a piezoelectric body and an electric field applying mechanism may be combined as a frequency setting mechanism. The piezoelectric body is provided in the vicinity of the magnetization free layer of the magnetoresistance effect element and an electric field is applied to the piezoelectric body. The piezoelectric body to which the electric field is applied is deformed to distort the magnetization free layer. When the magnetization free layer is distorted, the anisotropic magnetic field in the magnetization free layer is changed and the effective magnetic field in the magnetization free layer is changed. Then, the ferromagnetic resonance frequency of the magnetization free layer is set.

Also, for example, a control film which is an antiferromagnetic material or a ferrimagnetic material having an electromagnetic effect, a mechanism which applies a magnetic field to the control film, and a mechanism which applies an electric field to the control film may be used for the frequency setting mechanism. An electric field and a magnetic field are applied to the control film provided to magnetically couple with the magnetization free layer. When at least one of the electric field and the magnetic field applied to the control film is changed, the exchange coupling magnetic field in the magnetization free layer is changed and the effective magnetic field in the magnetization free layer is changed. Then, the ferromagnetic resonance frequency of the magnetization free layer is set.

Also, in the case where the ferromagnetic resonance frequency of the magnetization free layer of the magnetoresistance effect element is a desired frequency even if the frequency setting mechanism 80 is not provided (even if a static magnetic field is not applied from the magnetic field applying mechanism), the frequency setting mechanism 80 may not be provided.

When a magnetic field applying mechanism is used as the frequency setting mechanism 80, it is preferable to provide only one magnetic field applying mechanism for the magnetoresistance effect elements by sharing since the manufacturing cost is reduced. Further, an external magnetic field in the same direction may be applied to each magnetoresistance effect element from the magnetic field applying mechanism. In addition, magnetization fixation directions of the magnetization fixed layers of the magnetoresistance effect elements can be the same direction.

In addition, the external magnetic field applied from the magnetic field applying mechanism has been described with an example in which in-plane direction components of each magnetoresistance effect element are provided. However, an angle (hereinafter referred to as a rotation angle) formed by an in-plane direction component in a direction of the external magnetic field applied from the magnetic field applying mechanism to each magnetoresistance effect element and an in-plane direction component in a fixation direction of the magnetization of the magnetization fixed layer of each magnetoresistance effect element is preferably around 90 degrees in that the amount of change in the resistance value of each magnetoresistance effect element due to the oscillation of the magnetization of the magnetization free layer of each magnetoresistance effect element becomes great, but it may be an acute angle or an obtuse angle. For example, in the first magnetoresistance effect element 12 and the second magnetoresistance effect element 22, both rotation angles thereof may be 90 degrees, may be acute angles, or may be obtuse angles. Also, the rotation angle in the first magnetoresistance effect element 12 may be any one of an acute angle and an obtuse angle, and the rotation angle in the second magnetoresistance effect element 22 may be the other one of the acute angle and the obtuse angle. Also, the rotation angle in the first magnetoresistance effect element 12 may be either an acute angle or an obtuse angle, and the rotation angle in the second magnetoresistance effect element 22 may be 90 degrees. Also, the rotation angle in the first magnetoresistance effect element 12 may be 90 degrees, and the rotation angle in the second magnetoresistance effect element 22 may be either an acute angle or an obtuse angle.

Further, the external magnetic field applied from the magnetic field applying mechanism may have a stacking direction component of each magnetoresistance effect element. The angle (hereinafter referred to as an elevation angle) formed by the stacking direction component in a direction of the external magnetic field applied to each magnetoresistance effect element from the magnetic field applying mechanism and the in-plane direction component in the fixation direction of magnetization of the magnetization fixed layer of each magnetoresistance effect element (the in-plane direction of the magnetization fixed layer) may be an acute angle or an obtuse angle. For example, in the first magnetoresistance effect element 12 and the second magnetoresistance effect element 22, both the elevation angles may be acute angles or may be obtuse angles. Also, the elevation angle in the first magnetoresistance effect element 12 may be any one of an acute angle and an obtuse angle, and the elevation angle in the second magnetoresistance effect element 22 may be the other one of the acute angle and the obtuse angle.

<Other Uses>

In the above description, although the case where the magnetoresistance effect device is used as a high frequency filter has been presented as an example, the magnetoresistance effect device can also be used as a high frequency device such as an amplifier (amplifier).

Further, when the magnetoresistance effect device is used as an amplifier, the direct current or the direct current voltage applied from the power supply 90 is set to a predetermined magnitude or more. By doing so, the signal output from the second port 2 becomes larger than the signal input from the first port 1 and the magnetoresistance effect device functions as an amplifier.

As described above, the magnetoresistance effect device can function as a high frequency device such as an amplifier.

The invention claimed is:

1. A magnetoresistance effect device comprising:

a first port;

a second port;

a first circuit unit and a second circuit unit which are connected between the first port and the second port;

a shared reference potential terminal which is connected to the first circuit unit and the second circuit unit by sharing or a first reference potential terminal and a second reference potential terminal which are connected to the first circuit unit and the second circuit unit, respectively; and a shared DC applying terminal which is capable of connecting a power source for applying a direct current or a direct current voltage to a first magnetoresistance effect element of the first circuit unit and a second magnetoresistance effect element of the second circuit unit by sharing, or a first DC applying terminal and a second DC applying terminal which are capable of connecting a power source for applying a direct current or a direct current voltage to a first magnetoresistance effect element of the first circuit unit and a second magnetoresistance effect element of the second circuit unit, respectively, wherein the first circuit unit includes the first magnetoresistance effect element including a magnetization fixed layer, a magnetization free layer, and a spacer layer sandwiched therebetween, and a first conductor connected to a first end face in a stacking direction of the first magnetoresistance effect element, the first conductor is formed such that a first end portion of the first conductor is connected to an input side of a high frequency current and a second end portion of the first conductor is connected to the shared reference potential terminal or the first reference potential terminal so that a high frequency current branches to flow to the first magnetoresistance effect element and the shared reference potential terminal or the first reference potential terminal, the second circuit unit includes the second magnetoresistance effect element including a magnetization fixed layer, a magnetization free layer, and a spacer layer sandwiched therebetween, and a second conductor connected to a first end face in a stacking direction of the second magnetoresistance effect element, the second conductor is formed such that a first end portion of the second conductor is connected to an input side of a high frequency current and a second end portion of the second conductor is connected to the shared reference potential terminal or the second reference potential terminal so that a high frequency current branches to flow to the second magnetoresistance effect element and the shared reference potential terminal or the second reference potential terminal, when the shared DC applying terminal or the first DC applying terminal and the second DC applying terminal are connected to a power source, a positional relationship between the first end face and a second end face opposite to the first end face of the first magnetoresistance effect element in the stacking direction of the first magnetoresistance effect element with respect to a flowing direction of a direct current flowing inside the first magnetoresistance effect element and a positional relationship between the first end face and a second end face opposite to the first end face of the second magnetoresistance effect element in the stacking direction of the second magnetoresistance effect element with respect to a flowing direction of a direct current flowing inside the second magnetoresistance effect element are opposite to each other, and in a case where, when viewed in the stacking direction of the first magnetoresistance effect element, a direction from the first end portion toward the second end portion of the first conductor in a region where the first conductor overlaps the first magnetoresistance effect element is defined as a first direction, a stacking direction of the first magnetoresistance effect element with the first conductor as a reference is defined as a first stacking direction, and a direction of an cross product between the first direction and the first stacking direction is defined as a first cross product direction, and when viewed in the stacking direction of the second magnetoresistance effect element, a direction from the first end portion toward the second end portion of the second conductor in a region where the second conductor overlaps the second magnetoresistance effect element is defined as a second direction, a stacking direction of the second magnetoresistance effect element with the second conductor as a reference is defined as a second stacking direction, and a direction of an cross product between the second direction and the second stacking direction is defined as a second cross product direction, a relative angle between the first cross product direction and the second cross product direction is 90 degrees or less.

2. The magnetoresistance effect device according to claim 1, further comprising:

a third circuit unit which is connected between the first port and the second port, wherein the third circuit unit includes a third magnetoresistance effect element including a magnetization fixed layer, a magnetization free layer, and a spacer layer sandwiched therebetween, and a third conductor which is disposed separately from the third magnetoresistance effect element with an insulator interposed therebetween, the shared reference potential terminal, the first reference potential terminal, the second reference potential terminal or a third reference potential terminal is connected to the third circuit unit, the third magnetoresistance effect element is connected to the shared DC applying terminal, the first DC applying terminal, the second DC applying terminal or a third DC applying terminal which is capable of connecting a power source for applying a direct current or a direct current voltage to the third magnetoresistance effect element, and a first end portion of the third conductor is connected to an input side of a high frequency current so that a high frequency magnetic field generated by a high frequency current flowing through the third conductor is applied to the magnetization free layer of the third magnetoresistance effect element.

3. The magnetoresistance effect device according to claim 1, further comprising:

a third circuit unit which is connected between the first port and the second port, wherein the third circuit unit includes a fourth magnetoresistance effect element including a magnetization fixed layer, a magnetization free layer, and a spacer layer sandwiched therebetween, the shared reference potential terminal, the first reference potential terminal, the second reference potential terminal or a third reference potential terminal is connected to the third circuit unit, the fourth magnetoresistance effect element is connected to the shared DC applying terminal, the first DC applying terminal, the second DC applying terminal or a third DC applying terminal which is capable of connecting a power source for applying a direct current or a direct current voltage to the fourth magnetoresistance effect element, and one end of the fourth magnetoresistance effect element is connected to an input side of a high frequency current in the third circuit unit and the other end of the fourth magnetoresistance effect element is connected to an output side of a high frequency current in the third circuit unit.

4. The magnetoresistance effect device according to claim 1, further comprising:

a third circuit unit which is connected between the first port and the second port, wherein the third circuit unit includes a fifth magnetoresistance effect element including a magnetization fixed layer, a magnetization free layer, and a spacer layer sandwiched therebetween, the shared reference potential terminal, the first reference potential terminal, the second reference potential terminal or a third reference potential terminal is connected to the third circuit unit, the fifth magnetoresistance effect element is connected to the shared DC applying terminal, the first DC applying terminal, the second DC applying terminal or a third DC applying terminal which is capable of connecting a power source for applying a direct current or a direct current voltage to the fifth magnetoresistance effect element, and one end of the fifth magnetoresistance effect element is connected to an input side and an output side of a high frequency current in the third circuit unit and the other end of the fifth magnetoresistance effect element is connected to the shared reference potential terminal, the first reference potential terminal, the second reference potential terminal or the third reference potential terminal.

5. A magnetoresistance effect module comprising:

the magnetoresistance effect device according to claim 1; and a shared direct current source or a shared direct current voltage source which is connected to the shared DC applying terminal of the magnetoresistance effect device, or a first direct current source or a first direct current voltage source and a second direct current source or a second direct current voltage source which are connected to the first DC applying terminal and the second DC applying terminal of the magnetoresistance effect device, respectively.

6. A magnetoresistance effect device comprising:

a first port;

a second port;

a first circuit unit and a second circuit unit which are connected between the first port and the second port;

a shared reference potential terminal which is connected to the first circuit unit and the second circuit unit by sharing or a first reference potential terminal and a second reference potential terminal which are connected to the first circuit unit and the second circuit unit, respectively; and a shared DC applying terminal which is capable of connecting a power source for applying a direct current or a direct current voltage to a first magnetoresistance effect element of the first circuit unit and a second magnetoresistance effect element of the second circuit unit by sharing, or a first DC applying terminal and a second DC applying terminal which are capable of connecting a power source for applying a direct current or a direct current voltage to a first magnetoresistance effect element of the first circuit unit and a second magnetoresistance effect element of the second circuit unit, respectively, wherein the first circuit unit includes the first magnetoresistance effect element including a magnetization fixed layer, a magnetization free layer, and a spacer layer sandwiched therebetween, and a first conductor connected to a first end face in a stacking direction of the first magnetoresistance effect element, the first conductor is formed such that a first end portion of the first conductor is connected to an input side of a high frequency current and a second end portion of the first conductor is connected to the shared reference potential terminal or the first reference potential terminal so that a high frequency current branches to flow to the first magnetoresistance effect element and the shared reference potential terminal or the first reference potential terminal, the second circuit unit includes the second magnetoresistance effect element including a magnetization fixed layer, a magnetization free layer, and a spacer layer sandwiched therebetween, and a second conductor connected to a first end face in a stacking direction of the second magnetoresistance effect element, the second conductor is formed such that a first end portion of the second conductor is connected to an input side of a high frequency current and a second end portion of the second conductor is connected to the shared reference potential terminal or the second reference potential terminal so that a high frequency current branches to flow to the second magnetoresistance effect element and the shared reference potential terminal or the second reference potential terminal, a positional relationship between the first end face and a second end face opposite to the first end face of the first magnetoresistance effect element in the stacking direction of the first magnetoresistance effect element with respect to a connection point on an input side of a direct current or a direct current voltage of the first magnetoresistance effect element and a positional relationship between the first end face and a second end face opposite to the first end face of the second magnetoresistance effect element in the stacking direction of the second magnetoresistance effect element with respect to a connection point on an input side of a direct current or a direct current voltage of the second magnetoresistance effect element are opposite to each other, and in a case where, when viewed in the stacking direction of the first magnetoresistance effect element, a direction from the first end portion toward the second end portion of the first conductor in a region where the first conductor overlaps the first magnetoresistance effect element is defined as a first direction, a stacking direction of the first magnetoresistance effect element with the first conductor as a reference is defined as a first stacking direction, and a direction of an cross product between the first direction and the first stacking direction is defined as a first cross product direction, and when viewed in the stacking direction of the second magnetoresistance effect element, a direction from the first end portion toward the second end portion of the second conductor in a region where the second conductor overlaps the second magnetoresistance effect element is defined as a second direction, a stacking direction of the second magnetoresistance effect element with the second conductor as a reference is defined as a second stacking direction, and a direction of an cross product between the second direction and the second stacking direction is defined as a second cross product direction, a relative angle between the first cross product direction and the second cross product direction is 90 degrees or less.

7. The magnetoresistance effect device according to claim 6, further comprising:

a third circuit unit which is connected between the first port and the second port, wherein the third circuit unit includes a third magnetoresistance effect element including a magnetization fixed layer, a magnetization free layer, and a spacer layer sandwiched therebetween, and a third conductor which is disposed separately from the third magnetoresistance effect element with an insulator interposed therebetween, the shared reference potential terminal, the first reference potential terminal, the second reference potential terminal or a third reference potential terminal is connected to the third circuit unit, the third magnetoresistance effect element is connected to the shared DC applying terminal, the first DC applying terminal, the second DC applying terminal or a third DC applying terminal which is capable of connecting a power source for applying a direct current or a direct current voltage to the third magnetoresistance effect element, and a first end portion of the third conductor is connected to an input side of a high frequency current so that a high frequency magnetic field generated by a high frequency current flowing through the third conductor is applied to the magnetization free layer of the third magnetoresistance effect element.

8. A magnetoresistance effect module comprising:

the magnetoresistance effect device according to claim 6; and a shared direct current source or a shared direct current voltage source which is connected to the shared DC applying terminal of the magnetoresistance effect device, or a first direct current source or a first direct current voltage source and a second direct current source or a second direct current voltage source which are connected to the first DC applying terminal and the second DC applying terminal of the magnetoresistance effect device, respectively.

9. The magnetoresistance effect device according to claim 6, further comprising:

a third circuit unit which is connected between the first port and the second port, wherein the third circuit unit includes a fifth magnetoresistance effect element including a magnetization fixed layer, a magnetization free layer, and a spacer layer sandwiched therebetween, the shared reference potential terminal, the first reference potential terminal, the second reference potential terminal or a third reference potential terminal is connected to the third circuit unit, the fifth magnetoresistance effect element is connected to the shared DC applying terminal, the first DC applying terminal, the second DC applying terminal or a third DC applying terminal which is capable of connecting a power source for applying a direct current or a direct current voltage to the fifth magnetoresistance effect element, and one end of the fifth magnetoresistance effect element is connected to an input side and an output side of a high frequency current in the third circuit unit and the other end of the fifth magnetoresistance effect element is connected to the shared reference potential terminal, the first reference potential terminal, the second reference potential terminal or the third reference potential terminal.

10. The magnetoresistance effect device according to claim 6, further comprising:

a third circuit unit which is connected between the first port and the second port, wherein the third circuit unit includes a fourth magnetoresistance effect element including a magnetization fixed layer, a magnetization free layer, and a spacer layer sandwiched therebetween, the shared reference potential terminal, the first reference potential terminal, the second reference potential terminal or a third reference potential terminal is connected to the third circuit unit, the fourth magnetoresistance effect element is connected to the shared DC applying terminal, the first DC applying terminal, the second DC applying terminal or a third DC applying terminal which is capable of connecting a power source for applying a direct current or a direct current voltage to the fourth magnetoresistance effect element, and one end of the fourth magnetoresistance effect element is connected to an input side of a high frequency current in the third circuit unit and the other end of the fourth magnetoresistance effect element is connected to an output side of a high frequency current in the third circuit unit.

11. A magnetoresistance effect device comprising:

a first port;

a second port;

a first circuit unit and a second circuit unit which are connected between the first port and the second port;

a shared reference potential terminal which is connected to the first circuit unit and the second circuit unit by sharing or a first reference potential terminal and a second reference potential terminal which are connected to the first circuit unit and the second circuit unit, respectively; and a shared DC applying terminal which is capable of connecting a power source for applying a direct current or a direct current voltage to a first magnetoresistance effect element of the first circuit unit and a second magnetoresistance effect element of the second circuit unit by sharing, or a first DC applying terminal and a second DC applying terminal which are capable of connecting a power source for applying a direct current or a direct current voltage to a first magnetoresistance effect element of the first circuit unit and a second magnetoresistance effect element of the second circuit unit, respectively, wherein the first circuit unit includes the first magnetoresistance effect element including a magnetization fixed layer, a magnetization free layer, and a spacer layer sandwiched therebetween, and a first conductor connected to a first end face in a stacking direction of the first magnetoresistance effect element, the first conductor is formed such that a first end portion of the first conductor is connected to an input side of a high frequency current and a second end portion of the first conductor is connected to the shared reference potential terminal or the first reference potential terminal so that a high frequency current branches to flow to the first magnetoresistance effect element and the shared reference potential terminal or the first reference potential terminal, the second circuit unit includes the second magnetoresistance effect element including a magnetization fixed layer, a magnetization free layer, and a spacer layer sandwiched therebetween, and a second conductor connected to a first end face in a stacking direction of the second magnetoresistance effect element, the second conductor is formed such that a first end portion of the second conductor is connected to an input side of a high frequency current and a second end portion of the second conductor is connected to the shared reference potential terminal or the second reference potential terminal so that a high frequency current branches to flow to the second magnetoresistance effect element and the shared reference potential terminal or the second reference potential terminal, when the shared DC applying terminal or the first DC applying terminal and the second DC applying terminal are connected to a power source, a positional relationship between the first end face and a second end face opposite to the first end face of the first magnetoresistance effect element in the stacking direction of the first magnetoresistance effect element with respect to a flowing direction of a direct current flowing inside the first magnetoresistance effect element and a positional relationship between the first end face and a second end face opposite to the first end face of the second magnetoresistance effect element in the stacking direction of the second magnetoresistance effect element with respect to a flowing direction of a direct current flowing inside the second magnetoresistance effect element are the same, and in a case where, when viewed in the stacking direction of the first magnetoresistance effect element, a direction from the first end portion toward the second end portion of the first conductor in a region where the first conductor overlaps the first magnetoresistance effect element is defined as a first direction, a stacking direction of the first magnetoresistance effect element with the first conductor as a reference is defined as a first stacking direction, and a direction of an cross product between the first direction and the first stacking direction is defined as a first cross product direction, and when viewed in the stacking direction of the second magnetoresistance effect element, a direction from the first end portion toward the second end portion of the second conductor in a region where the second conductor overlaps the second magnetoresistance effect element is defined as a second direction, a stacking direction of the second magnetoresistance effect element with the second conductor as a reference is defined as a second stacking direction, and a direction of an cross product between the second direction and the second stacking direction is defined as a second cross product direction, a relative angle between the first cross product direction and the second cross product direction is larger than 90 degrees.

12. The magnetoresistance effect device according to claim 11, further comprising:

a third circuit unit which is connected between the first port and the second port, wherein the third circuit unit includes a fourth magnetoresistance effect element including a magnetization fixed layer, a magnetization free layer, and a spacer layer sandwiched therebetween, the shared reference potential terminal, the first reference potential terminal, the second reference potential terminal or a third reference potential terminal is connected to the third circuit unit, the fourth magnetoresistance effect element is connected to the shared DC applying terminal, the first DC applying terminal, the second DC applying terminal or a third DC applying terminal which is capable of connecting a power source for applying a direct current or a direct current voltage to the fourth magnetoresistance effect element, and one end of the fourth magnetoresistance effect element is connected to an input side of a high frequency current in the third circuit unit and the other end of the fourth magnetoresistance effect element is connected to an output side of a high frequency current in the third circuit unit.

13. The magnetoresistance effect device according to claim 11, further comprising:

a third circuit unit which is connected between the first port and the second port, wherein the third circuit unit includes a third magnetoresistance effect element including a magnetization fixed layer, a magnetization free layer, and a spacer layer sandwiched therebetween, and a third conductor which is disposed separately from the third magnetoresistance effect element with an insulator interposed therebetween, the shared reference potential terminal, the first reference potential terminal, the second reference potential terminal or a third reference potential terminal is connected to the third circuit unit, the third magnetoresistance effect element is connected to the shared DC applying terminal, the first DC applying terminal, the second DC applying terminal or a third DC applying terminal which is capable of connecting a power source for applying a direct current or a direct current voltage to the third magnetoresistance effect element, and a first end portion of the third conductor is connected to an input side of a high frequency current so that a high frequency magnetic field generated by a high frequency current flowing through the third conductor is applied to the magnetization free layer of the third magnetoresistance effect element.

14. A magnetoresistance effect module comprising:

the magnetoresistance effect device according to claim 11; and a shared direct current source or a shared direct current voltage source which is connected to the shared DC applying terminal of the magnetoresistance effect device, or a first direct current source or a first direct current voltage source and a second direct current source or a second direct current voltage source which are connected to the first DC applying terminal and the second DC applying terminal of the magnetoresistance effect device, respectively.

15. The magnetoresistance effect device according to claim 11, further comprising:

a third circuit unit which is connected between the first port and the second port, wherein the third circuit unit includes a fifth magnetoresistance effect element including a magnetization fixed layer, a magnetization free layer, and a spacer layer sandwiched therebetween, the shared reference potential terminal, the first reference potential terminal, the second reference potential terminal or a third reference potential terminal is connected to the third circuit unit, the fifth magnetoresistance effect element is connected to the shared DC applying terminal, the first DC applying terminal, the second DC applying terminal or a third DC applying terminal which is capable of connecting a power source for applying a direct current or a direct current voltage to the fifth magnetoresistance effect element, and one end of the fifth magnetoresistance effect element is connected to an input side and an output side of a high frequency current in the third circuit unit and the other end of the fifth magnetoresistance effect element is connected to the shared reference potential terminal, the first reference potential terminal, the second reference potential terminal or the third reference potential terminal.

16. A magnetoresistance effect device comprising:

a first port;

a second port;

a first circuit unit and a second circuit unit which are connected between the first port and the second port;

a shared reference potential terminal which is connected to the first circuit unit and the second circuit unit by sharing or a first reference potential terminal and a second reference potential terminal which are connected to the first circuit unit and the second circuit unit, respectively; and a shared DC applying terminal which is capable of connecting a power source for applying a direct current or a direct current voltage to a first magnetoresistance effect element of the first circuit unit and a second magnetoresistance effect element of the second circuit unit by sharing, or a first DC applying terminal and a second DC applying terminal which are capable of connecting a power source for applying a direct current or a direct current voltage to the first magnetoresistance effect element of the first circuit unit and the second magnetoresistance effect element of the second circuit unit, respectively, wherein the first circuit unit includes the first magnetoresistance effect element including a magnetization fixed layer, a magnetization free layer, and a spacer layer sandwiched therebetween, and a first conductor connected to a first end face in a stacking direction of the first magnetoresistance effect element, the first conductor is formed such that a first end portion of the first conductor is connected to an input side of a high frequency current and a second end portion of the first conductor is connected to the shared reference potential terminal or the first reference potential terminal so that a high frequency current branches to flow to the first magnetoresistance effect element and the shared reference potential terminal or the first reference potential terminal, the second circuit unit includes the second magnetoresistance effect element including a magnetization fixed layer, a magnetization free layer, and a spacer layer sandwiched therebetween, and a second conductor connected to a first end face in a stacking direction of the second magnetoresistance effect element, the second conductor is formed such that a first end portion of the second conductor is connected to an input side of a high frequency current and a second end portion of the second conductor is connected to the shared reference potential terminal or the second reference potential terminal so that a high frequency current branches to flow to the second magnetoresistance effect element and the shared reference potential terminal or the second reference potential terminal, a positional relationship between the first end face and a second end face opposite to the first end face of the first magnetoresistance effect element in the stacking direction of the first magnetoresistance effect element with respect to a connection point on an input side of a direct current or a direct current voltage of the first magnetoresistance effect element and a positional relationship between the first end face and a second end face opposite to the first end face of the second magnetoresistance effect element in the stacking direction of the second magnetoresistance effect element with respect to a connection point on an input side of a direct current or a direct current voltage of the second magnetoresistance effect element are the same, and in a case where, when viewed in the stacking direction of the first magnetoresistance effect element, a direction from the first end portion toward the second end portion of the first conductor in a region where the first conductor overlaps the first magnetoresistance effect element is defined as a first direction, a stacking direction of the first magnetoresistance effect element with the first conductor as a reference is defined as a first stacking direction, and a direction of an cross product between the first direction and the first stacking direction is defined as a first cross product direction, and when viewed in the stacking direction of the second magnetoresistance effect element, a direction from the first end portion toward the second end portion of the second conductor in a region where the second conductor overlaps the second magnetoresistance effect element is defined as a second direction, a stacking direction of the second magnetoresistance effect element with the second conductor as a reference is defined as a second stacking direction, and a direction of an cross product between the second direction and the second stacking direction is defined as a second cross product direction, a relative angle between the first cross product direction and the second cross product direction is larger than 90 degrees.

17. The magnetoresistance effect device according to claim 16, further comprising:

a third circuit unit which is connected between the first port and the second port, wherein the third circuit unit includes a third magnetoresistance effect element including a magnetization fixed layer, a magnetization free layer, and a spacer layer sandwiched therebetween, and a third conductor which is disposed separately from the third magnetoresistance effect element with an insulator interposed therebetween, the shared reference potential terminal, the first reference potential terminal, the second reference potential terminal or a third reference potential terminal is connected to the third circuit unit, the third magnetoresistance effect element is connected to the shared DC applying terminal, the first DC applying terminal, the second DC applying terminal or a third DC applying terminal which is capable of connecting a power source for applying a direct current or a direct current voltage to the third magnetoresistance effect element, and a first end portion of the third conductor is connected to an input side of a high frequency current so that a high frequency magnetic field generated by a high frequency current flowing through the third conductor is applied to the magnetization free layer of the third magnetoresistance effect element.

18. The magnetoresistance effect device according to claim 16, further comprising:

a third circuit unit which is connected between the first port and the second port, wherein the third circuit unit includes a fourth magnetoresistance effect element including a magnetization fixed layer, a magnetization free layer, and a spacer layer sandwiched therebetween, the shared reference potential terminal, the first reference potential terminal, the second reference potential terminal or a third reference potential terminal is connected to the third circuit unit, the fourth magnetoresistance effect element is connected to the shared DC applying terminal, the first DC applying terminal, the second DC applying terminal or a third DC applying terminal which is capable of connecting a power source for applying a direct current or a direct current voltage to the fourth magnetoresistance effect element, and one end of the fourth magnetoresistance effect element is connected to an input side of a high frequency current in the third circuit unit and the other end of the fourth magnetoresistance effect element is connected to an output side of a high frequency current in the third circuit unit.

19. The magnetoresistance effect device according to claim 16, further comprising:

a third circuit unit which is connected between the first port and the second port, wherein the third circuit unit includes a fifth magnetoresistance effect element including a magnetization fixed layer, a magnetization free layer, and a spacer layer sandwiched therebetween, the shared reference potential terminal, the first reference potential terminal, the second reference potential terminal or a third reference potential terminal is connected to the third circuit unit, the fifth magnetoresistance effect element is connected to the shared DC applying terminal, the first DC applying terminal, the second DC applying terminal or a third DC applying terminal which is capable of connecting a power source for applying a direct current or a direct current voltage to the fifth magnetoresistance effect element, and one end of the fifth magnetoresistance effect element is connected to an input side and an output side of a high frequency current in the third circuit unit and the other end of the fifth magnetoresistance effect element is connected to the shared reference potential terminal, the first reference potential terminal, the second reference potential terminal or the third reference potential terminal.

20. A magnetoresistance effect module comprising:

the magnetoresistance effect device according to claim 16; and a shared direct current source or a shared direct current voltage source which is connected to the shared DC applying terminal of the magnetoresistance effect device, or a first direct current source or a first direct current voltage source and a second direct current source or a second direct current voltage source which are connected to the first DC applying terminal and the second DC applying terminal of the magnetoresistance effect device, respectively.

* * * * *